US008313098B2

(12) United States Patent
Hattori et al.

(10) Patent No.: US 8,313,098 B2
(45) Date of Patent: Nov. 20, 2012

(54) PAPER TRANSPORT DEVICE, PAPER PROCESSING APPARATUS, AND IMAGE FORMING APPARATUS WITH PAPER-JAMMING DETECTION UNIT

(75) Inventors: Hitoshi Hattori, Tokyo (JP); Masahiro Tamura, Kanagawa (JP); Nobuyoshi Suzuki, Tokyo (JP); Shuuya Nagasako, Kanagawa (JP); Naohiro Kikkawa, Kanagawa (JP); Kazuhiro Kobayashi, Kanagawa (JP); Tomohiro Furuhashi, Kanagawa (JP); Makoto Hidaka, Tokyo (JP); Junichi Tokita, Kanagawa (JP); Akira Kunieda, Tokyo (JP); Hiroshi Maeda, Aichi (JP); Tomoichi Nomura, Aichi (JP); Ichiro Ichihashi, Aichi (JP)

(73) Assignee: Ricoh Company, Limited, Tokyo (JP)

( * ) Notice: Subject to any disclaimer, the term of this patent is extended or adjusted under 35 U.S.C. 154(b) by 420 days.

(21) Appl. No.: 12/230,096

(22) Filed: Aug. 22, 2008

(65) Prior Publication Data

US 2009/0051100 A1 Feb. 26, 2009

(30) Foreign Application Priority Data

Aug. 24, 2007 (JP) ..... 2007-218634

(51) Int. Cl.
*B65H 43/00* (2006.01)

(52) U.S. Cl. ..... 271/176; 271/259

(58) Field of Classification Search ..... 271/176, 271/258.01, 259, 258.02
See application file for complete search history.

(56) References Cited

U.S. PATENT DOCUMENTS

| | | | | |
|---|---|---|---|---|
| 4,231,567 | A * | 11/1980 | Ziehm | 271/259 |
| 4,384,202 | A * | 5/1983 | Fasig | 250/223 R |
| 4,786,041 | A * | 11/1988 | Acquaviva et al. | 271/3.13 |
| 5,713,060 | A * | 1/1998 | Sato et al. | 399/20 |
| 7,328,892 | B2 | 2/2008 | Asami et al. | |
| 7,484,731 | B2 * | 2/2009 | Gutierrez-Vazquez et al. | 271/258.04 |
| 7,651,092 | B2 * | 1/2010 | Hirao et al. | 271/298 |
| 7,809,290 | B2 * | 10/2010 | Tamagaki | 399/21 |
| 8,052,144 | B2 * | 11/2011 | Kaneko et al. | 271/258.02 |
| 2006/0006594 | A1 * | 1/2006 | Kuru et al. | 271/258.02 |

(Continued)

FOREIGN PATENT DOCUMENTS

JP 62116440 A * 5/1987

(Continued)

OTHER PUBLICATIONS

Translation JP 4-338050 A.*

*Primary Examiner* — Gerald McClain
(74) *Attorney, Agent, or Firm* — Harness, Dickey & Pierce, P.L.C.

(57) ABSTRACT

A paper transport device is configured to independently drive a paper ejecting roller when predetermined abnormal events occur. When paper-jamming occurs and if no paper is present downstream of a jammed paper or a preceding paper that is present most downstream is located upstream of a predetermined position, the paper ejecting roller is stopped to prevent ejection of papers outside of the paper transport device. When paper-jamming occurs and if a preceding paper that is present most downstream is located downstream of the predetermined position, the paper ejecting roller is independently driven to complete ejection of the preceding paper.

24 Claims, 50 Drawing Sheets

U.S. PATENT DOCUMENTS

| | | | |
|---|---|---|---|
| 2006/0261544 | A1 | 11/2006 | Tamura et al. |
| 2007/0182082 | A1 | 8/2007 | Asami et al. |
| 2007/0235917 | A1 | 10/2007 | Nagasako et al. |
| 2008/0006993 | A1 | 1/2008 | Nomura et al. |
| 2008/0048380 | A1 | 2/2008 | Ichihashi et al. |
| 2008/0067730 | A1 | 3/2008 | Suzuki et al. |

FOREIGN PATENT DOCUMENTS

| | | | | |
|---|---|---|---|---|
| JP | 04338050 | A | * | 11/1992 |
| JP | 08-231121 | | | 9/1996 |
| JP | 08231121 | A | * | 9/1996 |
| JP | 09-071363 | | | 3/1997 |
| JP | 09071363 | A | * | 3/1997 |

* cited by examiner

PAPER TRANSPORT DEVICE, PAPER PROCESSING APPARATUS, AND IMAGE FORMING APPARATUS WITH PAPER-JAMMING DETECTION UNIT

CROSS-REFERENCE TO RELATED APPLICATIONS

The present application claims priority to and incorporates by reference the entire contents of Japanese priority document 2007-218634 filed in Japan on Aug. 24, 2007.

BACKGROUND OF THE INVENTION

1. Field of the Invention

The present invention relates to a technology for controlling driving of transport rollers in a paper transport device for use in a paper processing apparatus.

2. Description of the Related Art

In a paper post-processing apparatus used with an image forming apparatus, when abnormal events such as paper-jamming, cover's opening during paper transport, or mechanical abnormality occur, paper cannot be transported in a desired manner. Therefore, when such events occur, entire driving of the paper post-processing apparatus is forced to stop. When a paper that has being transported is remained in the paper post-processing apparatus at the time of stopping of the driving, a paper removal process is firstly performed and then a recovery process is performed on a remained paper so that the remained paper is subjected again to image forming processing, post-paper processing, and paper ejecting processing.

However, when the leading edge of a paper is present downstream of a paper ejecting roller at the time of stopping of the paper post-processing apparatus, the paper may be ejected outside of the apparatus due to delay in stopping of the paper ejecting roller even when the apparatus commands to keep the paper inside of the apparatus. Alternatively, a user may pull out the paper when the leading edge of the paper is ejected outside of the paper post-processing apparatus, and may consider the paper as acceptable. In this case, because the paper-post processing apparatus considers that the paper is still remained in the apparatus although the paper is actually ejected, the recovery process including image forming processing and paper processing is re-performed, resulting in redundant output.

For example, Japanese Patent Application Laid-open No. H09-71363 discloses a sheet post-processing apparatus that can cope with the above situation. Specifically, the sheet post-processing apparatus includes a plurality of sheet processing units each of which can be driven independently to execute a sequential process along a flow of transporting a sheet. With this configuration, it is possible to eliminate a remained sheet removal process resulting from stopping of the apparatus and to prevent interruption of sheet processing. More specifically, the sheet post-processing apparatus includes a stopping unit that, when abnormality is detected in any one of the sheet processing units, stops the sheet processing unit with the abnormality; a selecting unit that selects another sheet processing unit to be stopped simultaneously with the sheet processing unit with the abnormality based on a position of the sheet processing unit with the abnormality; and a simultaneous stopping unit that stops the selected sheet processing unit.

Furthermore, another sheet post-processing apparatus is disclosed in Japanese Patent Application Laid-open No. H08-231121. The sheet post-processing apparatus is configured such that even if paper-jamming occurs in a post-processing apparatus, sheet (paper) transport in an image forming apparatus need not be stopped immediately and a sheet removal process can be carried out easily. Specifically, the sheet post-processing apparatus receives a paper ejected out from a paper ejecting unit of an image forming apparatus and transports the received paper through a single transport path to a sorting unit, where the paper is sorted out and is transported for sheet alignment. This sheet post-processing apparatus includes an entrance guide plate disposed at an entrance end of the single transport path facing the paper ejecting unit of the image forming apparatus, and a releasing unit that releases the entrance guide plate when paper-jamming occurs in the sheet post-processing apparatus.

However, if a paper at the upstream side is stopped while a paper at the downstream side is being transported, such a trouble as folding, tearing, and roller abrasion (soil) of the paper at the downstream side may occur on the paper at the downstream side, especially when the distance between both papers is short. For example, when the trailing edge of the downstream paper has not passed a stopped roller after an upstream processing unit is stopped or when the downstream paper comes in contact with the upstream paper and causes a paper-jamming, the downstream paper is damaged by folding, breaking, roller abrasion (soil), or the like.

SUMMARY OF THE INVENTION

It is an object of the present invention to at least partially solve the problems in the conventional technology.

According to an aspect of the present invention, there is provided a paper transport device that includes a plurality of transport rollers that transport one or more papers at a time, the transport rollers includes an ejecting roller disposed at a position from which a paper is ejected outside of the paper transport device, the ejecting roller capable of running independent of other transport rollers; a paper-jamming detecting unit that detects paper-jamming of a paper that is being transported by the transport rollers; a position detecting unit that detects positions of papers that are being transported by the transport rollers; and a control unit that controls driving of the transport rollers, wherein when the paper-jamming detecting unit detects paper-jamming and the position detecting unit detects either that no paper is present downstream of a jammed paper, or that a preceding paper that is present most downstream is located upstream of a predetermined position, the control unit stops the transport rollers to prevent ejection of papers outside of the paper transport device, and when the paper-jamming detecting unit detects paper-jamming and the position detecting unit detects that a preceding paper that is present most downstream is located downstream of the predetermined position, the control unit drives the ejecting roller to complete ejection of the preceding paper.

According to another aspect of the present invention, there is provided a paper transport device that includes a plurality of transport rollers that transport one or more papers at a time, the transport rollers includes an ejecting roller disposed at a position from which a paper is ejected outside of the paper transport device, the ejecting roller capable of being driven independent of other transport rollers; an abnormality detecting unit that detects abnormality of each of mechanisms of the paper transfer device; a position detecting unit that detects positions of papers that are being transported by the transport rollers; and a control unit that controls driving of the transport rollers, wherein when the abnormality detecting unit detects abnormality of at least one of the mechanisms and the position detecting unit detects either that no paper is present downstream of a mechanism with the abnormality, or that a preceding paper that is present most downstream is located upstream of a predetermined position, the control unit stops the transport rollers to prevent ejection of papers outside of the paper transport device, and when the abnormality detecting unit detects abnormality of at least one of the mechanisms and the position detecting unit detects that a preceding paper that is present most downstream is located downstream of the predetermined position, the control unit drives the ejecting roller to complete ejection of the preceding paper.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
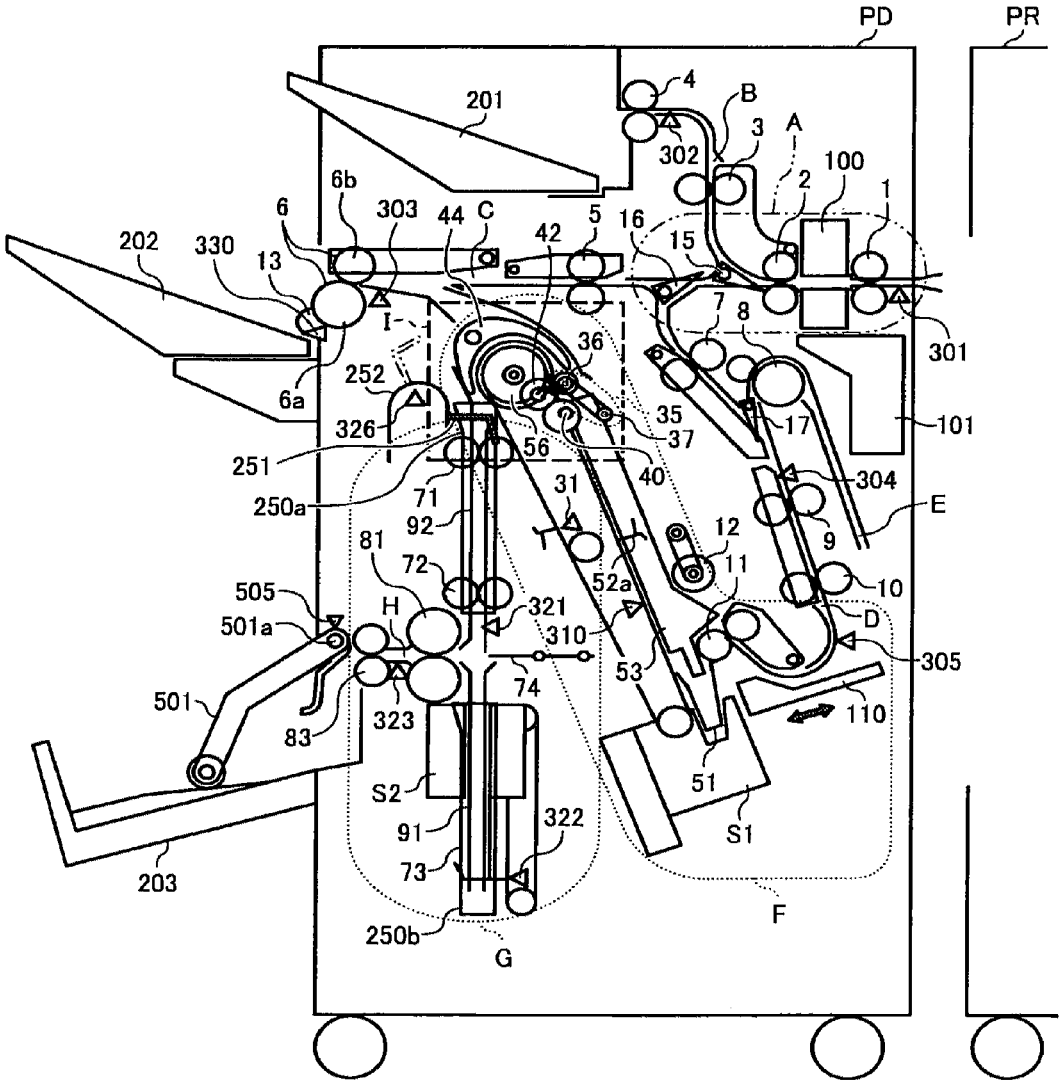
FIG. 1 is a schematic diagram of a system composed of a paper post-processing apparatus and an image forming apparatus according to an embodiment of the present invention.

Exemplary embodiments of the present invention are described in detail below with reference to the accompanying drawings.

In the following embodiments, a plurality of transport rollers correspond to an entrance roller 1, transport rollers 2 and 5, and a shift paper ejecting roller 6 (composed of a driving roller 6*a* and a driven roller 6*b*), (hereinafter, "paper ejecting roller 6"); an ejecting roller corresponds to the paper ejecting roller 6; a paper-jamming detecting unit corresponds to a CPU 360 and sensors 301, 302, 303, 304, 305, 306, 321, and 323 (although collectively referred to as "sensors", each of which is named uniquely as will be described below) that are disposed on transport paths; a position detecting unit corresponds to the sensors 301, 302, 303, 304, 305, 306, 310, 321, and 323 that are disposed on transport paths; a control unit corresponds to the CPU 360; a cover opening/closing detecting unit corresponds to a front cover opening/closing sensor 340; an abnormality detecting unit corresponds to the CPU 360; a first detecting unit corresponds to the shift paper ejecting sensor 303; a second detecting unit corresponds to the paper trailing edge detecting sensor 306; a paper processing apparatus corresponds to a paper post-processing apparatus PD; and an image forming apparatus corresponds to an image forming apparatus PR.

1. General Configuration

FIG. 1 is a schematic diagram of a system composed of a paper post-processing apparatus PD serving as a paper processing apparatus and an image forming apparatus PR according to the present embodiment.

The paper post-processing apparatus PD is attached to a side of the image forming apparatus PR, and a paper ejected out of the image forming apparatus PR is guided to the paper post-processing apparatus PD. The paper is distributed by branch nails 15 and 16 to a transport path A having a post-processing unit (a punching unit 100 serving as a holing unit in this embodiment) that carries out a post-process on a single paper, to a transport path B that guides the paper through the transport path A to an upper tray 201, to a transport path C that guides the paper to a shift tray 202, and to a transport path D that guides the paper to a processing tray F (hereinafter, "end face stitching process tray") that carries out paper aligning, stapling, etc.

The image forming apparatus PR at least includes the following components although drawings depicting the components are not provided: an image processing circuit that converts input data into printable image data; an optical writing device that optically writes in data on a photosensitive element based on an image signal output from the image processing circuit; a developing device that develops by toner a latent image formed on the photosensitive element by optical writing; a transfer device that transfers a toner image developed by the developing device to a paper; and a fixing device that fixes the toner image transferred onto the paper. The paper bearing a fixed toner image is sent to the paper post-processing apparatus PD, which carries out a desired post-process. The image forming apparatus PR is assumed as an electrophotographic type as described above, but can be any known image forming apparatuses employing an ink-jet method, thermal transport method, etc. In this embodiment, the image forming circuit, the optical writing device, the developing device, the transfer device, and the fixing device forms an image forming unit.

A paper is guided through the transport paths A and D to the end face stitching process tray F, where the paper is subjected to processing such as paper aligning or stapling. The paper is then distributed by a guide member 44 to the transport path C leading to the shift tray 202, and to a saddle stitching/center folding process tray G (hereinafter, "saddle stitching process tray"). The paper subjected to a folding process, etc. at the saddle stitching process tray G is guided through a transport path H to a lower tray 203. A branch nail 17 is disposed in the transport path D, where the branch nail 17 is kept in a state shown FIG. 1 by a low-load spring (not shown). After the trailing edge of the paper transported by a transport roller 7 has passed the branch nail 17, at least a transport roller 9 out of the transport roller 9, a transport roller 10, and a staple paper ejecting roller 11 is reversed to send the paper backward along a turn guide 8. As a result, the paper is guided with the trailing edge first to a paper storage unit E and reserved there (prestack), so that the paper is allowed to be stacked together with a next paper for further transport. Repeating this operation enables transport of a stack of two or more papers. Reference numeral 304 denotes a prestack sensor for setting a timing of reverse transport for making the paper prestacked.

The transport path A is shared by the transport paths B, C, and D at the upstream side thereof and provided with the entrance sensor 301 that detects a paper coming in from the image forming apparatus PR, the entrance roller 1, the punching unit 100, a punching residue hopper 101, the transport roller 2, and the branch nails 15 and 16, which are disposed in that order along the transport path A from the upstream side to the downstream side. The branch nails 15 and 16 are kept in a state shown in FIG. 1 by a spring (not shown), and are separately driven by turning on a solenoid (not shown). By changing a combination of turning ON/OFF of the branch nails 15 and 16, a paper is distributed to any one of the transport paths B, C, and D.

When a paper is guided to the transport path B, the solenoid is turned OFF in the state of FIG. 1. When the paper is guide to the transport path C, the solenoid is turned ON in the state of FIG. 1. As a result, the branch nail 15 turns upward while the branch nail 16 turns downward to transport the paper through a transport roller 3 and an upper paper ejecting roller 4 to finally eject the paper onto the upper tray 201. When the paper is guided to the transport path D, the solenoid is turned OFF when the branch nail 16 is in the state of FIG. 1 while turned ON when the branch nail 15 is in the state of FIG. 1. This causes both the branch nails 15 and 16 to turn upward. As a result, the paper is transported through the transport roller 5 and the paper ejecting roller 6 to the shift tray 202.

The paper post-processing apparatus PD is capable of performing the following processes on papers: punching by the punching unit 100; jogging and end stitching by a jogger fence 53 and an end face stitching stapler S1; jogging and saddle stitching by a saddle stitching upper jogger fence 250*a*, a saddle stitching lower jogger fence 250*b*, and a saddle stitching stapler S2; sorting by the shift tray 202; and center folding by a folding plate 74 and a folding roller 81.

2. Shift Tray Unit

Figure 2:
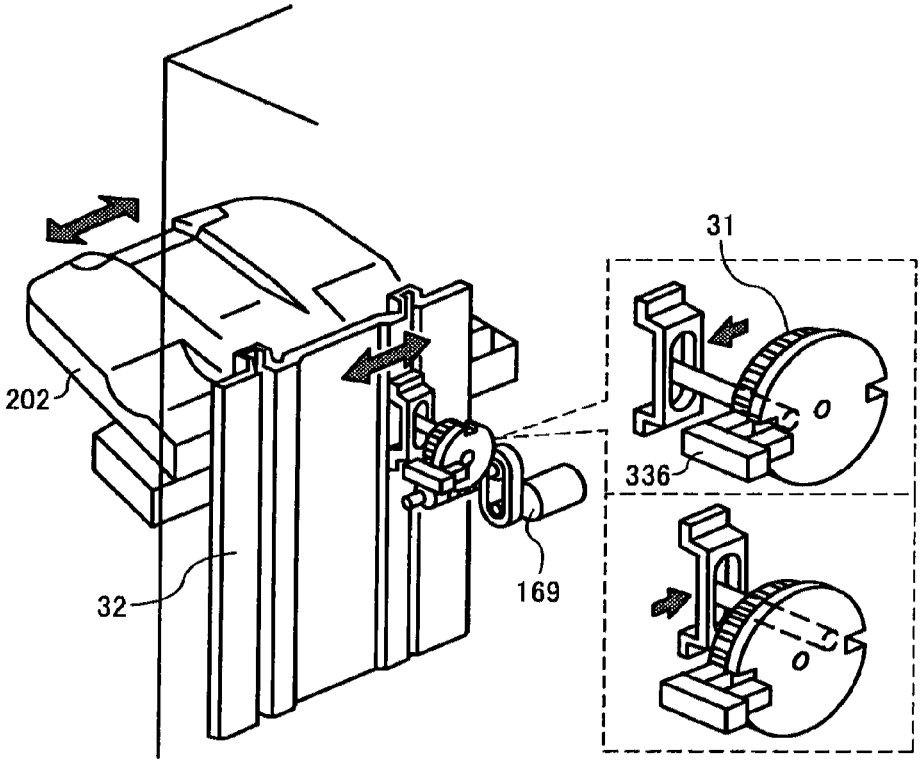
FIG. 2 is a perspective view of a shift mechanism of the paper post-processing apparatus shown in FIG. 1.

As shown in FIG. 1, a shift tray paper ejecting unit located at the end of the downstream side of the paper post-processing apparatus PD is composed of the paper ejecting roller 6 (the driving roller 6*a* and the driven roller 6*b*), a return roller 13, a paper-surface detecting sensor 330, the shift tray 202, a shift mechanism shown in FIG. 2 that reciprocates the shift tray 202 in a direction perpendicular to a paper transport direction, and a shift tray lifting mechanism that lifts and lowers the shift tray 202.

The return roller 13 is a sponge roller that comes in contact with a paper ejected out of the paper ejecting roller 6 to butt the trailing edge of the paper against an end fence 32 to align the paper. The return roller 13 is rotated by the torque of the paper ejecting roller 6. A tray lift limiting switch 333 is disposed near the return roller 13. When the shift tray 202 moves up to push up the return roller 13, the tray lift limiting switch 333 is turned ON to stop a tray lifting motor 168. This prevents the overrun of the shift tray 202. Near the return roller 13, as shown in FIG. 1, the paper-surface detecting sensor 330 is also disposed, which serves as a paper-surface position detecting unit that detects the position of the surface of a paper or a sheaf of papers ejected onto the shift tray 202.

In the present embodiment, a paper-surface detecting sensor 330*a* (for stapling) and a paper-surface detecting sensor 330*b* (for non-stapling) are turned ON when shielded by a shielding unit 30*b*. When the shift tray 202 moves up to turn a contact portion 30*a* of a paper-surface lever 30 upward, the paper-surface detecting sensor 330*a* is turned OFF first. Then, when the paper-surface lever 30 is further turned upward, the paper-surface detecting sensor 330*b* is turned ON. When the paper-surface detecting sensor 330*a* and the paper-surface detecting sensor 330*b* detect the height of a stack of papers reaches a predetermined height, the tray lifting motor 168 starts to lower the shift tray 202 by a predetermined distance. This keeps the paper-surface position of the shift tray 202 substantially constant.

Figure 3:
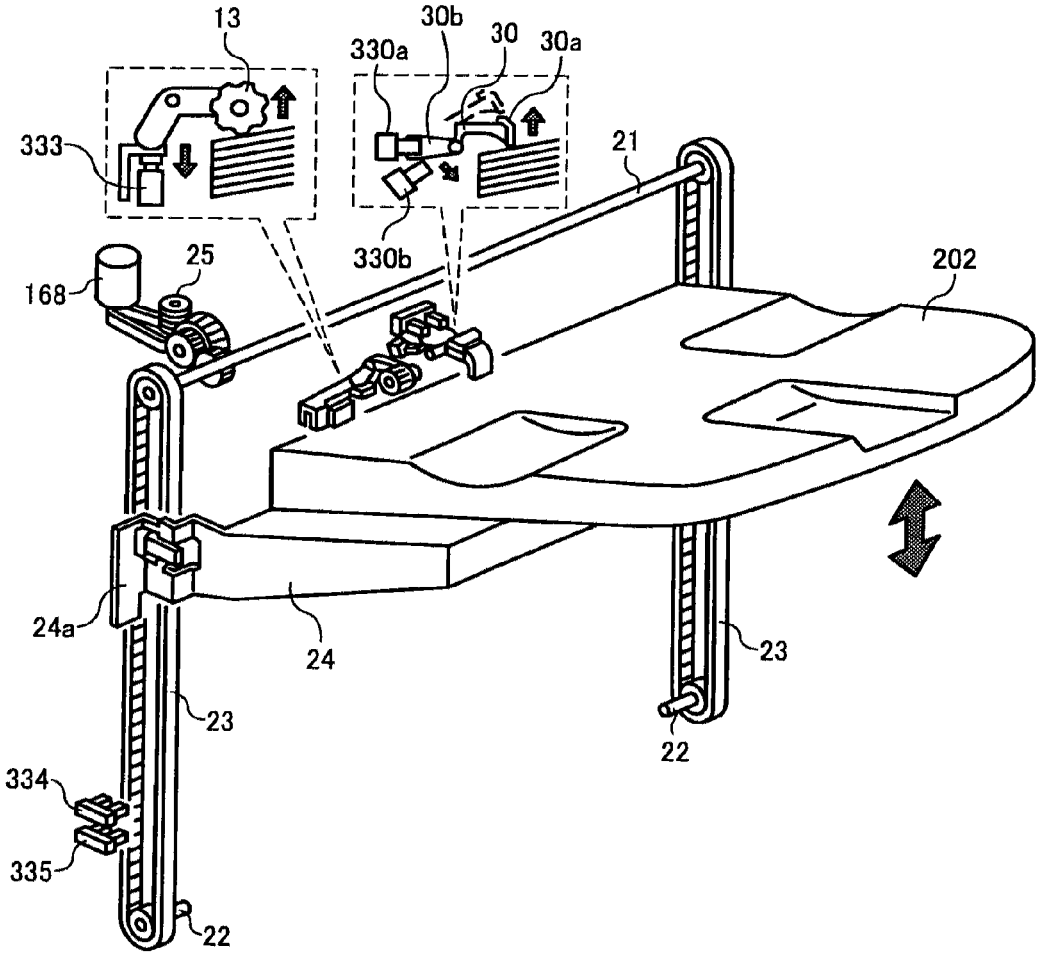
FIG. 3 is a perspective view of a lifting mechanism of a shift tray of the paper post-processing apparatus shown in FIG. 1.

As shown in FIG. 3, the shift tray 202 is lifted and lowered as a driving unit (not shown) drives a driving shaft 21. Between the driving shaft 21 and a driven shaft 22, timing belts 23 are stretched with tension over timing pulleys. To the timing belts 23, a side plate 24 is fixed to support the shift tray 202. With this configuration, a unit including the shift tray 202 is suspended in a movable manner.

A driving source that moves up and down the shift tray 202 is the tray lifting motor 168 capable of rotating clockwise and counterclockwise. Motive power generated by the tray lifting motor 168 is transmitted to a final gear of a gear train (not shown) fixed to the driving shaft 21 via a worm gear 25. The worm gear 25 interposed in the gear train enables holding the shift tray 202 at a constant position, which prevents an unexpected accident, such as drop of the shift tray 202.

A shielding plate 24*a* is formed integrally on the side plate 24 of the shift tray 202, and a full load detecting sensor 334 that detects a full load of a stacked papers and a lower limit sensor 335 that detects a lower limit position of the shift tray 202 are disposed below the shielding plate 24*a*. The shielding plate 24*a* turns ON and OFF the full load detecting sensor 334 and the lower limit sensor 335. The full load detecting sensor 334 and the lower limit sensor 335 are photosensors and turned ON when shielded by the shielding plate 24*a*. The paper ejecting roller 6 is not shown in FIG. 3 for convenience of explanation.

A moving mechanism of the shift tray 202 is shown in FIG. 2. A shift motor 169 serves as a driving source, which rotates a shift cam 31. The shift cam 31 has an upright pin located to be separate from the rotating shaft of the shift cam 31 by a predetermined distance. The pin is fitted loosely in an elongated hole of the end fence 32 so that the end fence guides the trailing edge of a stack of papers on the shift tray 202 and is fitted to the shift tray 202 in a direction perpendicular to a paper ejecting direction. The rotation of the shift cam 31 causes the end fence 32 to move in the direction perpendicular to the paper ejecting direction, which causes the shift tray 202 to move. The shift tray 202 stops at a position on the front side and at a position on the rear side, and the stop positions of the shift tray 202 are detected by a shift sensor 336. Thus, the shift motor 169 is turned ON and OFF to control the move of the shift tray 202 in the direction perpendicular to the paper ejecting direction.

Figure 4:
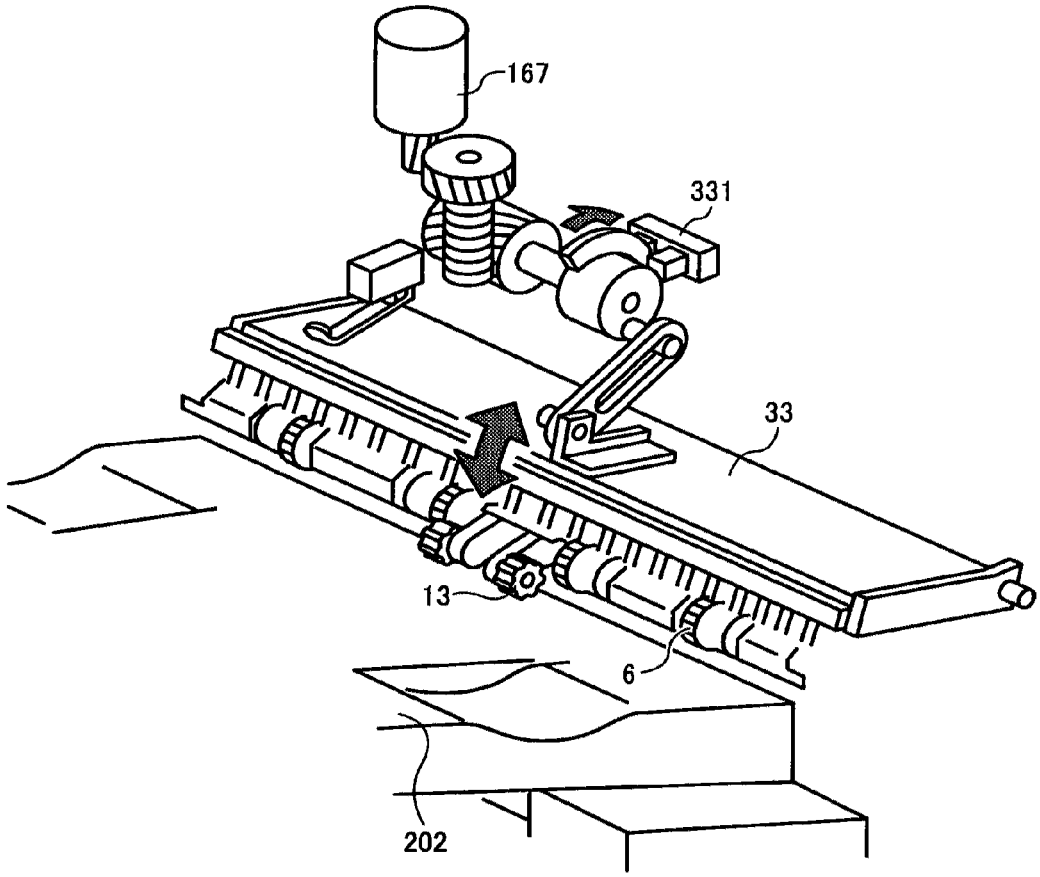
FIG. 4 is a perspective view of a mechanism of a shift paper ejecting roller and an opening/closing guide plate of the paper post-processing apparatus shown in FIG. 1.

The paper ejecting roller 6 includes the driving roller 6*a* and the driven roller 6*b*. As shown in FIGS. 1 and 4, the driven roller 6*b* is supported rotatably on a free end of an opening/closing guide plate 33 whose end at the upstream side in the paper ejecting direction is supported to allow the opening/closing guide plate 33 to turn up and down freely. The driven roller 6*b* is kept in contact with the driving roller 6*a* by the deadweight of the driven roller 6*b* or an energy-applying force, and a paper is sandwiched between the driving roller 6*a* and the driven roller 6*b* and is ejected outside of the paper post-processing apparatus PD. When a paper sheaf subjected to a stitching process is ejected out, the opening/closing guide plate 33 is turned upward, and is returned toward the original position at a predetermined timing. This timing is determined based on a detection signal from the shift paper ejecting sensor 303. The stop position of the opening/closing guide plate 33 is determined based on a detection signal from a paper ejecting guide plate opening/closing sensor 331. A paper ejecting guide plate opening/closing motor 167 drives the opening/closing guide plate 33.

3. End Face Stitching Process Tray Unit

A configuration of the end face stitching process tray F that carries out the stapling process is shown in FIGS. 5, 6, 12, and 13.

3.1 General Configuration of End Face Stitching Process Tray

Papers guided by the staple paper ejecting roller 11 to the end face stitching process tray F are stacked sequentially on the end face stitching process tray F. In this case, each paper is aligned vertically (paper transport direction) by the return roller 12, and is aligned horizontally (direction perpendicular to the paper transport direction, which is called "paper width direction") by the jogger fence 53. At a break in a series of jobs, that is, at a break between the last paper of a paper sheaf and the head paper of the next paper sheaf, the end face stitching staple S1 is driven by a staple signal from a control circuit 350 (see FIG. 33) to carry out the stitching process.

The paper sheaf having undergone the stitching process is sent immediately to the paper ejecting roller 6 by a releasing belt 52 having releasing nails 52*a* projecting thereon, and is ejected onto the shift tray 202 set at a receiving position.

3.2 Paper Releasing Mechanism

Figure 12:
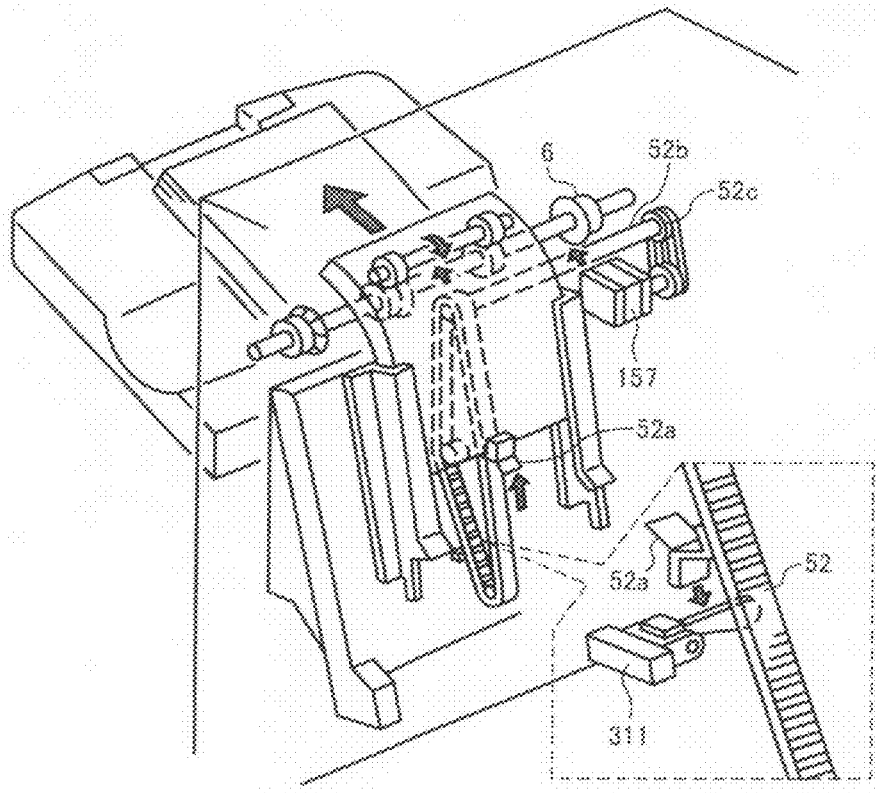
FIG. 12 is a perspective view of a driving mechanism of a releasing belt that pushes up a paper sheaf and a releasing nail.

As shown in FIG. 12, a home position of the releasing nails 52*a* is detected by a releasing belt HP sensor 311. The releasing belt HP sensor 311 is turned ON and OFF by the releasing nails 52*a* disposed on the releasing belt 52. The releasing nails 52*a* are disposed on the outer periphery of the releasing belt 52, where the releasing nails 52*a* are located opposite to each other and alternately transport a paper sheaf stored in the end face stitching process tray F. The releasing belt 52 is rotated backward when necessary to jog a transport-direction leading edge of the paper sheaf stored in the end face stitching process tray F by a front face of one of the releasing nails 52*a* standing by for moving a paper sheaf and a back face of the other one of the releasing nails 52*a*. The releasing nails 52*a*, therefore, function also as a jogging unit that jogs a paper sheaf in the paper transport direction.

Figure 5:
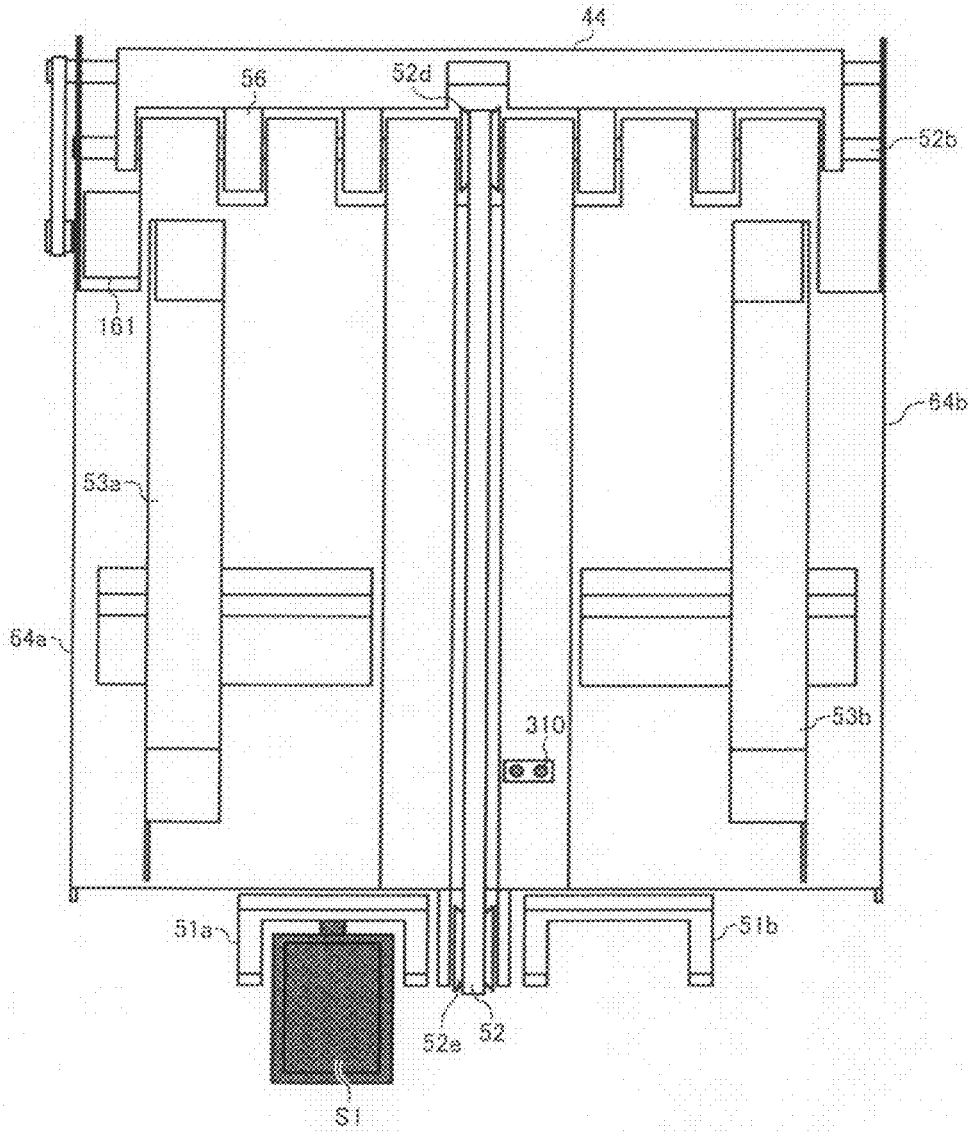
FIG. 5 is a plan view of a configuration of an end face stitching process tray used for a stapling process.

The releasing belt 52 is arranged at the alignment center in the paper width direction, and is stretched between a driving pulley 52*d* and a driving pulley 52*e*, as shown in FIG. 5. The releasing belt 52 is driven by a releasing motor 157 via a driving shaft 52*b* and the driving pulley 52*e*, as shown in FIG. 12. A plurality of releasing rollers 56 are arranged to be symmetrical with regard to the releasing belt 52 and capable of rotating relative to the driving shaft 52*b*, and function as driven rollers. Reference numerals 64*a* and 64*b* denote a front plate and a rear plate, respectively. Reference numerals 51*a* and 51*b* denote a front trailing edge fence and a back trailing edge fence, respectively, (which are denoted by reference numeral 51 in FIG. 1). Reference numerals 53*a* and 53*b* denote a front jogger fence and a back jogger fence, respectively.

3.3 Processing Mechanism

Figure 6:
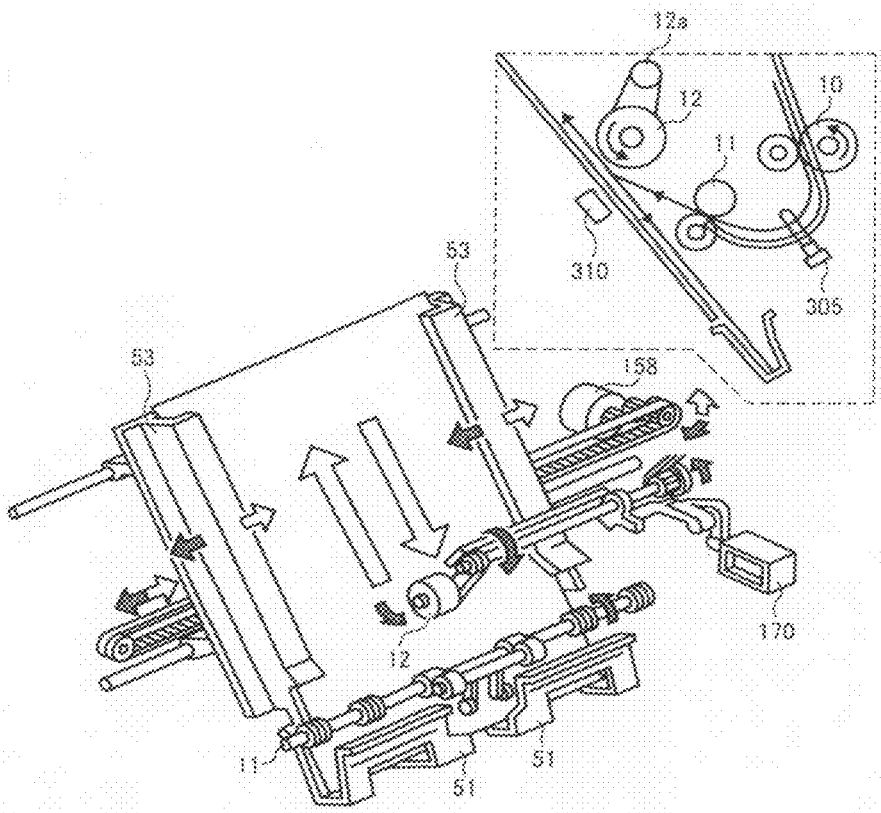
FIG. 6 is a perspective view of the configuration of the end face stitching process tray used for the stapling process.

As shown in FIG. 6, a return roller 12 is caused to oscillate about a fulcrum 12*a* by a striking SOL 170, so that the return roller 12 acts intermittently on a paper sent into the end face stitching process tray F to butt the trailing edge of the paper against the trailing edge fence 51. At this state, the return roller 12 rotates counterclockwise. The jogger fence 53 is composed of a pair of the front jogger fence 53*a* and the back jogger fence 53*b*, as shown in FIG. 5. The jogger fence 53 is driven by a jogger motor 158 capable of rotating clockwise and counterclockwise via a timing belt to reciprocate in the paper width direction, as shown in FIG. 6.

Figure 13:
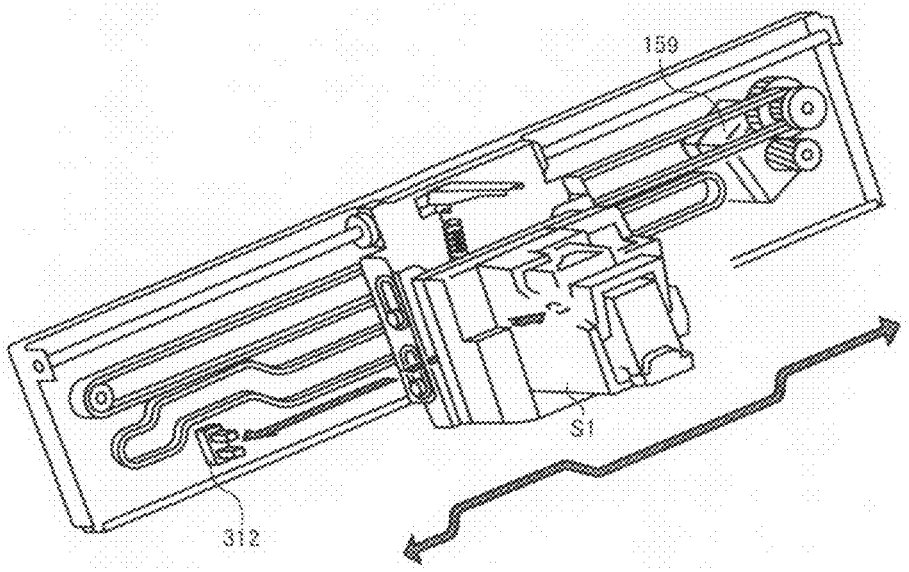
FIG. 13 is a perspective view of an end face stitching stapler.

As shown in FIG. 13, the end face stitching stapler S1 is driven by a stapler moving motor 159 capable of rotating clockwise and counterclockwise via a timing belt, and moves in the paper width direction to stitch the paper at a predetermined position on the end of the paper. At one side end of a moving range of the end face stitching stapler S1, a stapler move HP sensor 312 is disposed. The stapler move HP sensor 312 detects a home position of the end face stitching stapler S1. A stitching position in the paper width direction is controlled based on an amount of move of the end face stitching S1 from the home position.

Figure 14:
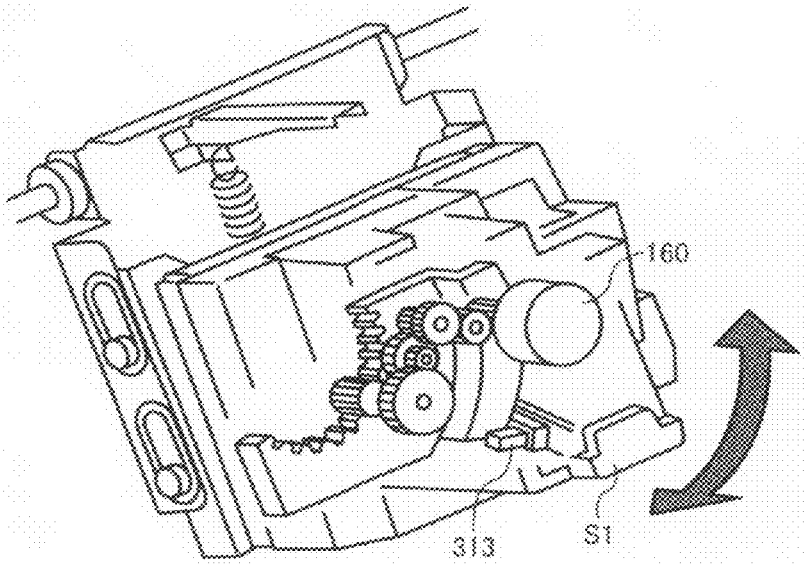
FIG. 14 is a perspective view of a diagonal stitching mechanism of the end face stitching stapler.

FIG. 14 is a perspective view of a diagonal stitching mechanism of the stapler S1. The stapler S1 is configured so that a staple driving angle can be changed into an angle parallel to or diagonal to the end of the paper, and that only the stitching mechanism portion of the stapler S1 is rotated diagonally by a predetermined angle at the home position to facilitate replacement of a staple. Specifically, the stapler S1 is rotated diagonally by a diagonal motor 160. When a staple replacement position sensor (not shown) detects the stapler S1 reaching a predetermined diagonal angle or when a diagonal sensor 313 detects the stapler S1 reaching a staple replacement position, the diagonal motor 160 comes to a stop. When diagonal stapling or staple replacement is over, the stapler S1 rotates to the original position in preparation for next stapling. Reference numeral 310 in FIGS. 1 and 5 denote the paper presence/absence sensor that detects the presence and absence of a paper on the end face stitching process tray F.

3.4 Paper Sheaf Trailing Edge Pressing Mechanism

A mechanism that presses a bulge on the trailing edge of a paper sheaf placed on the end face stitching process tray F is shown in FIGS. 7 to 11.

Figure 7:
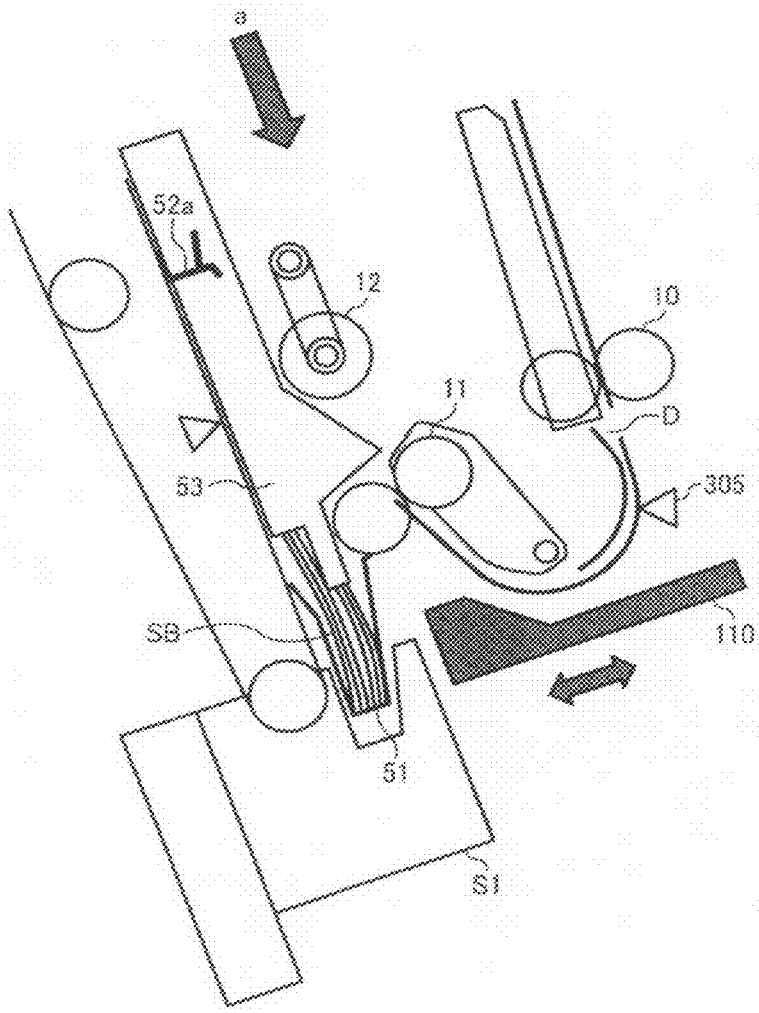
FIG. 7 depicts a mechanism that presses a bulge on the trailing edge of a paper sheaf placed on the end face stitching process tray.

Each of papers ejected onto the end face stitching process tray F is aligned vertically (paper transport direction) by the return roller 12, as described above. If the trailing edge of a stack of papers placed on the end face stitching process tray F is curled or easy to buckle, the trailing edge is likely to yield to the weight of the papers, resulting in buckle and bulge. As the number of stacked papers increases, a gap for receiving the next paper in the trailing edge fence 51 gets smaller, leading to inferior vertical alignment. The trailing edge pressing mechanism reduces a bulge on the trailing edge of a paper sheaf to make it easy for a paper to come into the trailing edge fence 51. FIG. 7 is a schematic diagram of the trailing edge pressing mechanism viewed from its front side. A trailing edge pressing bar 110 is located at the lower end of the trailing edge fence 51, where the trailing edge pressing bar 110 is able to press the trailing edge of a paper sheaf SB stored in the trailing edge fence 51 and reciprocates in the direction virtually perpendicular to the end face stitching process tray F.

Figure 8:
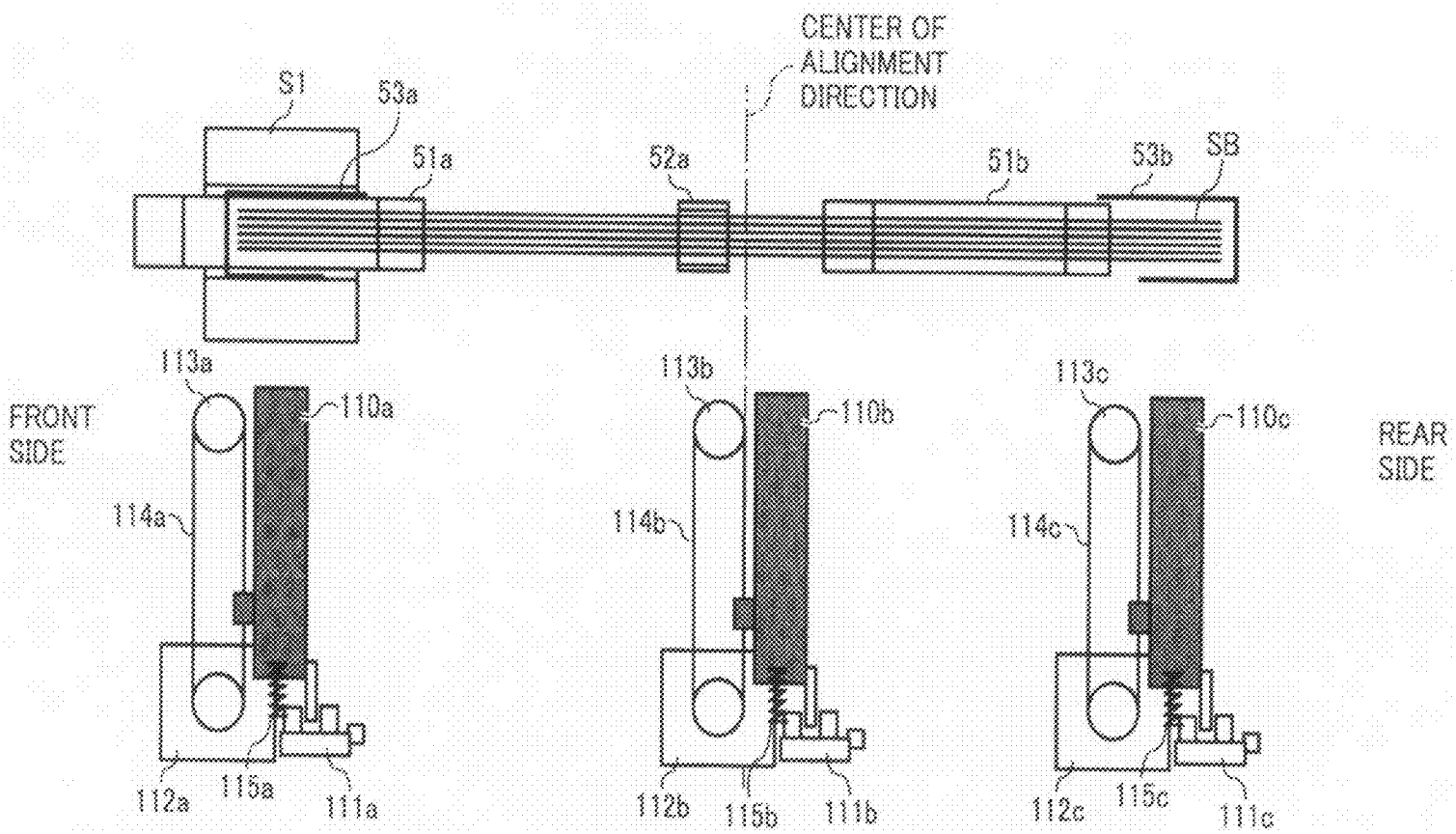
FIG. 8 is a schematic diagram viewed from a direction of "a" shown in FIG. 7.

As shown in FIG. 8, trailing edge pressing levers 110*a*, 110*b*, and 110*c* that press the trailing edge of a stack of papers placed on the end face stitching process tray F are arranged on the front side, at the center, and on the rear side of the trailing edge pressing mechanism, respectively. The mechanism of the trailing edge pressing lever 110*a* on the front side is described below. The trailing edge pressing lever 110*a* is fixed to a timing belt 114*a*, which is stretched via a trailing edge pressing lever motor 112*a* and a pulley 113*a* and, therefore, operates along with the rotation of the trailing edge pressing lever motor 112*a*. When a projecting shielding unit projecting on the trailing edge pressing lever 110*a* shields a home sensor 111*a*, the home position of the trailing edge pressing lever 110*a* is detected. The home position of the trailing edge pressing lever 110*a* is determined to be a position at which the trailing edge pressing lever 110*a* does not interfere with the stapler S1 in a range where the stapler S1 moves in a direction indicated by an arrow shown in FIG. 13 (paper width direction for stitching the end of the paper). An amount of move of the trailing edge pressing lever 110*a* in a direction for pressing the trailing edge of the paper sheaf, that is, a direction indicated by an arrow shown in FIG. 12 is determined based on the number of pluses input to the trailing edge pressing lever motor 112*a*. The trailing edge pressing lever 110*a* moves to a position at which the leading edge of the trailing edge pressing lever 110*a* comes in contact with the paper sheaf SB to press a bulge on its trailing edge. A change in the thickness of the paper sheaf SB placed on the tray F is canceled out by a spring 115*a* through its expansion and contraction. The operation of the trailing edge pressing levers 110*b* and 110*c* is the same as that of the trailing edge pressing lever 110*a*. Therefore, peripheral mechanisms related to the trailing edge pressing levers 110*b* and 110*c* are denoted by reference numerals with suffixes b and c that are given in replacement of a suffix a, and will be omitted in further description.

Figure 9:
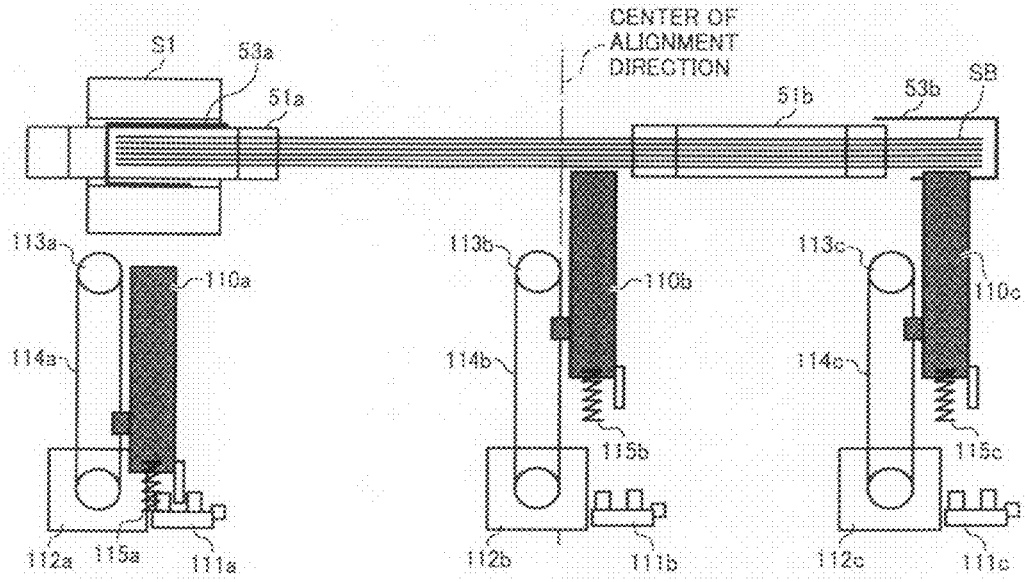
FIG. 9 depicts a positional relation between an end face stitching lever and a stapler at the time of front side stitching.
Figure 10:
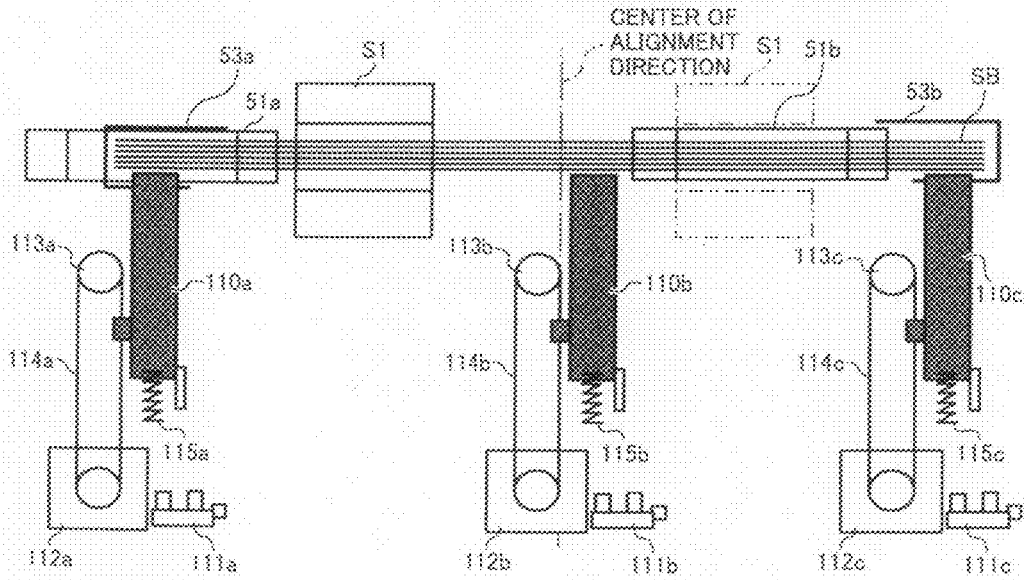
FIG. 10 depicts a positional relation between the end face stitching lever and the stapler at the time of two-spot stitching.
Figure 11:
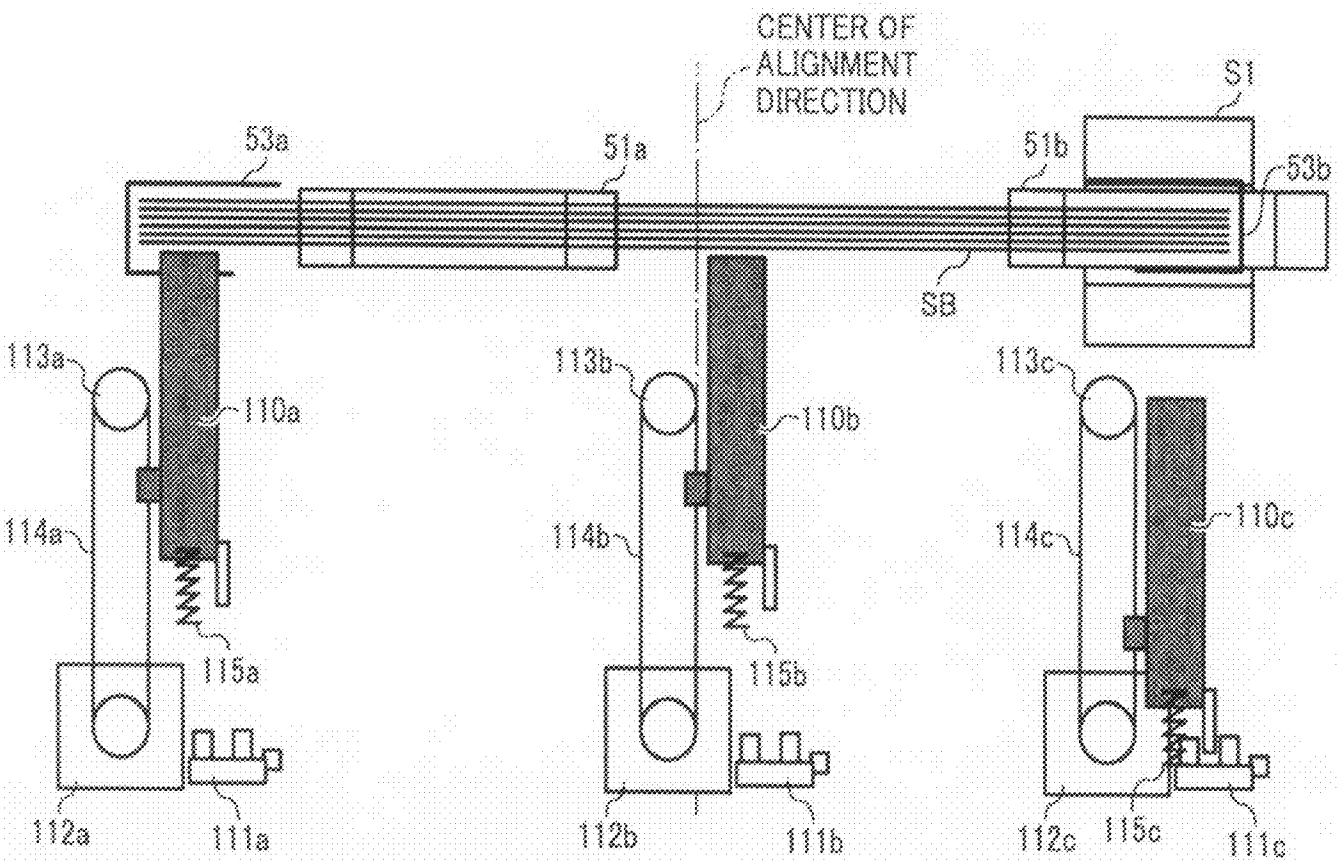
FIG. 11 depicts a positional relation between the end face stitching lever and the stapler at the time of rear side stitching.

A positional relation between each of the trailing edge pressing levers 110*a*, 110*b*, and 110*c* and the end face stitching stapler S1 in each stitching mode is different from one another. The stand-by position of the stapler S1 in a front side stitching mode is shown in FIG. 9, the same in a two-spot stitching mode is shown in FIG. 10, and the same in a rear side stitching mode is shown in FIG. 11. When the stapler S1 is at each stand-by position and any one of the trailing edge pressing levers 110*a*, 110*b*, and 110*c* operates, the operating trailing edge pressing lever must be prevented from interfering with the stapler S1. The trailing edge pressing levers 110*b* and 110*c* operate in the front side stitching mode shown in FIG. 9, the trailing edge pressing levers 110*a*, 110*b*, and 110*c* operate in the two-spot stitching mode shown in FIG. 10, and the trailing edge pressing levers 110*a* and 110*b* operate in the rear side stitching mode shown in FIG. 11. The operating positions of the trailing edge pressing levers 110*a*, 110*b*, and 110*c* in each stitching mode are shown in FIGS. 9 to 11. Operating timing of the trailing edge pressing levers 110*a*, 110*b*, and 110*c* is set to be within a period from a point at which ejected papers are stacked in the trailing edge fence 51 and are jogged in the paper width direction by the jogger fence 53 to a point at which a next paper is aligned by the return roller 12.

4. Paper Sheaf Turning Mechanism

Figure 15:
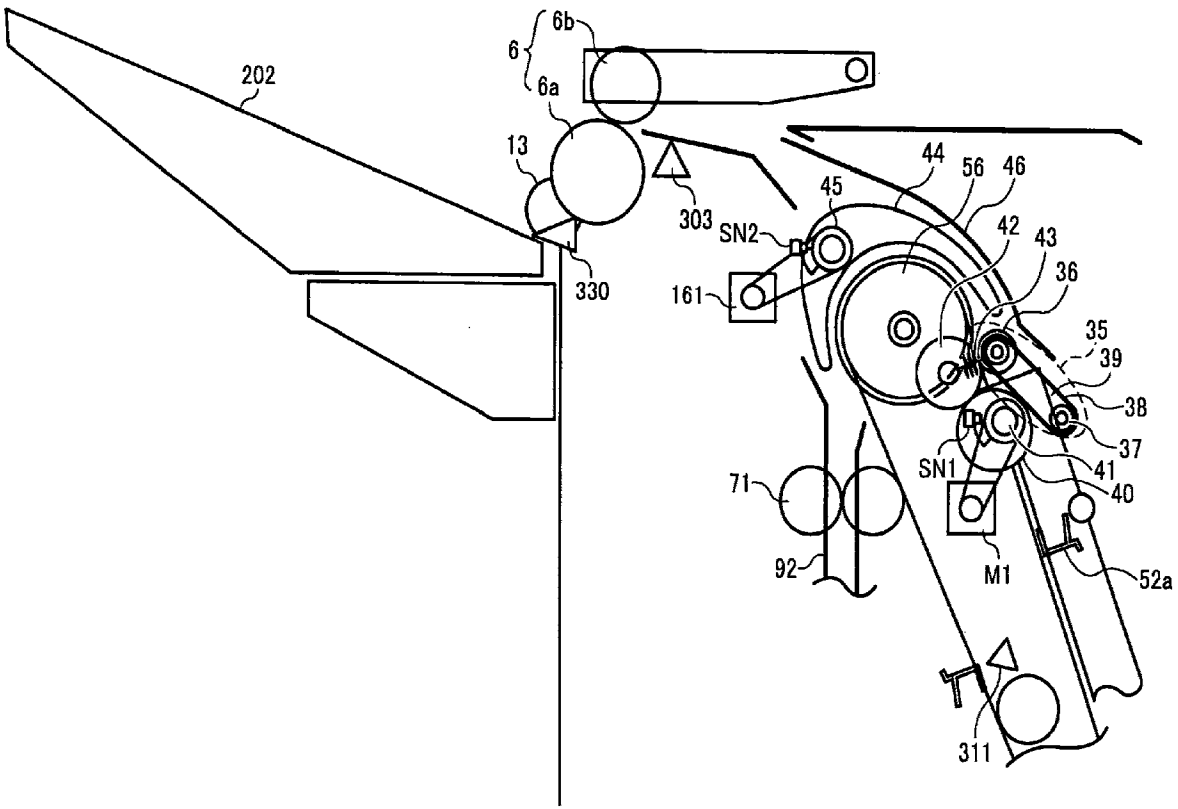
FIG. 15 depicts a paper sheaf turning mechanism.

FIG. 15 depicts the main part of a paper sheaf turning mechanism.

Figure 16A:
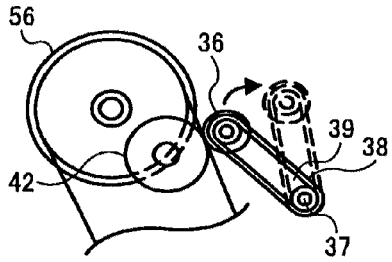
FIGS. 16A and 16B depict examples of a paper sheaf transport mechanism in the paper sheaf turning mechanism.
Figure 16B:
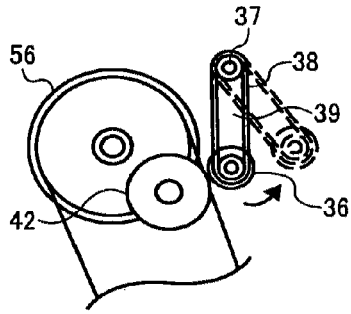
Figure 18A:
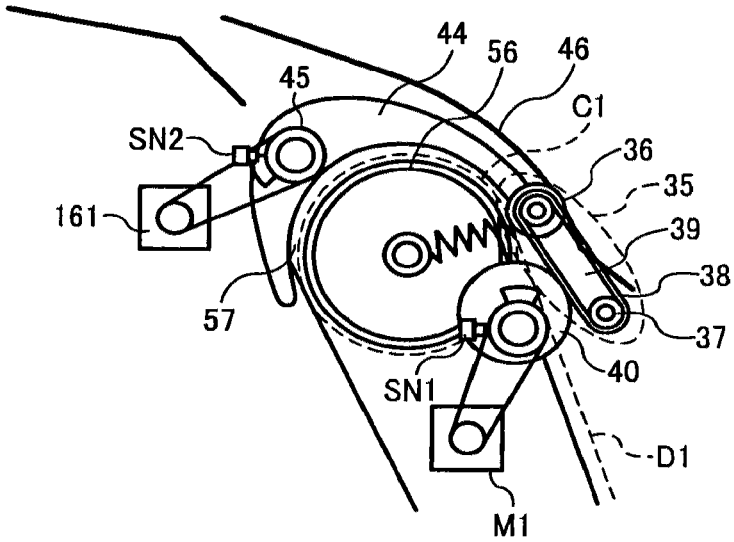
FIG. 18A depicts an example of the paper sheaf turning mechanism when a paper is turned.
Figure 18B:
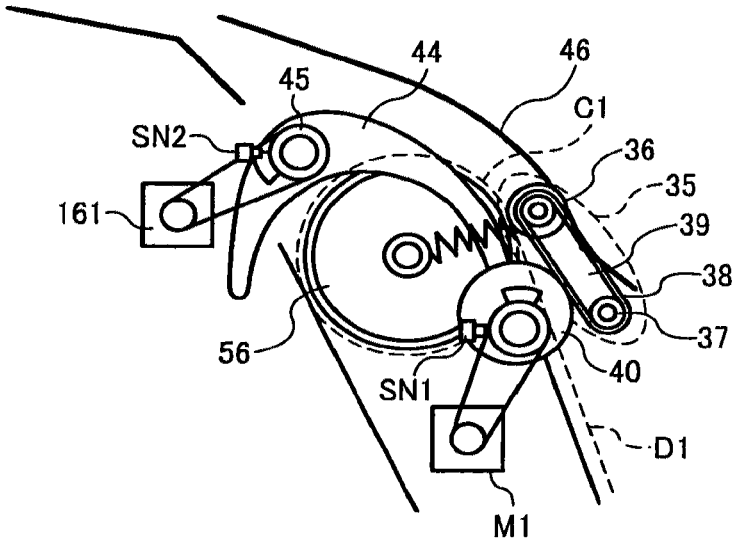
FIG. 18B depicts an example of the paper sheaf turning mechanism when a paper is not turned and sent toward a shift tray.

As shown in FIGS. 1 and 15, transport paths and transport units that transport a paper sheaf from the end face stitching process tray F to the saddle stitching process tray G or to the shift tray 202 include a transport mechanism 35 that gives the paper sheaf a transport force, the releasing roller 56 that causes the paper sheaf to make a turn, and the guide member 44 that guides the paper sheaf along a turn transport path 57 (FIGS. 18A and 18B). Specifically, as shown in FIG. 15, a driving force from a driving shaft 37 is transmitted through a timing belt 38 to a roller 36 of the transport mechanism 35. The roller 36 and the driving shaft 37 are coupled and supported by an arm 39, which enables the roller 36 to swing about the driving shaft 37 serving as a pivot. Swinging of the roller 36 of the transport mechanism 35 is carried out by a cam 40, which rotates around a rotating shaft 41 and is driven by a driving force transmitted from a motor M1. A home position of the cam 40 that rotates and moves the transport mechanism 35 is detected by a sensor SN1. A rotation angle from the home position can be controlled by providing another sensor to the mechanism of FIG. 15, or can be adjusted through pulse control over the motor M1. The transport mechanism 35 can have, for example, two types of main configurations as shown in FIGS. 16A and 16B. The configuration varies depending on whether the driving shaft 37 is disposed at the upstream side in the paper transport direction (FIG. 16A) or at the downstream side in the paper transport direction (FIG. 16B). Which configuration is to be adopted depends on the arrangement relation with other mechanisms, and, therefore, no relative merit is attributed to either of the configurations.

Figure 17:
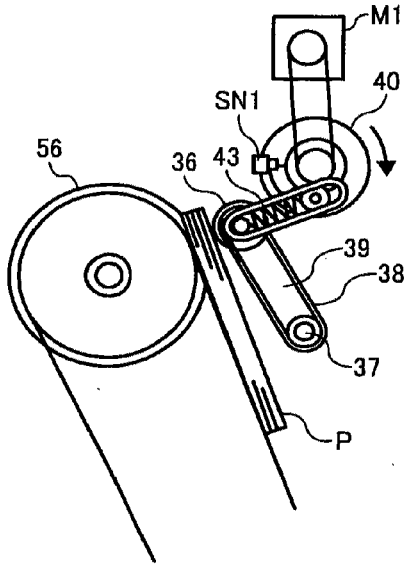
FIG. 17 depicts another example of the paper sheaf transport mechanism in the paper sheaf turning mechanism.

In the transport mechanism 35, a driven roller 42 is disposed opposite to the roller 36. A paper sheaf is sandwiched between the driven roller 42 and the roller 36, and is pressurized by an elastic material 43 to give the paper sheaf a transport force. The thicker the paper sheaf P becomes, the greater the transport force, that is, pressurization force, must be. For this reason, a configuration shown in FIG. 17 can be available, in which the roller 36 of the transport mechanism 35 is pressed against the paper sheaf via the elastic material 43 by the cam 40 so that pressurization force is adjusted by adjusting an angle of pressing. In another configuration shown in FIG. 18A, the driven roller 42 opposite to the roller 36 of the transport mechanism 35 can be replaced with the releasing roller 56. In this case, a nip position between the roller 36 and the releasing roller 56 should preferably be near a point of contact at which a paper sheaf transport track D1 is tangent to a concentric circle C1 of the releasing roller 56.

The turn transport path 57, which is the transport path for transporting the paper sheaf from the end face stitching process tray F to the saddle stitching process tray G, is formed of the releasing roller 56 and the guide member 44 opposite to the releasing roller 56. The guide member 44 rotates about a fulcrum 45, and is driven by a driving force transmitted from a sheaf branch driving motor 161. A home position of the guide member 44 is detected by a sensor SN2. As shown in FIG. 18B, a transport path for transporting the paper sheaf from the end face stitching process tray F to the shift tray 202 serving as a stacking unit is provided in such a way that the guide member 44 rotates clockwise about the fulcrum 45 to prepare a space to be used as the transport path between the guide member 44 and a guide plate 46.

FIGS. 19 to 22 are explanatory views of basic operation of a paper sheaf directional change mechanism including the transport mechanism 35, the guide member 44, and the releasing roller 56.

Figure 19:
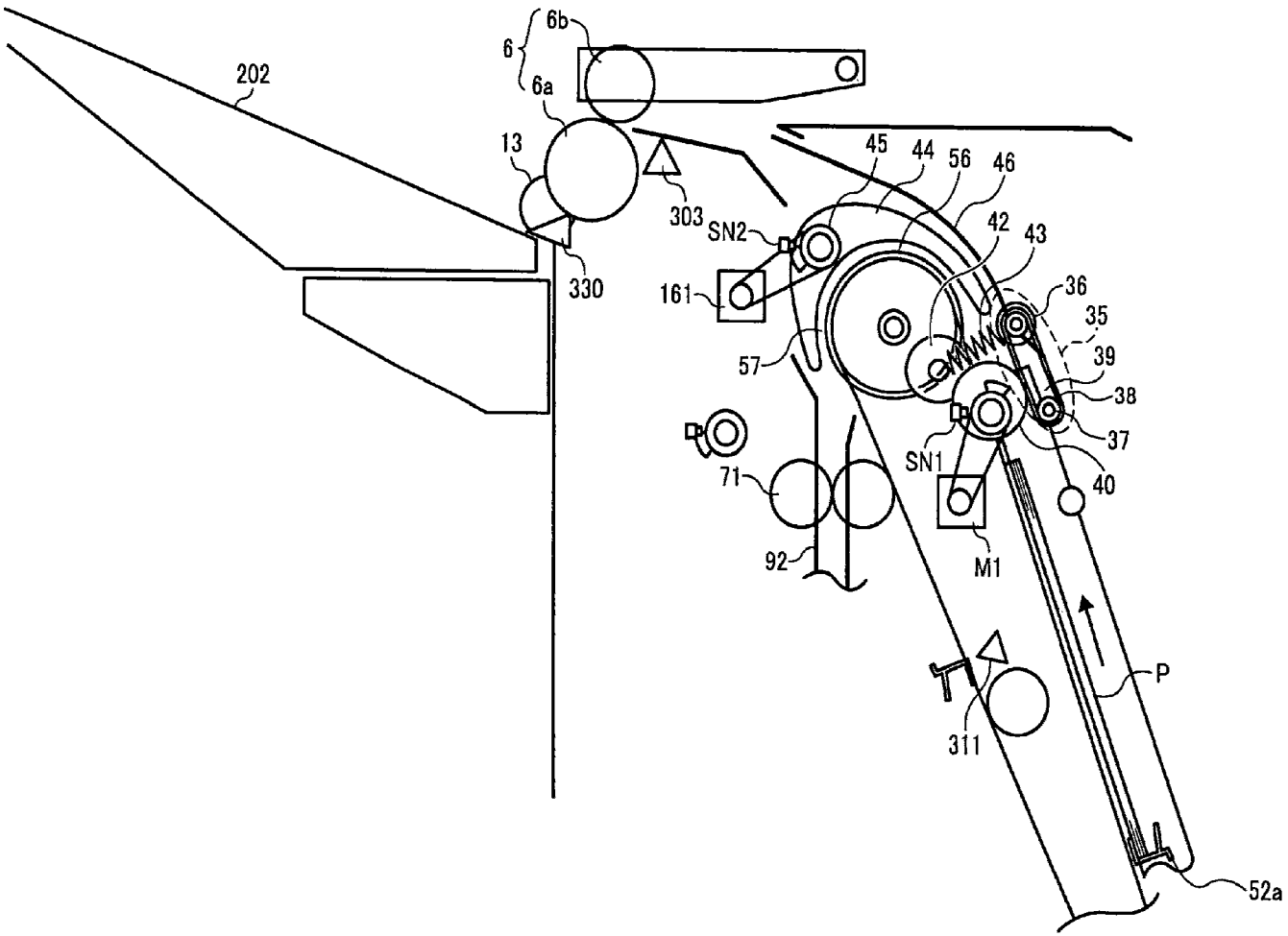
FIG. 19 depicts a state where the trailing edge of a paper sheaf aligned at an end stitching process unit is pushed up by the releasing nail.

As shown in FIG. 19, when the paper sheaf P is sent from the end face stitching process tray F to the saddle stitching process tray G, the releasing nail 52*a* pushes up the trailing edge of the paper sheaf aligned at the end face stitching process tray F so that the paper sheaf is sandwiched between the roller 36 of the transport mechanism 35 and the driven roller 42, and a transport force is given to the sandwiched paper sheaf. At this time, the roller 36 of the transport mechanism 35 stands by at a position where the roller 36 is not collided with the leading edge of the paper sheaf P.

Figure 20A:
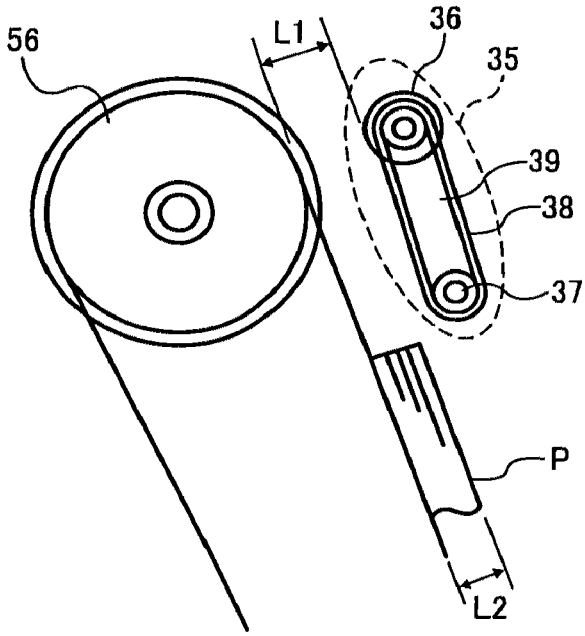
FIGS. 20A and 20B are explanatory views of an operation of a mechanism that prevents a jam when a paper sheaf is sent out.
Figure 20B:
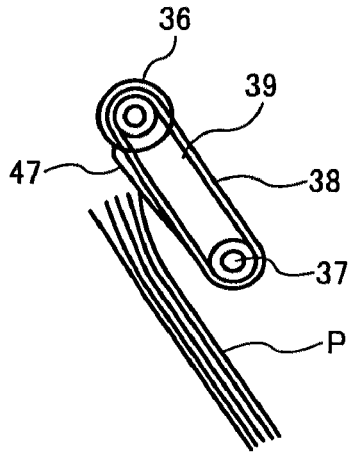

As shown in FIG. 20A, the distance L1 between the stacking face of the paper sheaf P aligned at the end face stitching process tray F or the guided face of the paper sheaf P pushed up by the releasing nail 52*a* and the roller 36 is set to be wider than the maximum thickness L2 of the paper sheaf P sent from the end face stitching process tray F to the saddle stitching process tray G to prevent collision between the leading edge of the paper sheaf P and the roller 36. Because the thickness of the paper sheaf P depends on the number or type of papers aligned at the end face stitching process tray F, the position of the roller 36 at which the roller 36 keeps the minimum necessary distance to prevent its collision with the leading edge of the paper sheaf P changes along with a change in the thickness of the paper sheaf P. If a retract position of the roller 36 is changed based on information about the number or type of papers, a time of move from the retract position to the position for giving a transport force to the paper sheaf P can be minimized, resulting in improving productivity. This information about the number or type of papers can be job information obtained from the image forming apparatus PR or information obtained through a sensor incorporated in the paper post-processing apparatus PD. When an unexpected large curl is formed on the paper sheaf P aligned at the end face stitching process tray F, the leading edge of the paper sheaf P may come in contact with the roller 36 when the releasing nail 52*a* pushes up the paper sheaf P. Therefore, as shown in FIG. 20B, it is necessary to arrange a guide 47 at a position just preceding to the roller 36 to reduce a contact angle between the leading edge of the paper sheaf P and the roller. The guide 47 works to attain the same effect when provided as a fixed member or elastic member.

Figure 21:
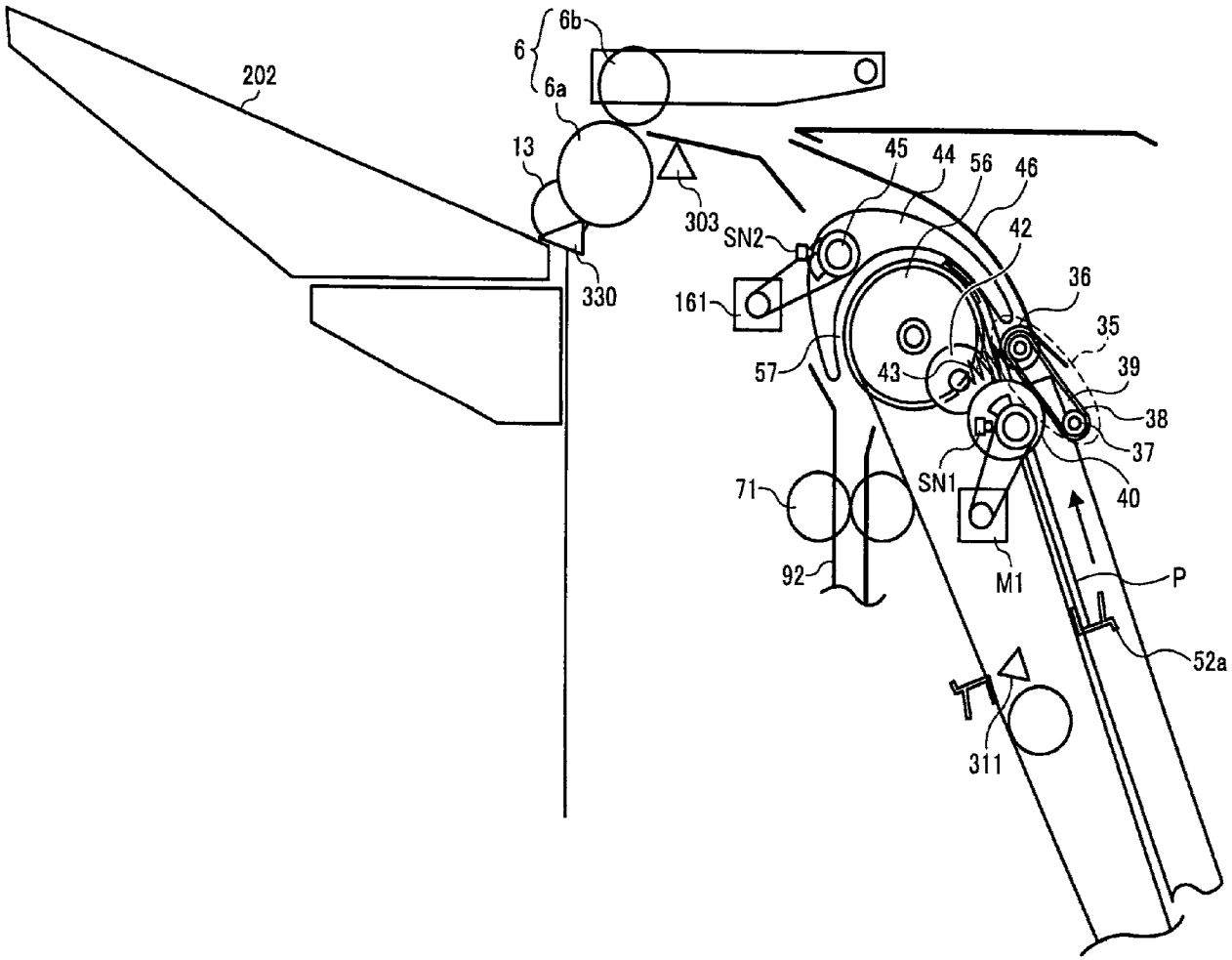
FIG. 21 is an explanatory view of an operation for applying transport force upon turning the paper sheaf.

As shown in FIG. 21, after passing of the leading edge of the paper sheaf P, the roller 36 of the transport mechanism 35 is brought into contact with the surface of the paper sheaf P to give it a transport force. At this time, the guide member 44 and the releasing roller 56 cooperate to form a guide along the turn transport path 57, through which the paper sheaf P is transported to the saddle stitching process tray G at the downstream side.

Figure 22:
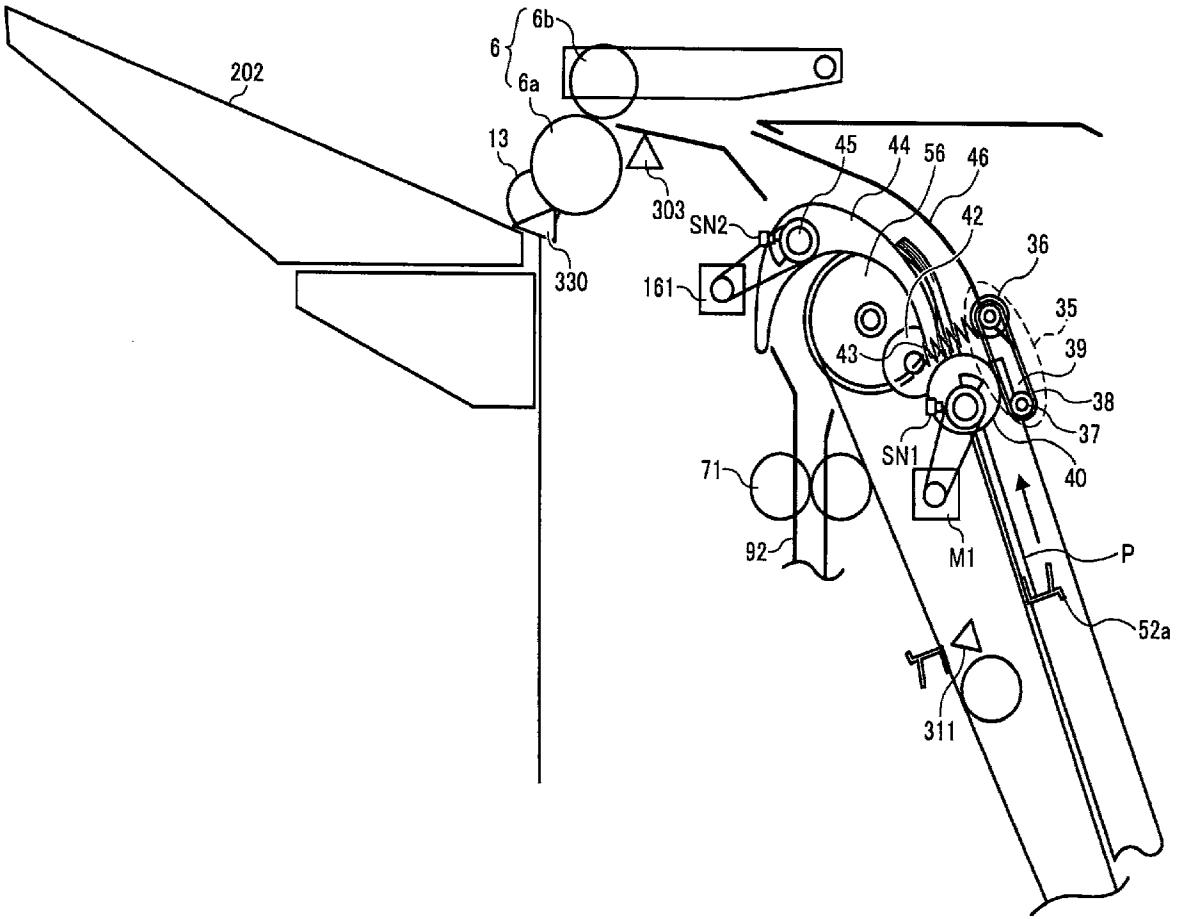
FIG. 22 is an explanatory view of an operation for transporting a paper sheaf to the shift tray.

As shown in FIG. 22, when the paper sheaf P is sent from the end face stitching process tray F to the shift tray 202, the guide member 44 is rotated clockwise at an angle greater than a rotation angle shown in FIG. 21 for sending the paper sheaf P to the saddle stitching process tray G so that the guide member 44 and the guide plate 46 cooperate to form a transport path leading to the shift tray 202. The trailing edge of the paper sheaf P aligned at the end face stitching process tray F is pushed up by the releasing nail 52*a* to transport the paper sheaf P to the shift tray 202. In this case, the transport force of the roller 36 of the transport mechanism 35 is not used.

In the present embodiment, the releasing roller 56 functions as a driven roller that is not restricted by the driving shaft driving the releasing belt 52 but is configured to follows the transport motion of the paper sheaf. However, the releasing roller 56 can function as a driving roller driven by the releasing motor 157. When the releasing roller 56 functions as the driving roller, a circumferential speed of the releasing roller 56 is set to be higher than a circumferential speed of the releasing belt 52.

5. Saddle Stitching Process Tray

Saddle stitching and center folding is carried out at the saddle stitching process tray G disposed at the downstream side of the end face stitching process tray F. A paper sheaf is guided by the paper sheaf turning mechanism from the end face stitching process tray F to the saddle stitching process tray G. A configuration of the saddle stitching process tray G is described below.

5.1 Configuration of Folding Process Tray

As shown in FIG. 1, the saddle stitching process tray G is disposed at the downstream side to the paper sheaf turning mechanism composed of the transport mechanism 35, the guide member 44, and the releasing roller 56. The saddle stitching process tray G is disposed substantially perpendicular to the paper sheaf turning mechanism at the downstream side thereof, and includes an center folding mechanism at the center of the tray G, an upper sheaf transport guide plate 92 located at an upper side of the center folding mechanism, and a lower sheaf transport guide plate 91 located at a lower side of the center folding mechanism. An upper sheaf transport roller 71 is disposed above the upper sheaf transport guide plate 92, and a lower sheaf transport roller 72 is disposed below the upper sheaf transport guide plate 92. The saddle stitching upper jogger fence 250*a* is disposed bridging both the upper sheaf transport roller 71 and the lower sheaf transport roller 72, where the saddle stitching upper jogger fence 250*a* lies along both side faces of the upper sheaf transport guide plate 92. In the same manner, the saddle stitching lower jogger fence 250*b* lies along both side faces of the lower sheaf transport guide plate 91. The saddle stitching stapler S2 is disposed at a position where the saddle stitching lower jogger fence 250*b* is placed. The saddle stitching upper jogger fence 250*a* and the saddle stitching lower jogger fence 250*b* are driven by a driving mechanism (not shown), and carry out an alignment operation in the direction perpendicular to the paper transport direction (paper width direction). The saddle stitching stapler S2 is composed of two pairs of clincher units (not shown) and driver units (not shown) that are arranged in the paper width direction at a predetermined interval. While two pairs of clincher units and driver units are provided as stationary units in the embodiment, a single pair of a clincher unit and a driver unit can be arranged in the paper width direction so that the single unit is moved in the paper width direction to carry out two-spot stitching.

A movable trailing edge fence 73 is disposed across the lower sheaf transport guide plate 91, and can be moved in the paper transport direction (vertical direction in FIG. 1) through a moving mechanism having a timing belt and a driving mechanism. As shown in FIG. 1, the driving mechanism is composed of a driving pulley and a driven pulley, over which the timing belt is stretched, and a stepping motor that drives the driving pulley. Likewise, a trailing edge striking nail 251 and its driving mechanism are disposed on the upper end side of the upper sheaf transport guide plate 92. The trailing edge striking nail 251 can be reciprocated between the direction in which the trailing edge striking nail 251 goes away from the paper sheaf turning mechanism and the direction in which the trailing edge striking nail 251 pushes the trailing edge of a paper sheaf (the side where the trailing edge striking nail 251 strikes the trailing edge of the guided paper sheaf) through a timing belt 252 and a driving mechanism (not shown). In FIG. 1, reference numeral 326 denotes a home position sensor that detects the home position of the trailing edge striking nail 251.

The center folding mechanism is disposed substantially at the center of the saddle stitching process tray G, and is composed of the folding plate 74, the folding roller 81, and a transport path H through which the folded paper sheaf is transported.

5.2 Folding Plate and Operating Mechanism Thereof

Figure 23A:
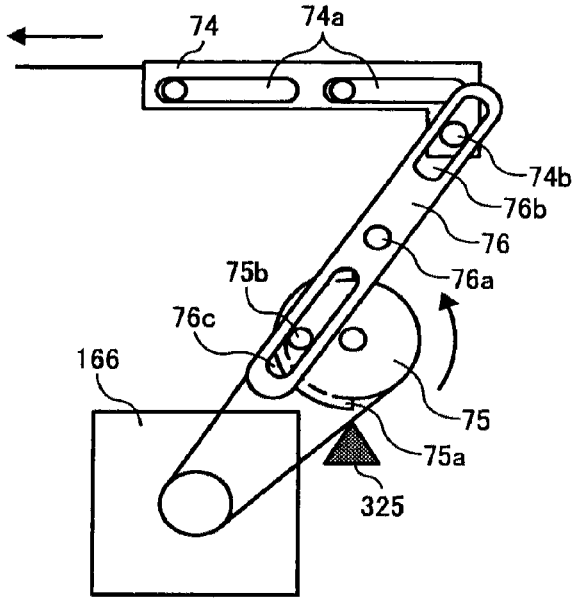
FIGS. 23A and 23B are explanatory views of an operation of a center folding mechanism.
Figure 23B:
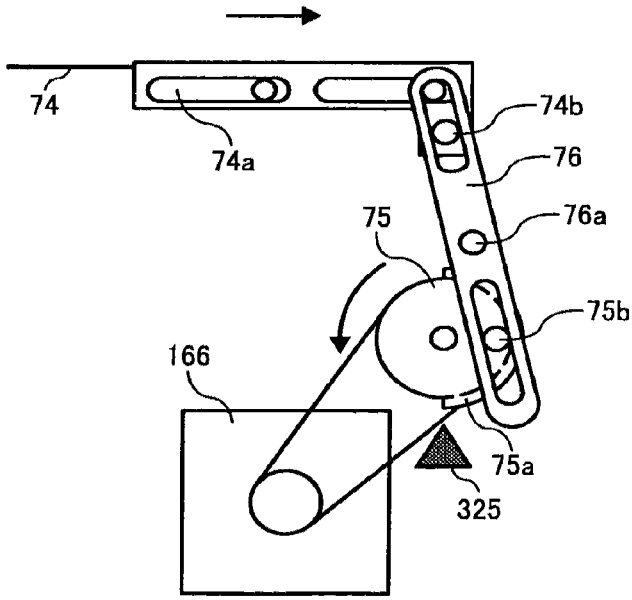

FIGS. 23A and 23B are explanatory views of a moving mechanism of the folding plate 74.

The folding plate 74 has long holes 74*a* in which two shafts erected on a front side plate and a rear side plate are fitted loosely, respectively, to support the folding plate 74 such that the folding plate 74 is movable longitudinally along the long holes 74*a*. A shaft 74*b* of the folding plate 74 is fitted in a long hole 76*b* of a link arm 76. As a result, the folding plate 74 reciprocates left and right in FIGS. 23A and 23B when the link arm 76 swings about a fulcrum 76*a*. A long hole 76*c* is formed on the end of the link arm 76 that is opposite to the long hole 76*b* with regard to the fulcrum 76*a*. A shaft 75*b* of a folding plate driving cam 75 is fitted loosely in the long hole 76*c*, so that the rotation of the folding plate driving cam 75 causes the link arm 76 to swing. The folding plate driving cam 75 is rotated in a direction indicated by arrows shown in FIGS. 23A and 23B by a folding plate driving motor 166. The stop position of the folding plate driving cam 75 is determined based on detection of both ends of a semicircular shielding unit 75*a* by a folding plate HP sensor 325.

FIG. 23A depicts a home position at which the folding plate 74 has retracted completely from a paper sheaf storage area of the saddle stitching process tray G. When the folding plate driving cam 75 is rotated in a direction indicated by the arrow, the folding plate 74 moves in the arrowed direction to project into the paper sheaf storage area of the saddle stitching process tray G. FIG. 23B depicts the state of each unit that results when the center of a paper sheaf on the saddle stitching process tray G is pushed into a nip of the folding roller 81. When the folding plate driving cam 75 is rotated in a direction indicated by an arrow in FIG. 23B, the folding plate 74 moves in that direction to retract from the paper sheaf storage areas of the saddle stitching process tray G.

In this embodiment, it is assumed that center folding is carried out when a sheaf of papers are stitched. The present invention, however, applies also to a case of folding of a single paper. Because saddle stitching is unnecessary when a single paper is processed, the single paper is sent immediately into the saddle stitching process tray G at the point that the paper is ejected. The paper is then subjected to a folding process by the folding plate 74 and the folding roller 81, and is ejected from a lower paper ejecting roller 83 onto the lower tray 203. Reference numeral 323 denotes a folding unit passage sensor that detects an inwardly folded paper, reference numeral 321 denotes a sheaf detecting sensor that detects the paper sheaf's reaching an center folding position, and reference numeral 322 denotes a movable trailing edge fence home position sensor that detects the home position of the movable trailing edge fence 73.

In this embodiment, the lower tray 203 is provided with a detecting lever 501 swingable about a fulcrum 501*a*. The detecting lever 501 detects the stack height of a sheaf of inwardly folded papers. The angle of the detecting lever 501 is detected by a paper-surface sensor 505 to detect the ascending/descending motion and overflow of the lower tray 203.

5.3 Modes and Ejection Patterns

In the present embodiment, the following post-processing modes are set, and a paper is ejected according to each of the modes. The post-processing modes include the following five types.

Nonstaple mode (A): a mode in which a paper is transported through the transport paths A and B, and is ejected onto the upper tray 201.

Nonstaple mode (B): a mode in which a paper is transported through the transport paths A and C, and is ejected onto the shift tray 202.

Sort/stack mode: a mode in which a paper is transported through the transport paths A and C, and is ejected onto the shift tray 202, which swings in the direction perpendicular to the paper ejecting direction at each end of a lot to sort out ejected papers.

Staple mode: a mode in which a paper sheaf is transported through the transport paths A and D to the end face stitching process tray F, where the paper sheaf is aligned and stitched, and then is transported through the transport path C to be ejected onto the shift tray 202.

Saddle stitching bookbinding mode: a mode in which a paper sheaf is transported through the transport paths A and D to the end face stitching process tray F, where the paper sheaf is aligned and stitched at its center, and is sent to the process tray G where the paper sheaf is folded at its center, and then is transported through the transport path H to be ejected onto the lower tray 203.

Operation carried out in each mode is described below.

(1) Operation in Nonstaple Mode (A)

A paper distributed by the branch nail 15 on the transport path A is guided to the transport path B, from which the paper is ejected onto the upper tray 201 by the transport roller 3 and the upper paper ejecting roller 4. The upper paper ejecting sensor 302 disposed near the upper paper ejecting roller 4 for detection of paper ejection monitors the state of paper ejection.

(2) Operation in Nonstaple Mode (B)

A paper distributed by the branch nails 15 and 16 on the transport path A is guided to the transport path C, from which the paper is ejected onto the shift tray 202 by the transport roller 5 and the paper ejecting roller 6. The shift paper ejecting sensor 303 disposed near the paper ejecting roller 6 for detection of paper ejection monitors the state of paper ejection.

(3) Operation in Sort/Stack Mode

In this mode, a paper is transported and ejected in the same manner as in the nonstaple mode (B). When the paper is ejected, the shift tray 202 swings in the direction perpendicular to the paper ejecting direction at each end of a lot to sort out ejected papers.

(4) Operation in Staple Mode

A paper distributed by the branch nails 15 and 16 on the transport path A is guided to the transport path D, from which the paper is ejected onto the end face stitching process tray F by the transport rollers 7, 9, and 10 and the staple paper ejecting roller 11. At the end face stitching process tray F, papers that have been sequentially ejected out of the staple paper ejecting roller 11 are aligned. When a predetermined number of papers are stacked into a paper sheaf, the paper sheaf is subjected to the stitching process by the end face stitching stapler S1. The stitched paper sheaf is then transported downstream by the releasing nail 52*a*, and is ejected onto the shift tray 202 by the paper ejecting roller 6. The shift paper ejecting sensor 303 is disposed near the paper ejecting roller 6 for detection of paper ejection. The shift paper ejecting sensor 303 monitors the state of paper ejection.

(4-1) Releasing Process after Stapling

When the staple mode is selected, the jogger fence 53 moves from the home position to a stand-by position where each side of the jogger fence 53 is 7 millimeters distant from each edge of the width of a paper ejected onto the end face stitching tray F, as shown in FIG. 6. When the paper is transported by the staple paper ejecting roller 11 and the trailing edge of the paper passes the staple paper ejecting sensor 305, the jogger fence 53 moves inward by 5 millimeters from the stand-by position to stop. The staple paper ejecting sensor 305 detects the trailing edge of the paper when the trailing edge passes by, and sends a detection signal to the CPU 360 (see FIG. 33). Upon receiving this signal, the CPU 360 starts counting the number of pulses generated from a staple transport motor (not shown) that drives the staple paper ejecting roller 11, and turns ON the striking SOL 170 after a predetermined number of pulses are generated. The return roller 12 oscillates as the striking SOL 170 is turned ON and OFF. When the striking SOL 170 is turned ON, the return roller 12 jogs the paper to send it down and butt it against the trailing edge fence 51 in a jogging motion. In this process, every time a paper stored in the end face stitching tray F passes the entrance sensor 301 or the staple paper ejecting sensor 305, a detection signal from the sensor is input to the CPU 360 and the number of papers is counted.

When a given time has passed after turning OFF of the striking SOL 170, the jogger fence 53 is moved further inward by 2.6 millimeters by the jogger motor 158 to halt to end lateral jogging. The jogger fence 53 then moves outward by 7.6 millimeters to return to the stand-by position, and waits for a next paper. This operation is repeated until the paper of the last page is processed. Subsequently, the jogger fence 53 moves inward by 7.6 millimeters again to stop, and holds both side ends of a paper sheaf to be ready for stapling. After a given time has passed, the end face stitching stapler S1 is actuated by a staple motor (not shown) to carry out the stitching process. If stitching at two or more spots is specified, the stapler moving motor 159 is driven after the end of stitching at one spot to move the end face stitching stapler S1 along the trailing edge of the paper to a proper spot, where stitching at the second spot is carried out. When a third spot or additional spot for stitching is specified, this operation is repeated.

When the stitching process is over, the releasing motor 157 is driven to drive the releasing belt 52. At the same time, the paper ejecting motor is also driven, which causes the paper ejecting roller 6 to start rotating to receive the paper sheaf lifted by the releasing nail 52*a*. At this time, the jogger fence 53 is controlled in different manners depending on sizes of papers and the number of stitched papers. For example, when the number of stitched papers is smaller than a preset number of papers or the size of papers is smaller than a preset size, the releasing nail 52*a* hooks on the trailing edge of the paper sheaf to transport the paper sheaf while the jogger fence 53 keeps holding the paper sheaf. After a given number of pulses are generated through detection of the paper sheaf by the paper presence/absence sensor 310 or the releasing belt HP sensor 311, the jogger fence 53 is retracted by 2 millimeters to release the paper sheaf from the jogger fence 53. A predetermined number of pulses are set within a period from the point of the releasing nail's contacting the trailing edge of the paper sheaf to the point of the trailing edge's passing the leading edge of the jogger fence 53. When the number of stitched papers is greater than the preset number of papers or the size of papers is larger than the preset size, the jogger fence 53 is retracted by 2 millimeters in advance, and the paper sheaf is released. In both cases of the number of stitched papers and size of papers, when the paper sheaf passes through the jogger fence 53, the jogger fence 53 moves further outward by 5 millimeters to return to the stand-by position reading preparation for a next paper. The restraint of the papers by the jogger fence 53 can be adjusted by adjusting the distance from the jogger fence 53 to the papers.

(5) Operation in Saddle Stitching Bookbinding Mode

Figure 25:
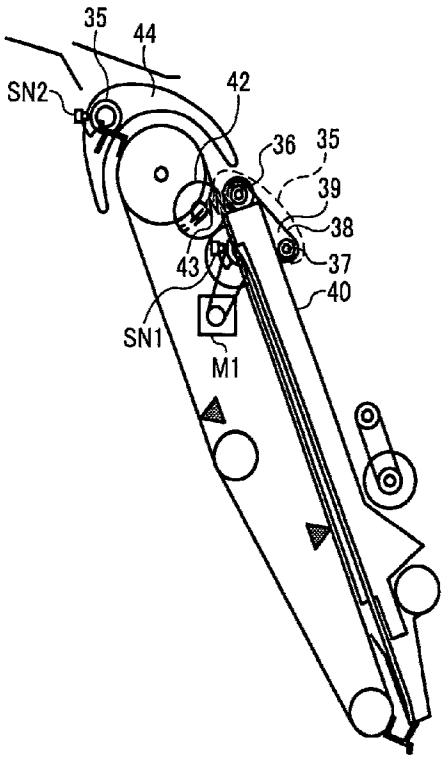
FIG. 25 depicts a state where papers are aligned and stacked on a stapling process tray.
Figure 24:
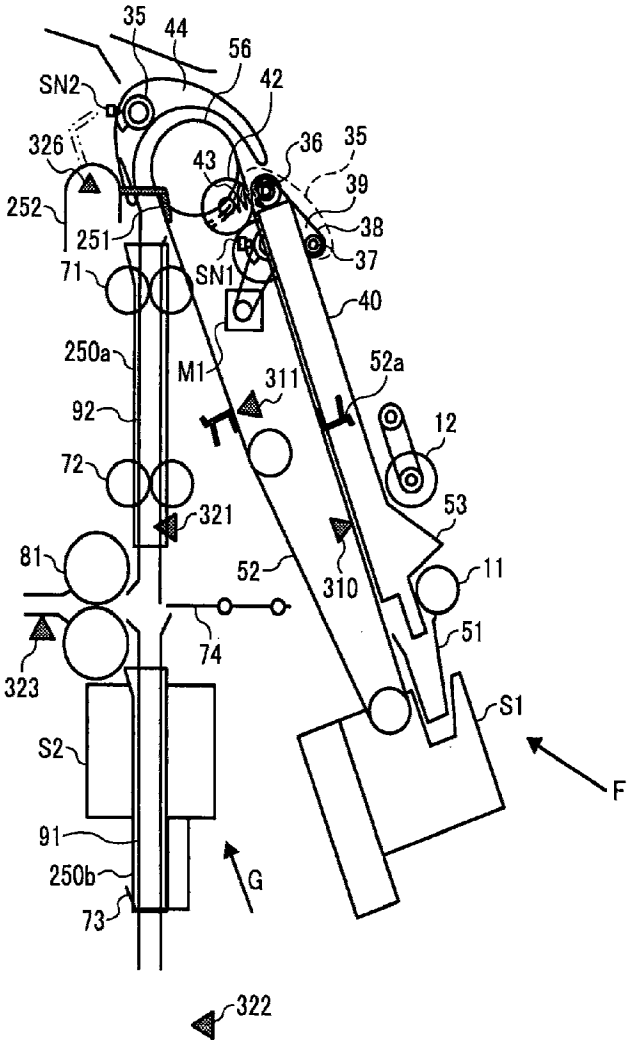
FIG. 24 is a plan view of the end face stitching process tray and a saddle stitching process tray.
Figure 32:
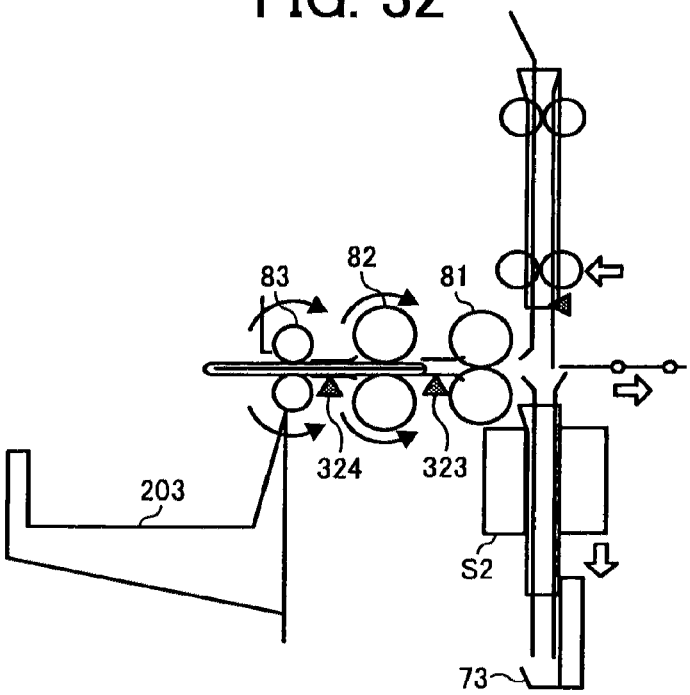
FIG. 32 depicts a state where center folding of the paper sheaf in the state of FIG. 31 is strengthened at a folding roller position.

FIG. 24 is a plan view of the end face stitching process tray F and the saddle stitching process tray G, and FIGS. 25 and 32 are explanatory views of an operation that is carried out in the saddle stitching bookbinding mode.

Referring to FIG. 1, a paper distributed by the branch nails 15 and 16 on the transport path A is guided to the transport path D, from which the paper is ejected onto the end face stitching process tray F of FIG. 24 by the transport rollers 7, 9, and 10 and the staple paper ejecting roller 11. At the end face stitching process tray F, papers that have been sequentially ejected out of the staple paper ejecting roller 11 are aligned in the same manner as in the staple mode described in (4), and the same operation as in the staple mode is carried out up to the point just before stapling of the papers (see FIG. 25 depicting a state where a paper sheaf is aligned by the trailing edge fence 51).

Figure 27:
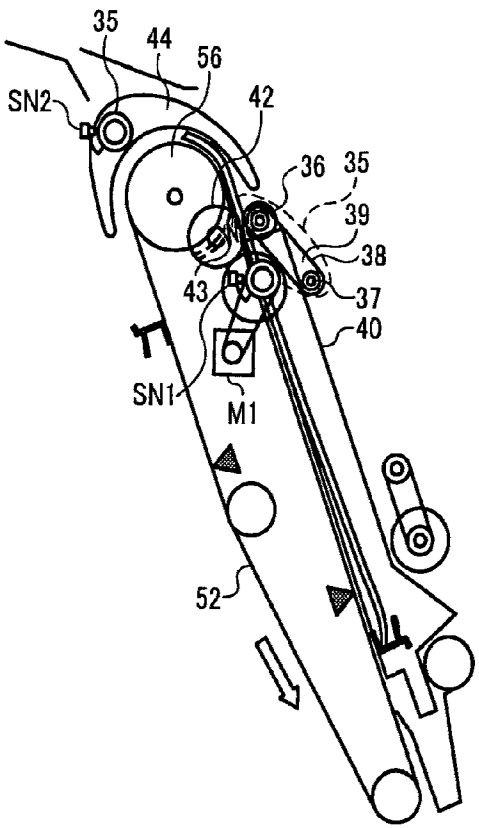
FIG. 27 depicts an initial state where the paper sheaf in the state of FIG. 26 has been guided in the paper turning mechanism.
Figure 26:
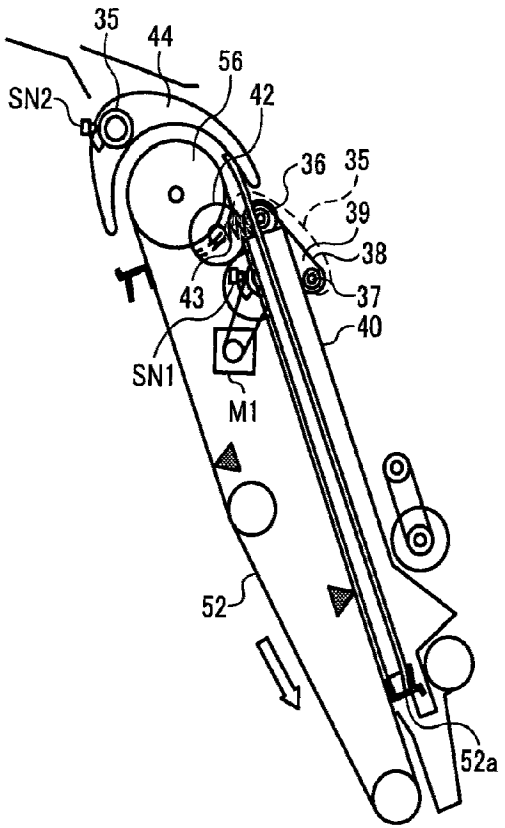
FIG. 26 depicts a state where the releasing nail starts pushing up a paper sheaf in the state of FIG. 25.

As shown in FIG. 26, after the paper sheaf is temporarily aligned at the end face stitching process tray F, the leading edge of the paper sheaf is pushed up by the releasing nail 52*a*. The papers then pass through between the driven roller 42 and the roller 36 that is opened to keep a space for preventing interference with the leading edge of the paper sheaf. The papers then proceed to a position at which the inner surface of the guide member 44 faces the outer peripheral surface of the releasing roller 56. Then, the roller 36 is closed by the motor M1 and the cam 40 that make up the swing driving mechanism, so that the leading edge of the paper sheaf is sandwiched between the roller 36 and the driven roller 42 under a predetermined pressure. As shown in FIG. 27, the roller 36 is supplied with a driving force from the timing belt 38 to rotate, and the releasing roller 56 rotates to transport the paper sheaf downstream along the path leading to the saddle stitching process tray G. The releasing roller 56 is disposed on the driving shaft of the releasing belt 52, and is driven in synchronization with the releasing belt 52.

Figure 29:
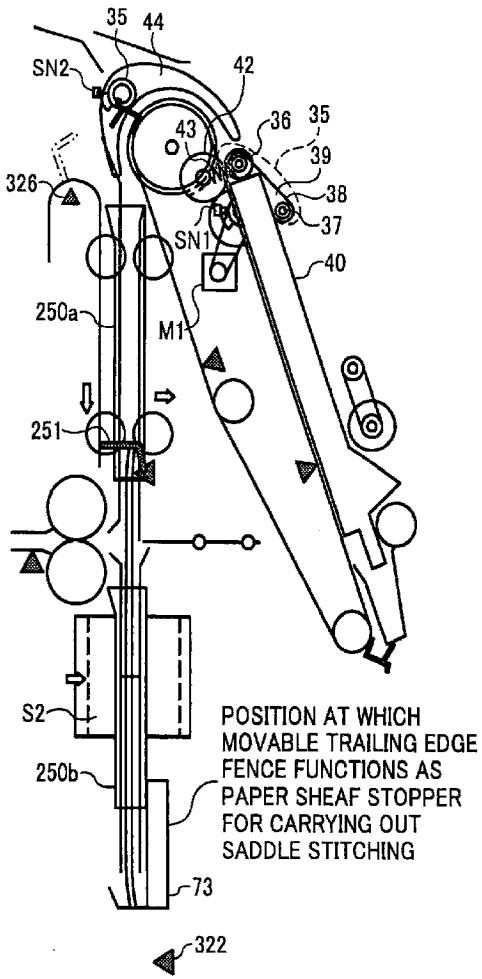
FIG. 29 depicts a state where the paper sheaf that is transported to the center folding process tray in the state of FIG. 28 is aligned.
Figure 28:
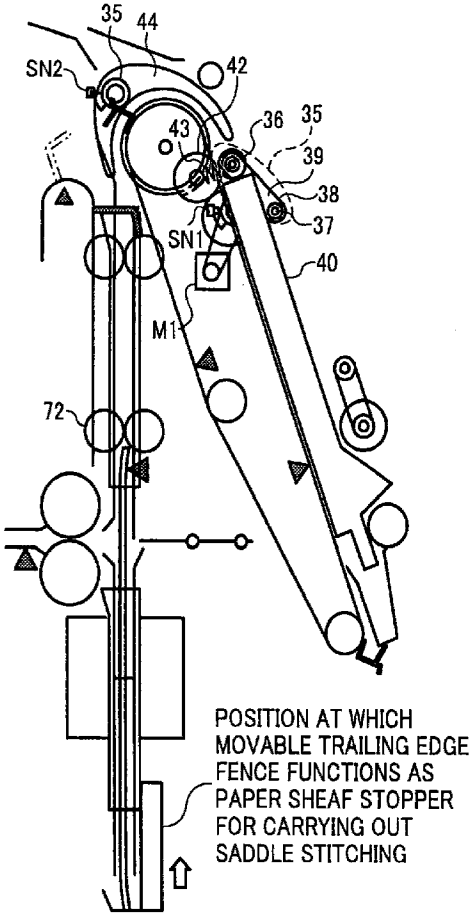
FIG. 28 depicts a state where the paper sheaf in the state of FIG. 27 has been transported to a center folding process tray.

The paper sheaf is transported from the position shown in FIG. 27 to the position shown in FIG. 28. Once entering the saddle stitching process tray G, the paper sheaf is transported by the upper sheaf transport roller 71 and the lower sheaf transport roller 72. At this time, the movable trailing edge fence 73 stands by at different stop positions depending on the different sizes in the transport direction of paper sheaves. When the leading edge of the paper sheaf comes in contact with the movable trailing edge fence 73 at the stand-by position and the papers are stacked there, the lower sheaf transport roller 72 releases its pressure, as shown in FIG. 28. Then, the trailing edge striking nail 251 strikes the trailing edge of the paper sheaf to carry out the final jogging in the transport direction, as shown in FIG. 29. This final jogging by the trailing edge striking nail 251 is necessary because a paper may shift in the paper sheaf during the course of process from temporal aligning at the end face stitching process tray F to stacking at the movable trailing edge fence 73.

The position of the paper sheaf shown in FIG. 29 is the saddle stitching position, at which the movable trailing edge fence 73 stands by, the saddle stitching upper jogger fence 250*a* and the saddle stitching lower jogger fence 250*b* carry out the final jogging in the paper width direction, and the saddle stitching stapler S2 stitches the center of the paper sheaf. The movable trailing edge fence 73 is positioned by pulse control from the movable trailing edge fence HP sensor 322, and the trailing edge striking nail 251 is positioned by pulse control from the trailing edge striking nail HP sensor 326.

Figure 30:
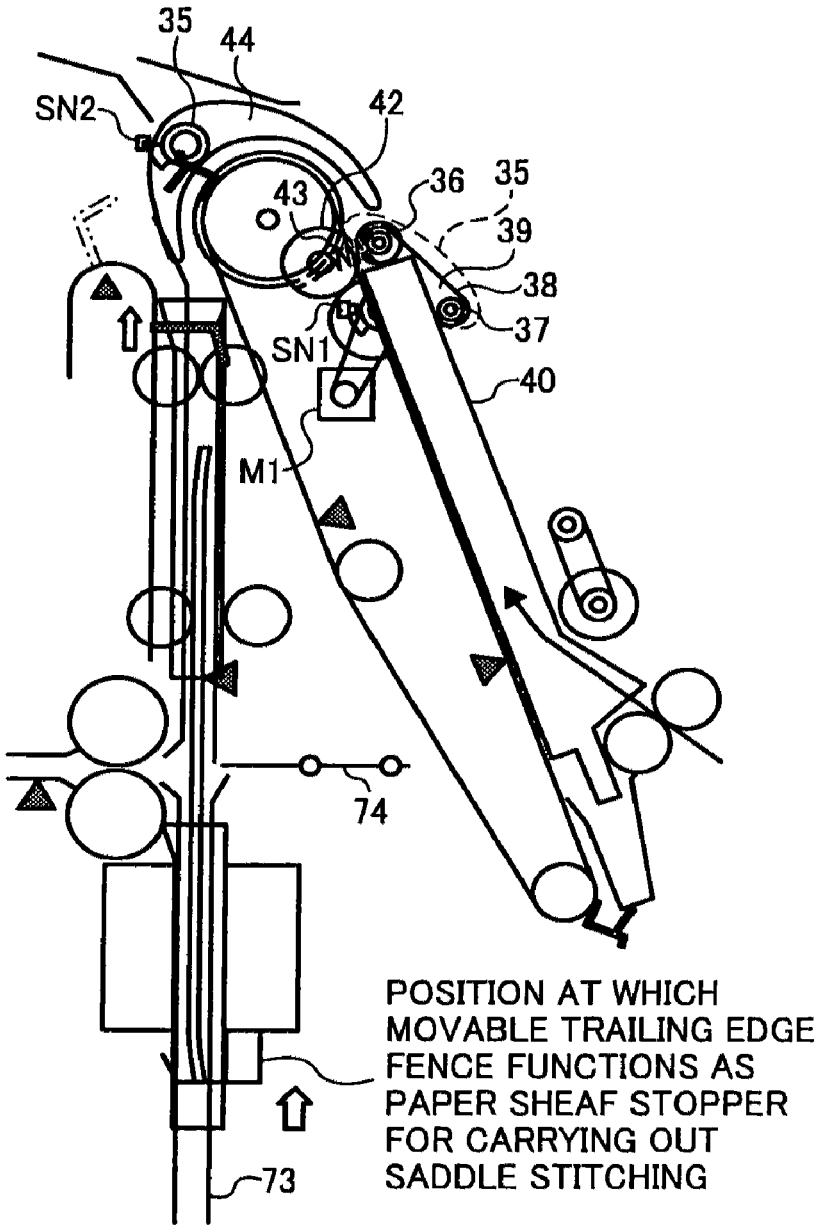
FIG. 30 depicts a state where the paper sheaf in the state of FIG. 29 is pushed up to a center folding position.
Figure 31:
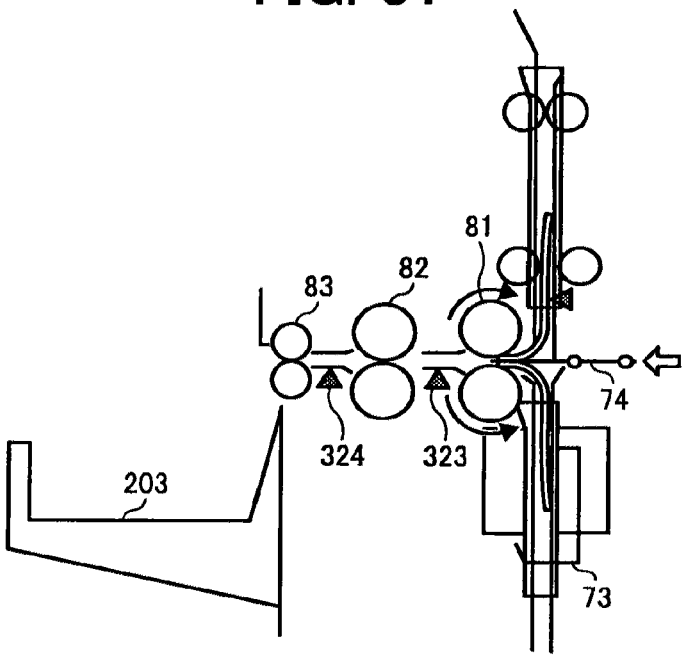
FIG. 31 depicts a state where center folding of the paper sheaf in the state of FIG. 30 is started.

As shown in FIG. 30, the paper sheaf stitched at its center is released from the pressure by the lower sheaf transport roller 72, and is transported in a pressure-free state up to a position at which the center folding position of the paper sheaf corresponds to the folding plate 74 as the movable trailing edge fence 73 moves up. Subsequently, as shown in FIG. 31, the folding plate 74 pushes in the vicinity of a stapled potion in the direction substantially perpendicular to the paper sheaf, guiding the paper sheaf to the nip of the folding roller 81 that is disposed in a preceding direction of the folding plate 74 to face the paper sheaf. Rotating in advance, the folding roller 81 catches the paper sheaf and transports it under pressure to fold the paper sheaf at its center. Transporting the saddle-stitched paper sheaf upward for the folding process in this manner allows sure transport of the paper sheaf only by the move of the movable trailing edge fence 73. If the paper sheaf is transported downward for the folding process only by the movable trailing edge fence 73, it is insufficient to attain ensured transport of the paper sheaf. Therefore, another unit, such as a transport roller, is necessary, resulting in a complicated configuration.

As shown in FIG. 32, the folded paper sheaf passes through a second folding roller 82 that strengthens the fold on the paper sheaf, and is ejected onto the lower tray 203 by the lower paper ejecting roller 83. At this time, when the trailing edge of the paper sheaf is detected by the folded portion passage sensor 323, the folding plate 74 and the movable trailing edge fence 73 return to their home positions and the lower sheaf transport roller 72 resumes its pressurization in preparation for a next paper. If the size and the number of papers of a next job are the same as the size and the number of papers of the present job, the movable trailing edge fence 73 moves to the position of FIG. 24 again. The second folding roller 82 shown in FIGS. 31 and 32 is not shown in FIG. 1 for convenience of explanation. Whether the second folding roller 82 is provided is determined depending on a design condition.

6. Control Circuit

Figure 33:
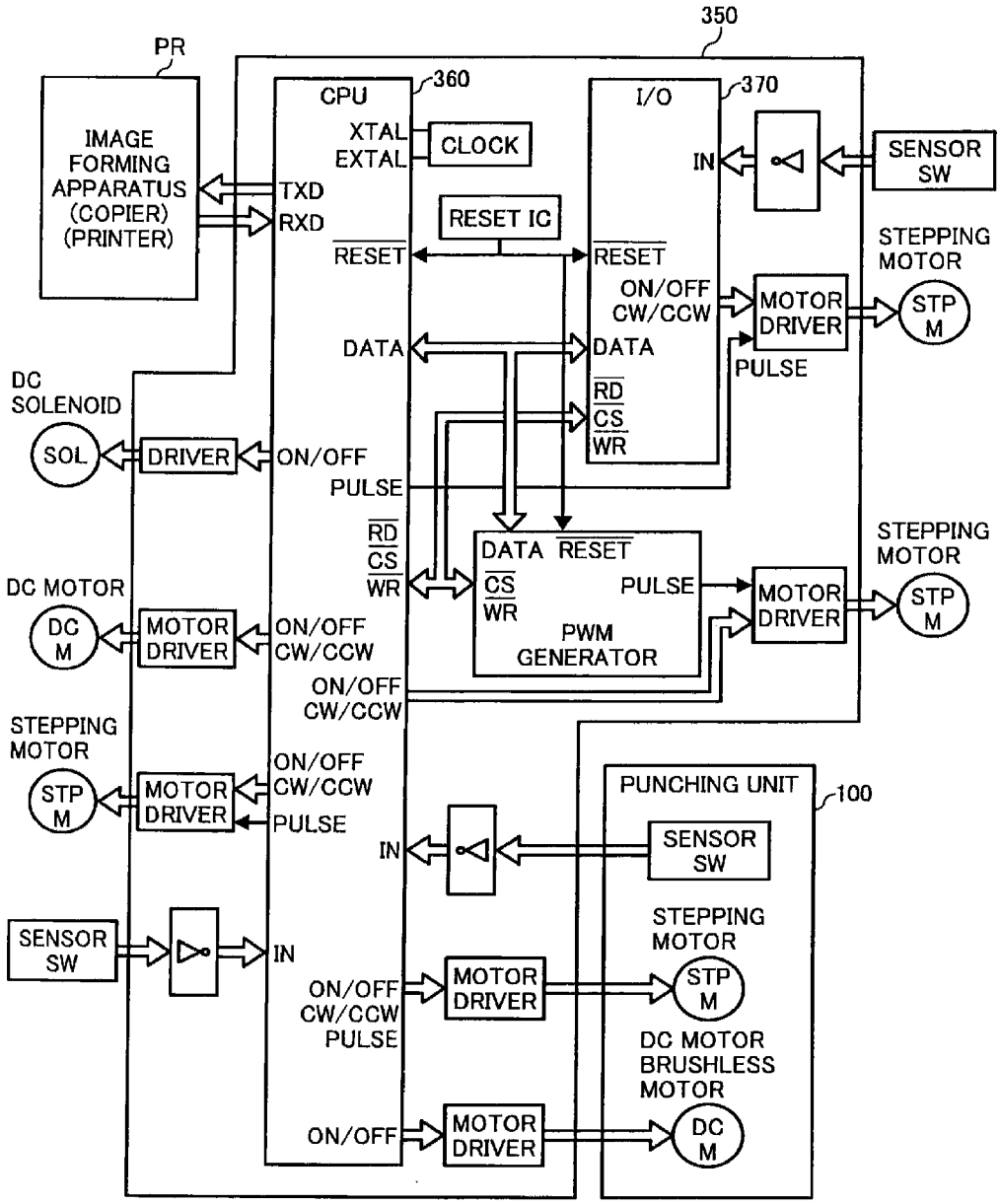
FIG. 33 is a block diagram of a control configuration of a system according to the embodiment.

FIG. 33 is a block diagram of a control configuration of a system according to the present embodiment. The control circuit 350 of the paper post-processing apparatus PD is a microcomputer that includes the CPU 360, an I/O interface 370, etc. Signals from switches on a control panel (not shown) of the body of the image forming apparatus PR and from sensors, such as the paper-surface detecting sensor 330, is input to the CPU 360 via the I/O interface 370. Based on an input signal, the CPU 360 controls driving of the tray lifting motor 168, the paper ejecting guide plate opening/closing motor 167, the shift motor 169, the return roller motor, solenoids, transport motors, paper ejecting motors, the releasing motor 157, the stapler moving motor 159, the diagonal motor 160, the jogger motor 158, the sheaf branch driving motor 161, the sheaf transport motor, the trailing edge moving motor, the folding plate driving motor 166, the folding roller driving motor. The tray lifting motor 168 is used for the shift tray 202. The paper ejecting guide plate opening/closing motor 167 opens and closes the opening/closing guide plate. The shift motor 169 moves the shift tray 202. The return roller motor drives the return roller 12. The solenoids include the striking SOL 170. The transport motors drive transport rollers. The paper ejecting motors drive paper ejecting rollers. The releasing motor 157 drives the releasing belt 52. The stapler moving motor 159 moves the end face stitching stapler S1. The diagonal motor 160 diagonally rotates the end face stitching stapler S1. The jogger motor 158 moves the jogger fence 53. The sheaf branch driving motor 161 rotates the guide member 44. The sheaf transport motor drives the transport roller 56 transporting a paper sheaf. The trailing edge moving motor moves the movable trailing edge fence 73. The folding plate driving motor 166 moves the folding plate 74. The folding roller driving motor drives the folding roller 81. Pulse signals from a staple transport motor (not shown) that drives the staple paper ejecting roller are input to the CPU 360, which counts the input pulses to control the striking SOL 170 and the jogger motor 158 according to the count of pulses.

The control operation to be described below is executed by the CPU 360. The CPU 360 reads program codes stored in a ROM (not shown), loads the read program codes onto a RAM (not shown), and executes the control operation based on computer programs indicated by the program codes, using the RAM as a work area.

7. Operation 7.1 Stopping Operation at the Time of Paper-Jamming

A stopping operation at the time of paper-jamming is carried out as one of the control operation. In this control operation, upon detection of paper-jamming, when another paper is not present downstream of a paper causing the paper-jamming, or even if such another paper is present, when the most downstream side paper is located upstream of a specified position, transport rollers are stopped to prevent ejection of all papers on transport out of the post-processing apparatus. Furthermore, upon detection of paper-jamming, when another paper is present downstream of a paper causing the paper-jamming and the most downstream side paper is located downstream of the specified position, an ejecting roller is kept driven to completely eject only the most downstream side paper. In this process, at the occurrence of the cause of stopping operation, when the leading edge of the most downstream side paper is located upstream of the paper ejecting roller (i.e., the leading edge of the paper is in the post-processing apparatus), transport rollers are stopped to prevent ejection of all papers on transport out of the post-processing apparatus. When the leading edge of the paper is located downstream of the paper ejecting roller (i.e., the leading edge of the paper is out of the post-processing apparatus), only the paper whose leading edge is located downstream of the paper ejecting roller is completely ejected out.

Figure 51:
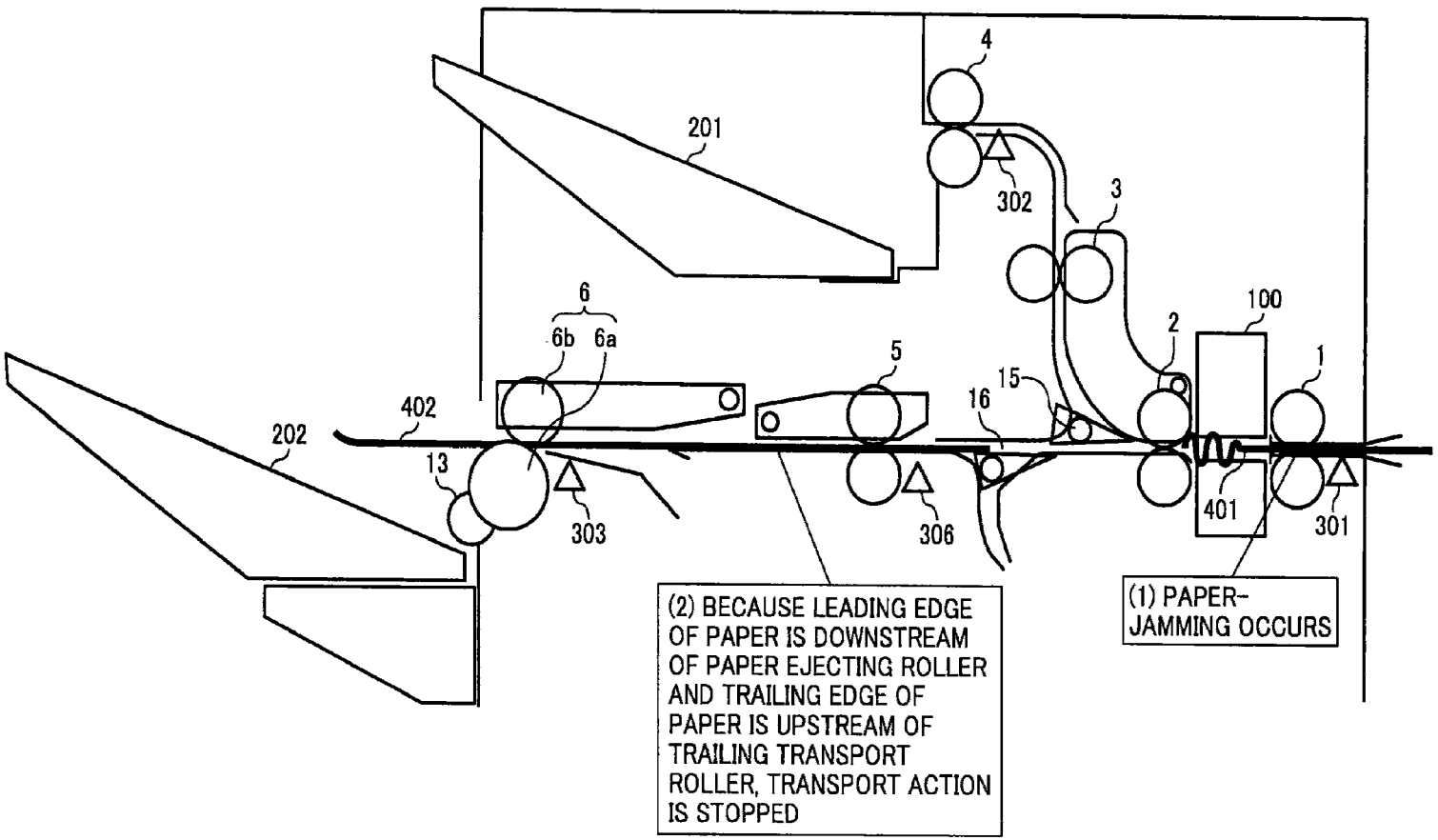
FIG. 51 is an explanatory view of a stopping operation at the time of paper-jamming when a most downstream side paper is located downstream of a specified position.

The CPU 360 makes a determination on paper-jamming detection based on the passage time of the paper and a timing of detection of the leading edge or trailing edge of a paper by a plurality of paper detecting sensors arranged along a transport path. For example, as shown in FIG. 51 to be described later, paper-jamming is determined when a paper is not detected within a predetermined time from a time of detection of the leading edge of a paper by the entrance sensor 301. The predetermined timing is, for example, a time estimated in consideration of a specified paper transport speed and a detection position of a next paper sensor (e.g., the paper trailing edge detecting sensor 306 or the shift paper ejecting sensor 303). In another case, when the same paper sensor (e.g., the entrance sensor 301) detects the leading edge of a paper and then does not detect the trailing edge of the paper after the passage of a time that is set based on the transport length and the transport speed of the paper, it is determined that the paper is stalled at the sensor position. Concretely, paper-jamming is determined.

Figure 34:
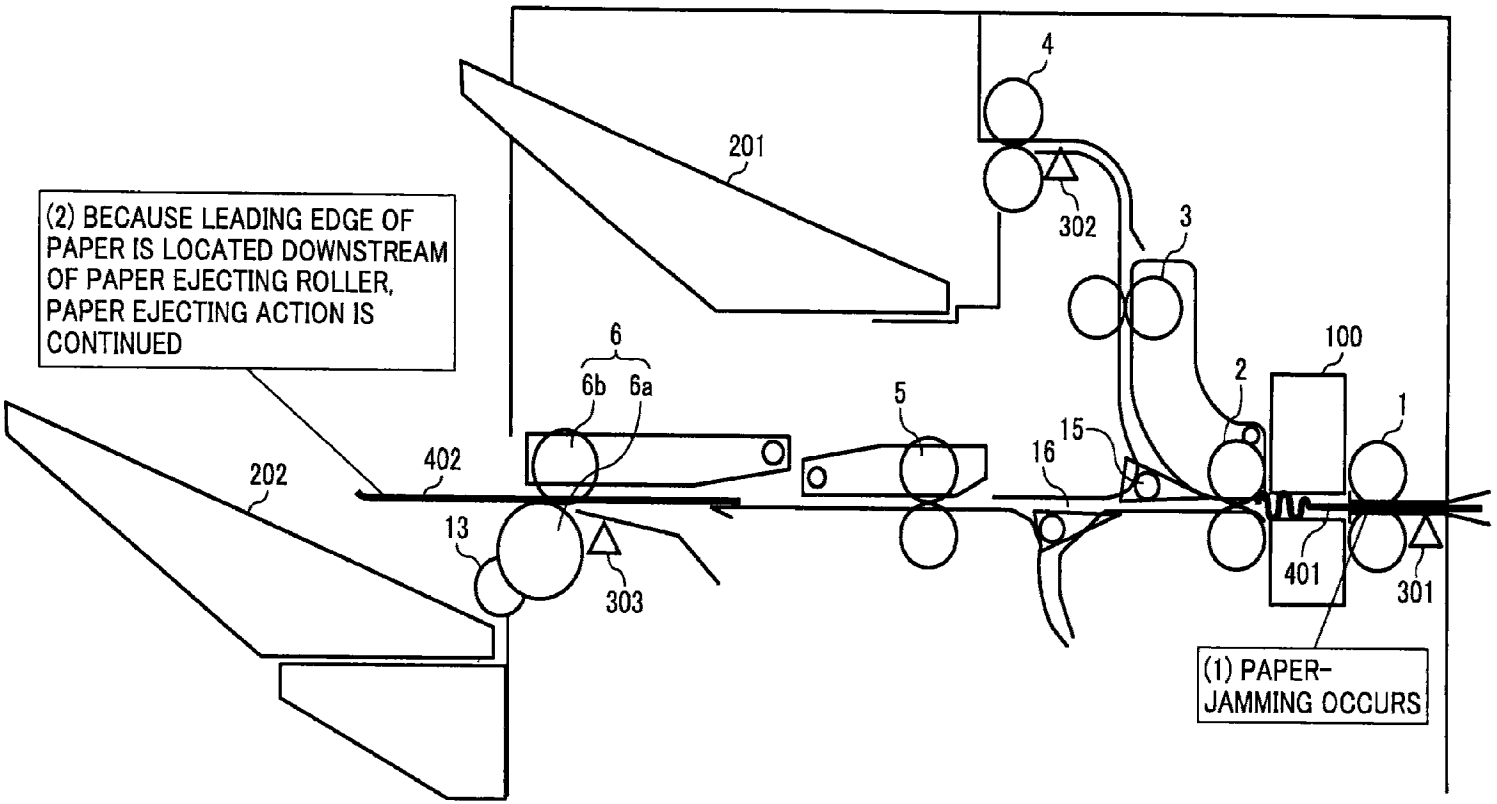
FIG. 34 depicts an example of a stopping operation at the time of paper-jamming.
Figure 35:
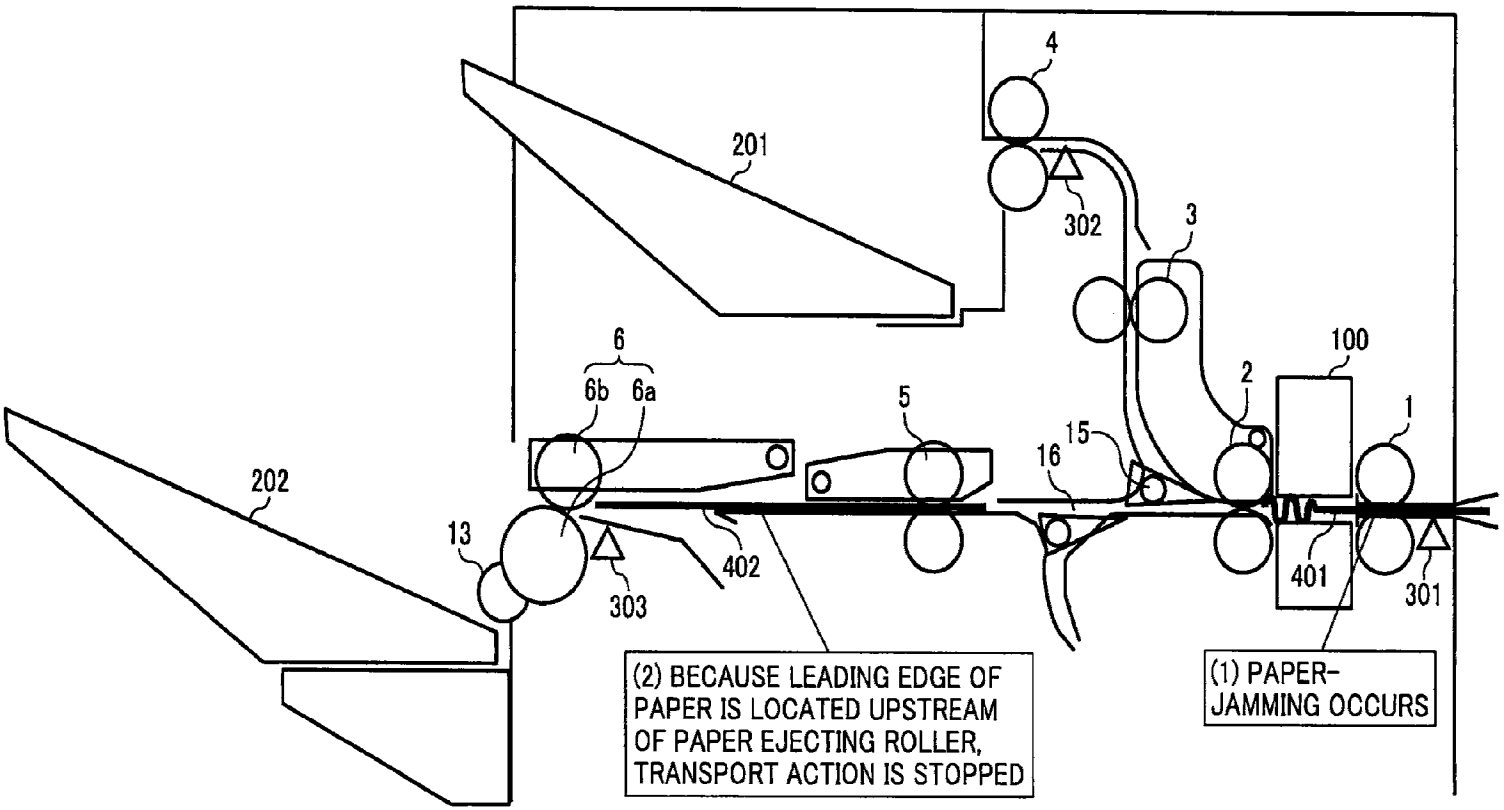
FIG. 35 depicts another example of the stopping operation at the time of paper-jamming.
Figure 36:
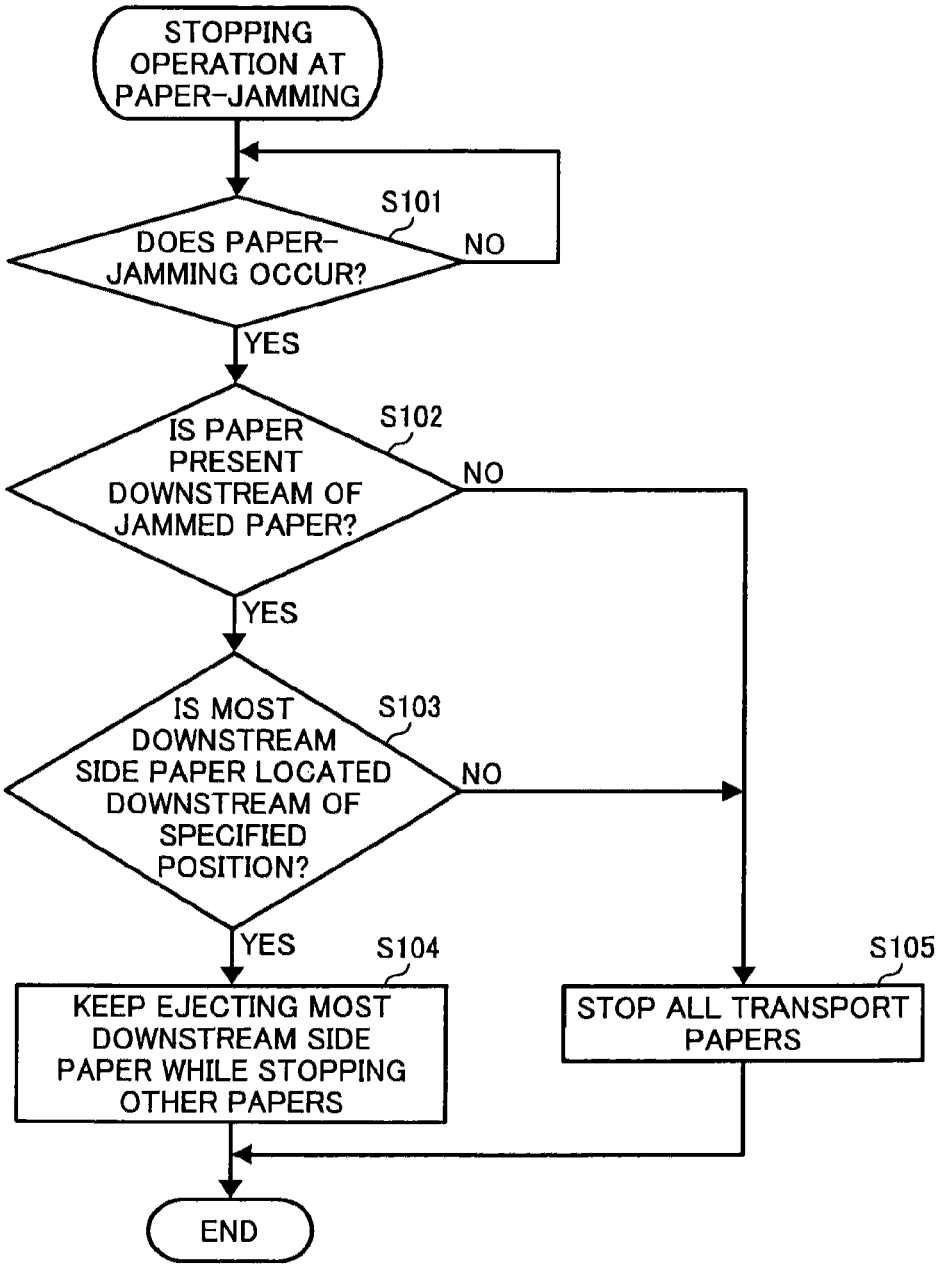
FIG. 36 is a flowchart of a processing procedure of the stopping operation at the time of paper-jamming.
Figure 37:
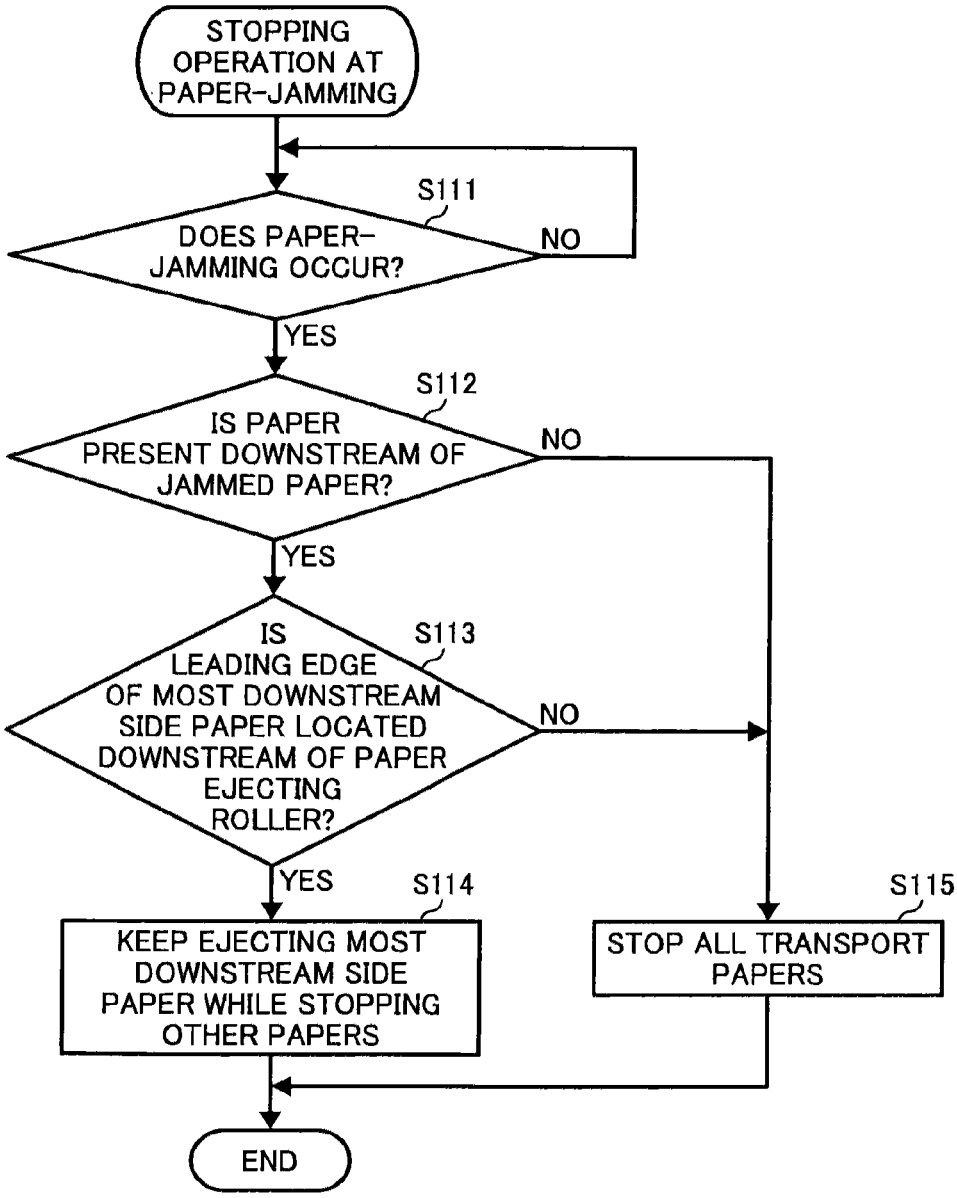
FIG. 37 is a flowchart of another processing procedure of the stopping operation at the time of paper-jamming.

FIGS. 34 and 35 depict examples of stopping operations at the time of paper-jamming. FIGS. 36 and 37 are flowcharts of processing procedures of the stopping operations at the time of paper-jamming.

In a case where paper-jamming (paper-jamming caused by a stalled paper in FIGS. 34 and 35) occurs at the location of the entrance sensor 301 (Steps S101 and S111), when a paper being transported by the transport rollers is not present downstream of a paper-jamming causing paper 401 (Step S102 and No at Step S103) or, even if such a paper is present, for example, when a most downstream side paper 402 is located upstream of a specified position (No at Step S103), for example, the leading edge of the most downstream side paper 402 is located upstream of the paper ejecting roller 6 (No at Step S113), all papers are stopped, as shown in FIG. 35 (Steps S105 and S115).

On the contrary, when a paper being transported by the transport rollers is present downstream of the paper-jamming causing paper 401 (Step S102 and Yes at Step S103) and the most downstream side paper 402 is located downstream of the specified position (Yes at Step S103), for example, when the leading edge of the most downstream side paper 402 is located downstream of the paper ejecting roller 6 (Yes at Step S113), only the most downstream side paper 402 is kept ejected while other papers are stopped.

7.2 Stopping Operation at the Time of Cover's Opening

A stopping operation at the time of the cover's opening is carried out as one of the control operation. In this control operation, upon detection of the cover's opening, when the most downstream side paper is at the upstream side of the specified position, transport rollers are stopped to prevent ejection of all papers out of the post-processing apparatus. Furthermore, upon detection of the cover's opening, when the most downstream side paper is at the downstream side of the specified position, the paper ejecting roller is kept driven to completely eject only the most downstream side paper. In this process, at the occurrence of the cause of stopping operation, when the leading edge of the most downstream side paper is located upstream of the paper ejecting roller (i.e., the leading edge of the paper is in the post-processing apparatus), transport rollers are stopped to prevent ejection of all papers out of the post-processing apparatus. Furthermore, when the leading edge of the paper is located downstream of the paper ejecting roller (i.e., the leading edge of the paper is out of the post-processing apparatus), only the paper whose leading edge is downstream of the paper ejecting roller is completely ejected out.

Figure 38:
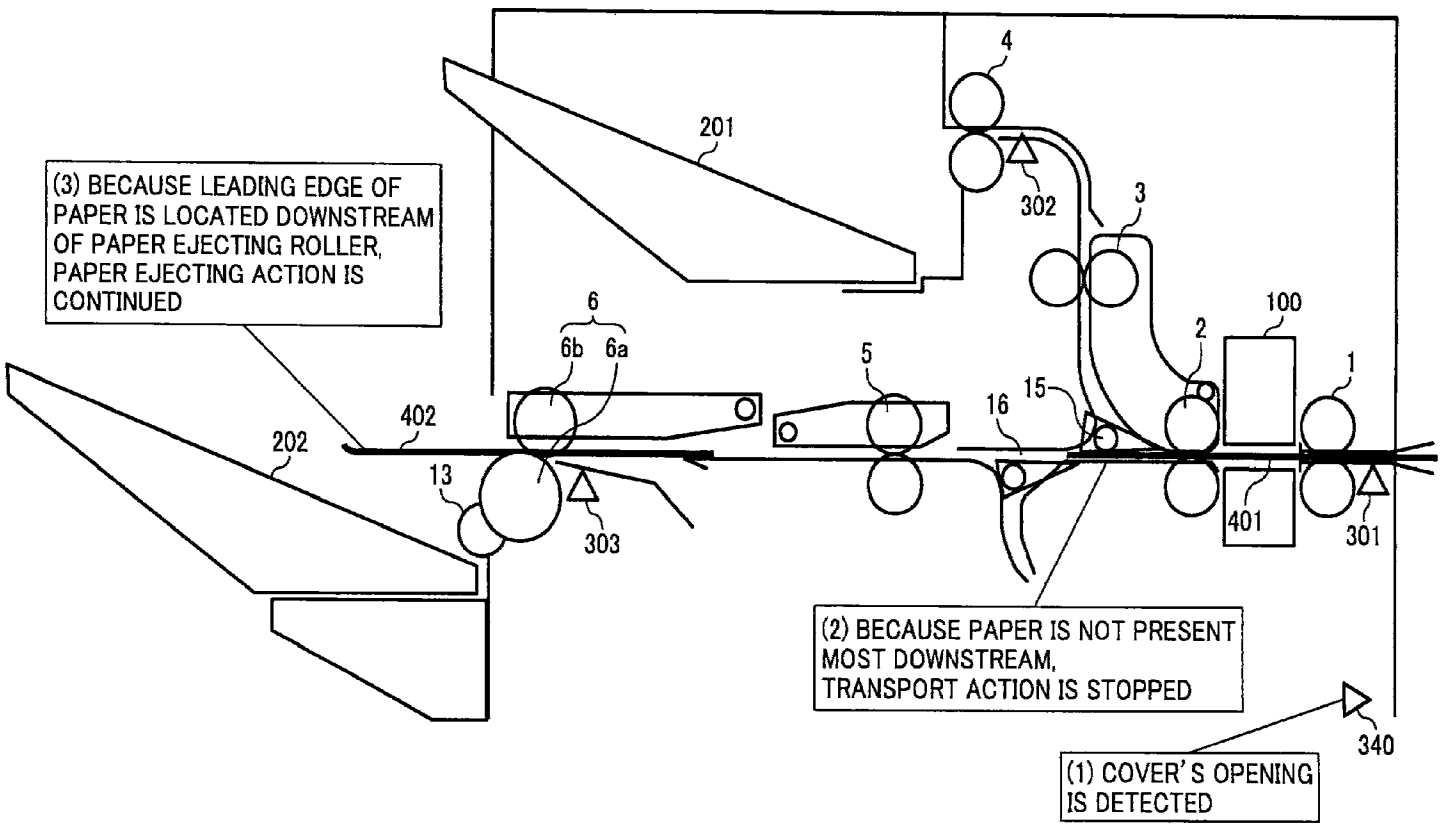
FIG. 38 depicts an example of a stopping operation at the time of a cover's opening.
Figure 39:
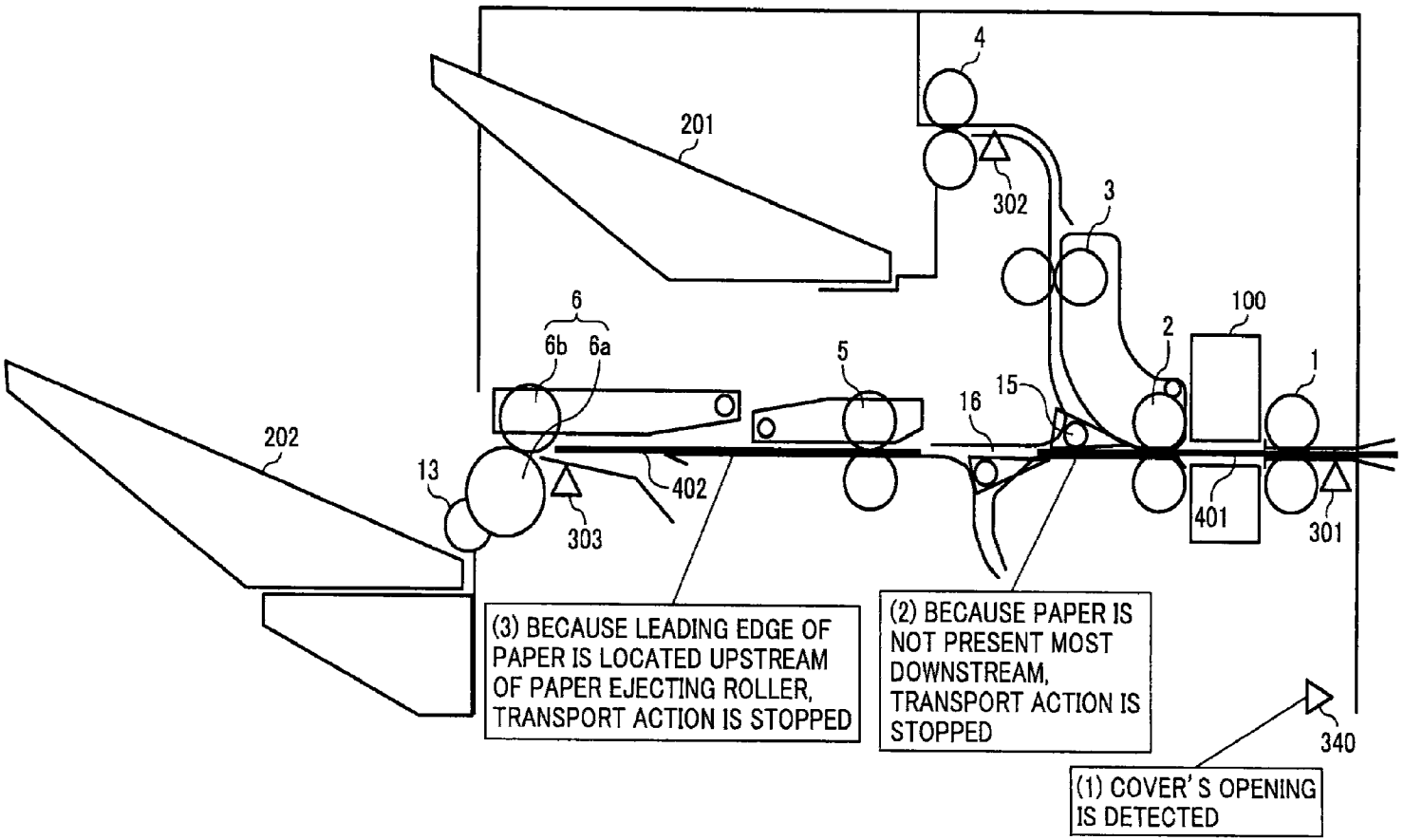
FIG. 39 depicts another example of the stopping operation at the time of the cover's opening.
Figure 40:
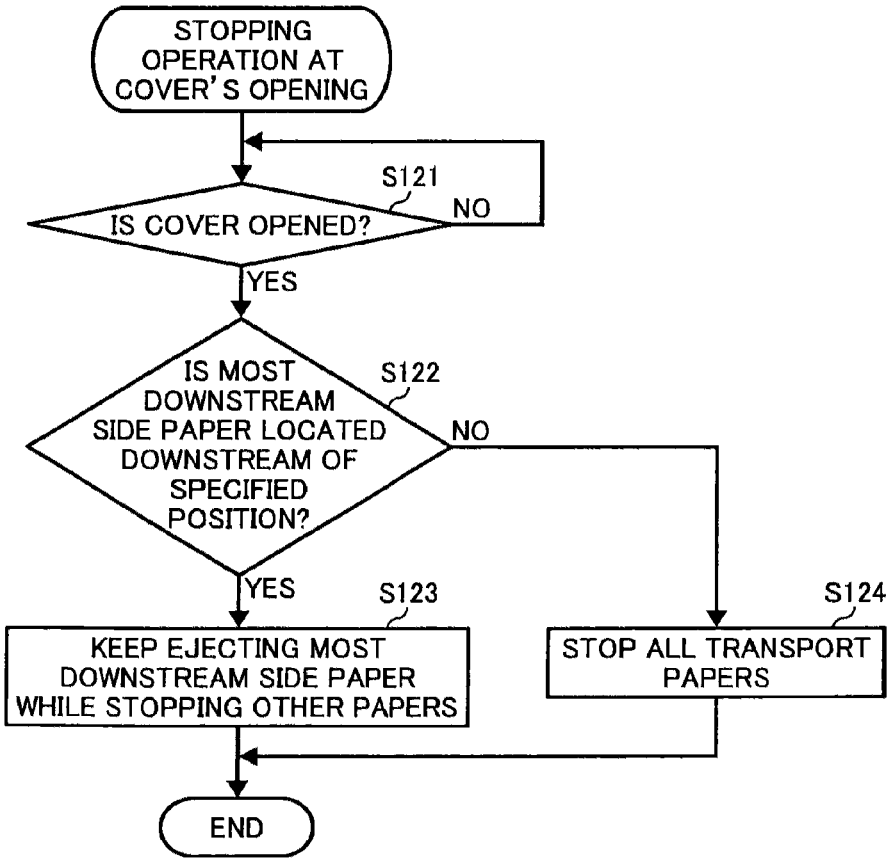
FIG. 40 is a flowchart of a processing procedure of the stopping operation at the time of the cover's opening.
Figure 41:
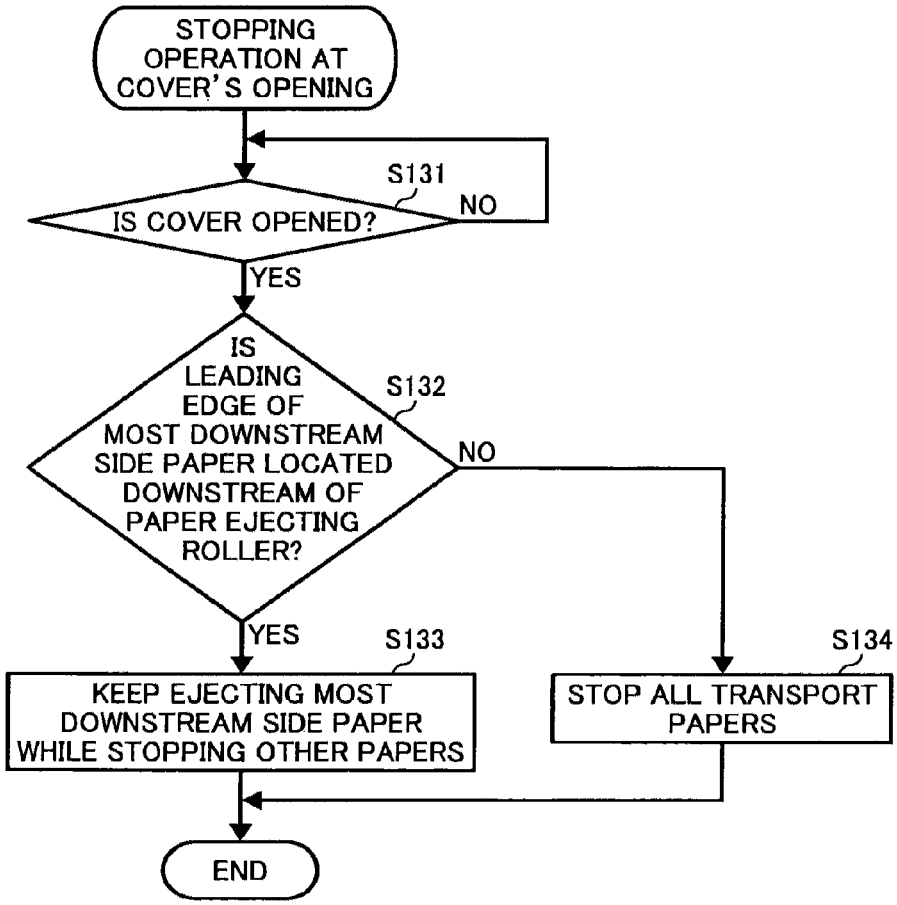
FIG. 41 a flowchart of another processing procedure of the stopping operation at the time of the cover's opening.

FIGS. 38 and 39 depict examples of stopping operations at the time of the cover's opening. FIGS. 40 and 41 are flowcharts of processing procedures of the stopping operations at the time of the cover's opening.

The paper post-processing apparatus PD has a front cover (not shown) on an enclosure, which can be opened and closed for handling paper-jamming or replacing a staple unit. A specific process needs to be taken when the front cover is opened during transport of papers, which is described below. A state of open or close of the front cover is detected by the front cover opening/closing sensor 340. When the front cover opening/closing sensor 340 detects the cover's opening during transport of papers (Steps S121 and Yes at Step S131) and the most downstream side paper 402 is present upstream of the specified position (No at Step S122), for example, the leading edge of the most downstream side paper 402 is located upstream of the paper ejecting roller 6 (No at Step S132), all papers are stopped, as shown in FIG. 39 (Step S134). On the contrary, when the most downstream side paper 402 is present downstream of the specified position (Yes at Step S122), for example, when the leading edge of the most downstream side paper 402 is located downstream of the paper ejecting roller 6 (Yes at Step S132), only the most downstream side paper 402 is kept ejected while other papers are stopped, as shown in FIG. 38 (Steps S123 and S133).

7.3 Stopping Operation at the Time of Occurrence of Abnormality

A stopping operation at the time of occurrence of an abnormality is carried out as one of the control operation. In this control operation, upon detection of an abnormality, e.g., an operation failure of any one of mechanisms in the paper post-processing apparatus PD, when another paper is not present downstream of a mechanism with the abnormality, or even if such a paper is present, when the most downstream side paper is present upstream of the specified position, transport rollers are stopped to prevent ejection of all papers out of the post-processing apparatus. Furthermore, upon detection of an abnormality of at least one of the mechanisms, when another paper is present downstream of a mechanism with the abnormality and the most downstream side paper is present downstream of the specified position, an ejection roller is kept driven to completely eject only the most downstream side paper. In this process, at the occurrence of the cause of stopping operation, when the leading edge of the most downstream side paper is located upstream of the paper ejecting roller (i.e., the leading edge of the paper is in the post-processing apparatus), transport rollers are stopped to prevent ejection of all papers out of the post-processing apparatus. When the leading edge of the paper is located downstream of the paper ejecting roller (i.e., the leading edge of the paper is out of the post-processing apparatus), only the paper whose leading edge is located downstream of the paper ejecting roller is completely ejected out. In detecting abnormality, for example, the CPU 360 determines an occurrence of an abnormality when the CPU 360 executes prescribed control over each unit and an operation following the control by the CPU 360 is not completed even after a scheduled time passes. The scheduled time is at which execution of the control is supposed to be completed.

Figure 42:
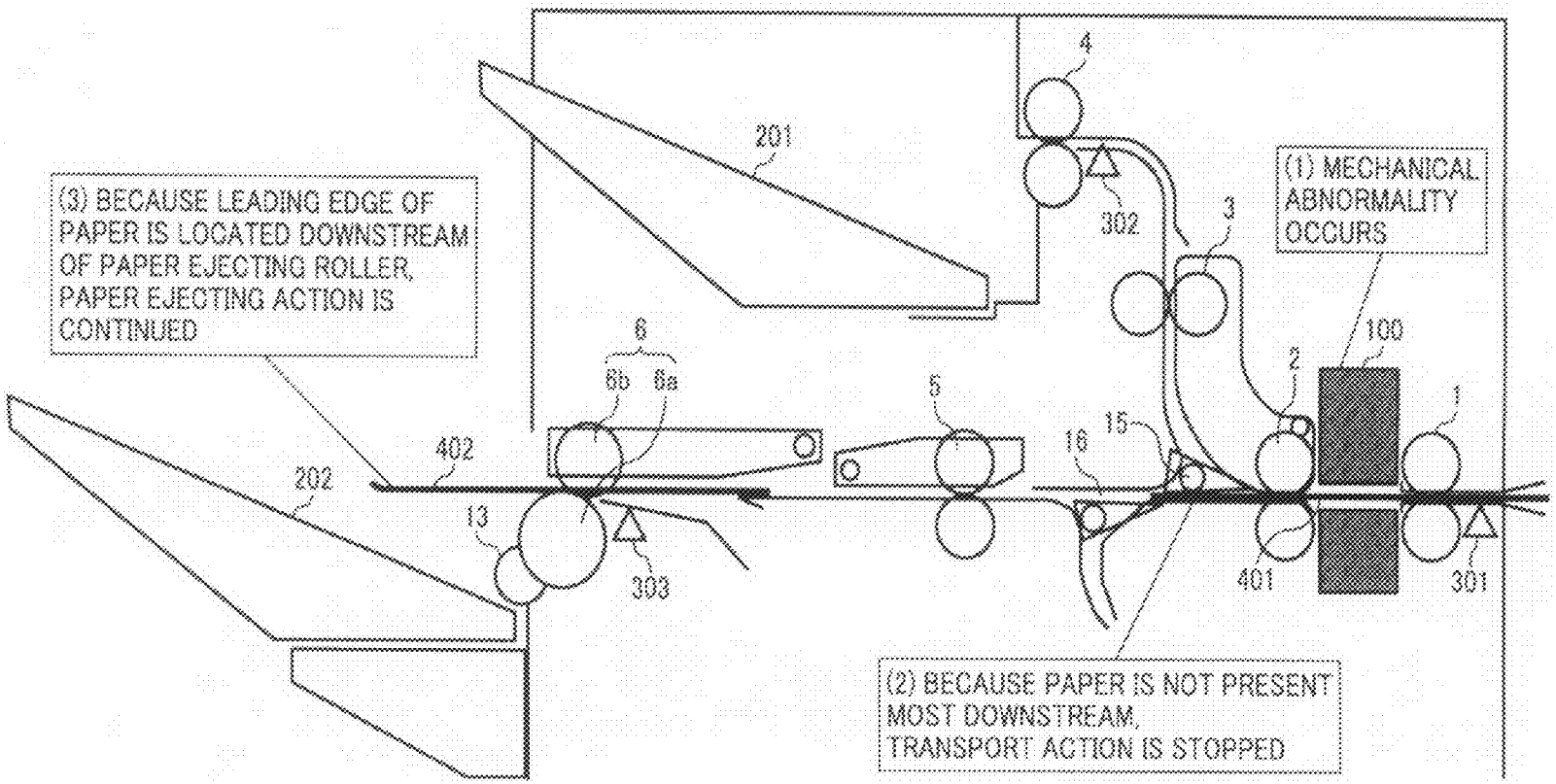
FIG. 42 depicts an example of a stopping operation at the time of occurrence of an abnormality.
Figure 43:
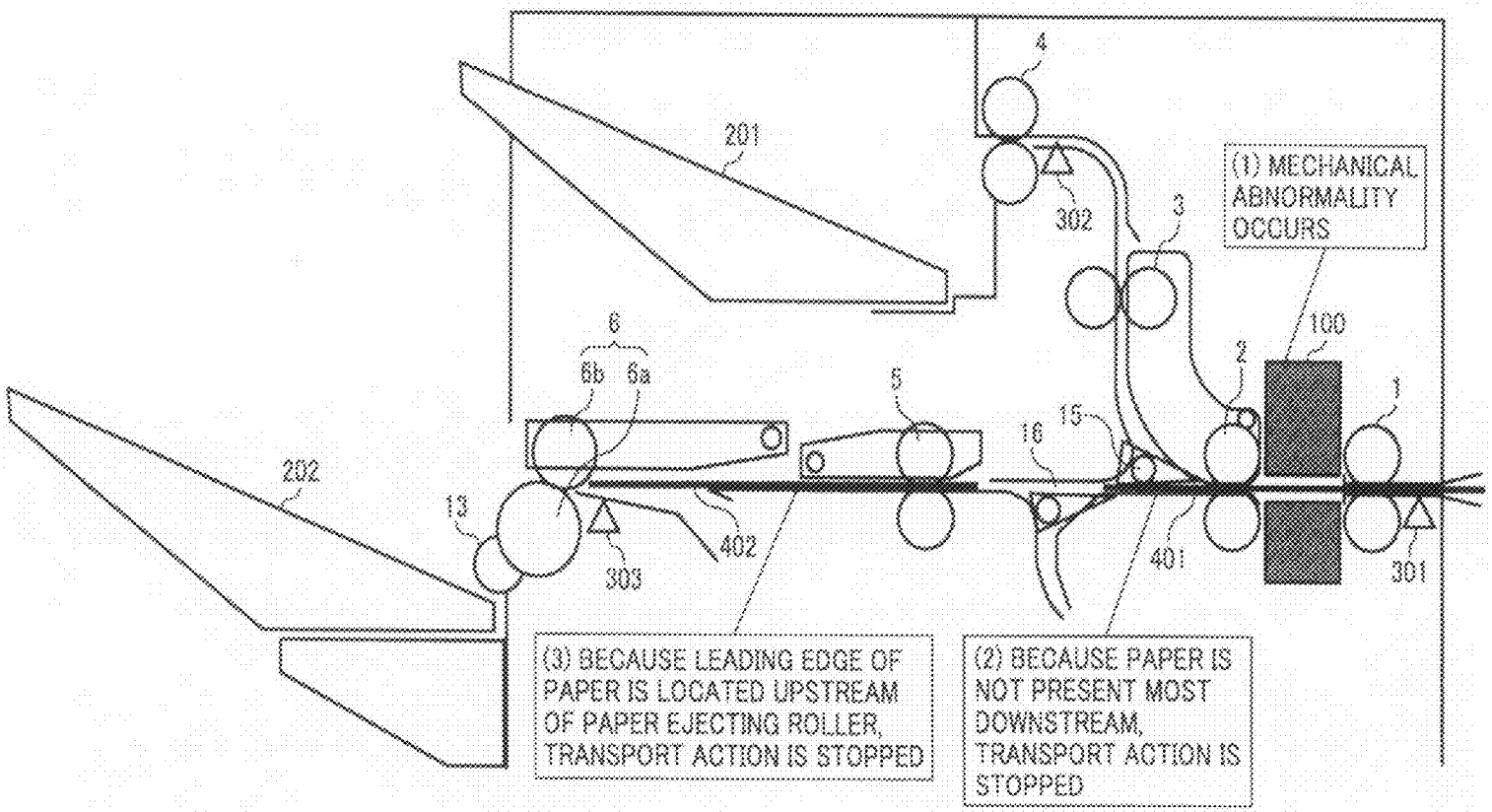
FIG. 43 depicts another example of the stopping operation at the time of occurrence of an abnormality.
Figure 44:
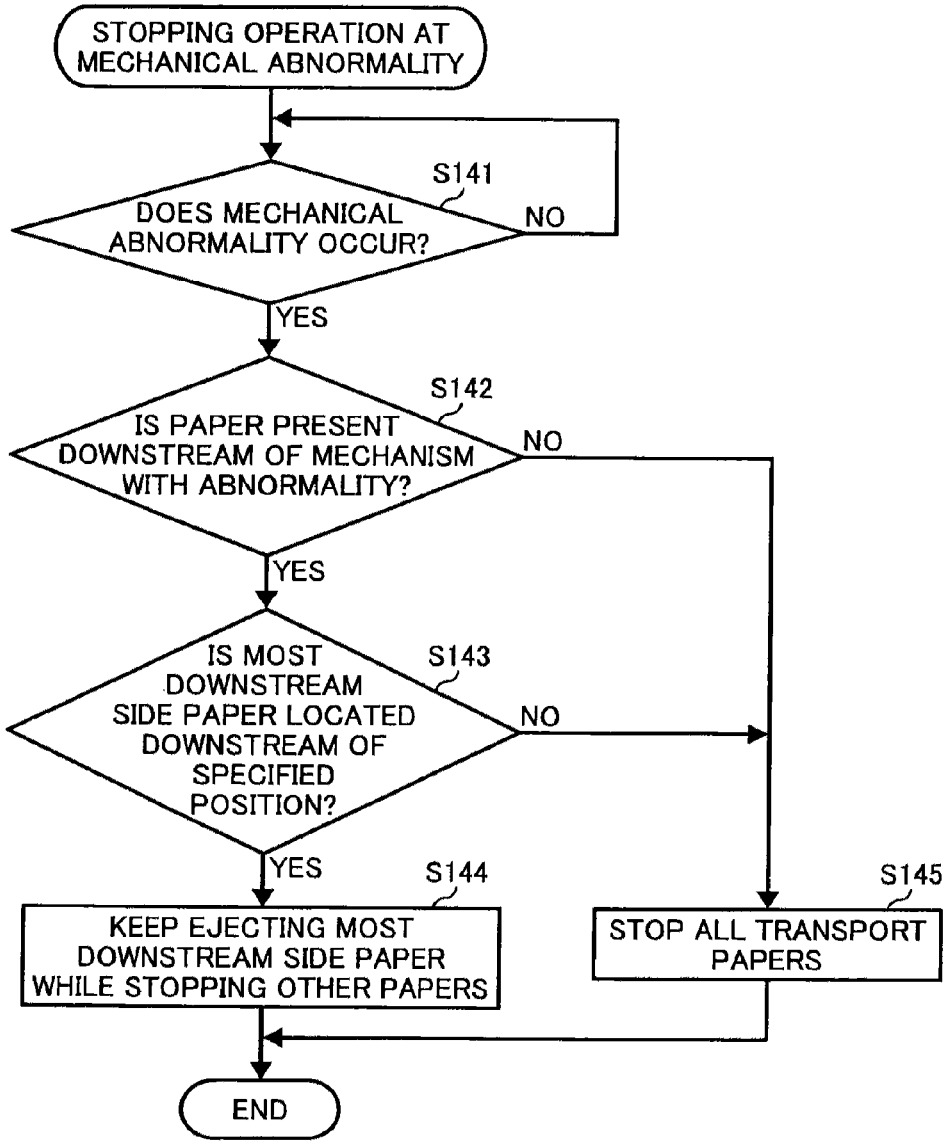
FIG. 44 is a flowchart of a processing procedure of a stopping operation at the time of occurrence of a mechanism abnormality.
Figure 45:
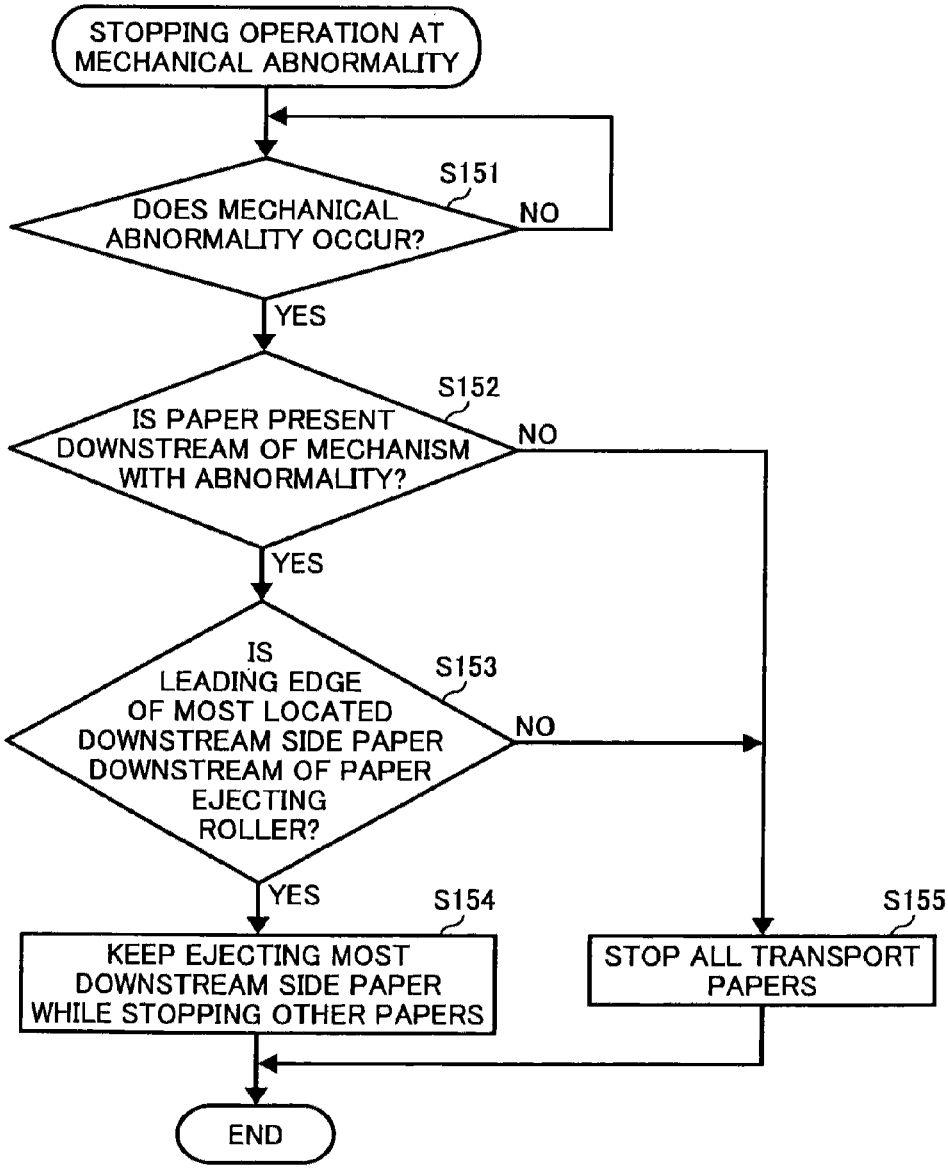
FIG. 45 is a flowchart of another processing procedure of the stopping operation at the time of occurrence of a mechanism abnormality.

FIGS. 42 and 43 depict examples of stopping operations at the time of occurrence of an abnormality. FIGS. 44 and 45 are flowcharts of processing procedures of the stopping operations at the time of occurrence of an abnormality.

The paper post-processing apparatus PD is capable of separately detecting various mechanical abnormalities, such as jamming and operation failure. For example, in a case where an abnormality of a mechanism is detected on the punching unit 100 (Step S141 and Yes at Step S151), when a paper being transported by the transport rollers is not present downstream of the mechanism (Step S142 and No at Step S152) or, even if such a paper is present, when the most downstream side paper 402 is present upstream of the specified position (No at Step S143), for example, the leading edge of the most downstream side paper 402 is located upstream of the paper ejecting roller 6 (No at Step S153), all papers are stopped, as shown in FIG. 43 (Steps S145 and S155). On the contrary, when a paper being transported is present downstream of the mechanism (Step S142 and Yes at Step S152) and the most downstream side paper 402 is present downstream of the specified position (Yes at Step S146), for example, the leading edge of the most downstream side paper 402 is located downstream of the paper ejecting roller 6 (Yes at Step S153), only the most downstream side paper 402 is kept ejected while other papers are stopped, as shown in FIG. 42 (Steps S144 and S154).

In the cases described in 7.1, 7.2, and 7.3, the paper ejecting roller 6 has a driving motor (shift paper ejecting motor (not shown)) independent of other transport rollers. This allows a choice on whether the paper ejecting roller 6 is to be kept operated independently after the stoppage of other transport rollers or stopped simultaneously with the stoppages of other transport rollers.

Each operation described above attains the following effects. When the paper-jamming causing paper 401 is stopped, a paper is stopped at the time of the cover's opening, or a paper is stopped at the time of occurrence of an abnormality, forcedly continuing paper transport at the downstream side may cause troubles, such as folding, tearing, or roller abrasion (soil) on a downstream side paper. For example, at the stoppage of an upstream processing unit, when it is determined that the trailing edge of the most downstream side paper 402 has not passed the stopped transport roller 5 or jamming of the paper-jamming causing paper 401 as a result of contact between the most downstream side paper 402 and the paper-jamming causing paper 401, it is concluded that the most downstream side paper 402 has a trouble such as folding, tearing, or roller abrasion (soil).

On the other hand, if the post-processing apparatus is brought to a full stop when the leading edge of the most downstream side paper 402 is located downstream of the paper ejecting roller 6, the paper ejecting roller 6 is not able to carry out the stop operation in time even if the most downstream side paper 402 is determined to be remained in the post-processing apparatus. Therefore, the paper is ejected onto the shift tray 202 after all or stopped in a state of being exposed out of the post-processing apparatus. When the paper ends up in such a state, the user may pull the paper out of the paper ejecting roller 6 and consider such a pulled-out paper as effective. In such a case, the same image formation and paper processing is carried out again in a recovery process, which results in redundant output.

In the present embodiment, preventing of redundant output in the recovery process is to be attained. Therefore, when the most downstream side paper 402 is at a position that may possibly lead to redundant paper output in the recovery process, only the most downstream side paper 402 is kept ejected onto the shift tray 202. At this time, the most downstream side paper 402 is regarded as the paper ejected normally and completely, and is not the subject of the recovery process. On the contrary, when the most downstream side paper 402 is at a position that does not lead to or less possibly leads to redundant paper output in the recovery process, all transport papers are stopped and are subjected to the recovery process. A specified position used for determining whether the most downstream side paper 402 is to be ejected out of the post-processing apparatus can be set based on various conditions such as a system configuration or an individual user. However, whether the most downstream side paper 402 is exposed out of the post-processing apparatus can be one preferable condition.

7.4 Detection of Position of Ejection Paper

The operations described in 7.1 and 7.3 are carried out to prevent the user from mistakenly considering a noneffective paper as effective. In these operations, it is necessary to exactly detect the position of the leading edge of an ejection paper at the stoppage of the post-processing apparatus. The shift paper ejecting sensor 303 is disposed near the paper ejecting roller 6, and is capable of detecting the leading edge of a transport paper. The position of the leading edge of a paper is detected easily by detecting an amount of rotation of the paper ejecting roller 6 after detection of the leading edge. Therefore, in the present embodiment, an amount of drive of the shift paper ejecting motor (not shown) that drives the paper ejecting roller 6 is to be detected after the shift paper ejecting sensor 303 detects the leading edge of a paper. In this case, if the shift paper ejecting motor is a stepping motor, the number of driving steps is to be counted. This enables detection of the position of the paper's leading edge after detection of the paper's leading edge.

7.5 Use of Transport Roller Having One-Way Clutch

Figure 46:
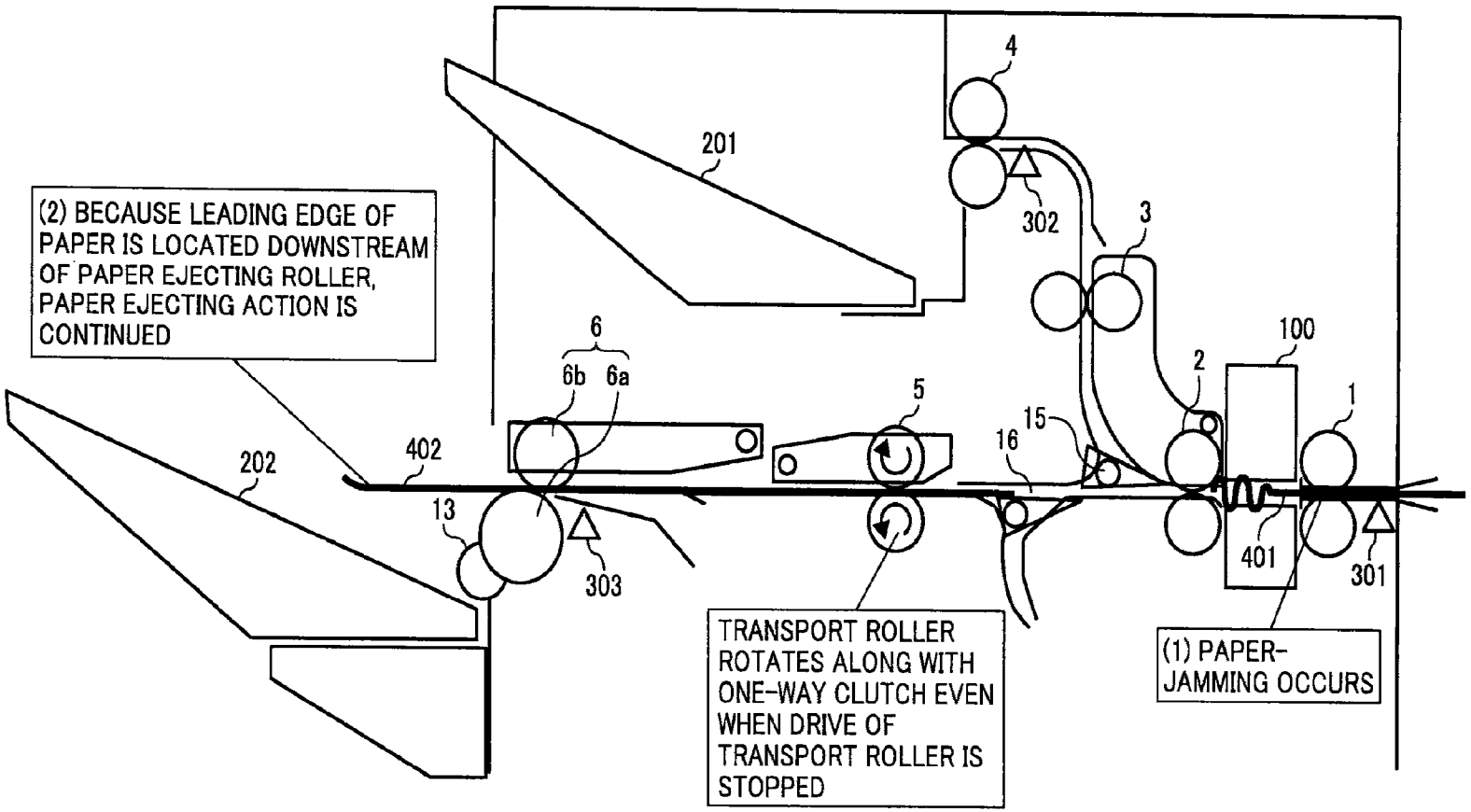
FIG. 46 is an explanatory view of a stopping operation at the time of paper-jamming when a one-way clutch is disposed on a drive system of at least one transport roller other than a shift paper ejecting roller.
Figure 48:
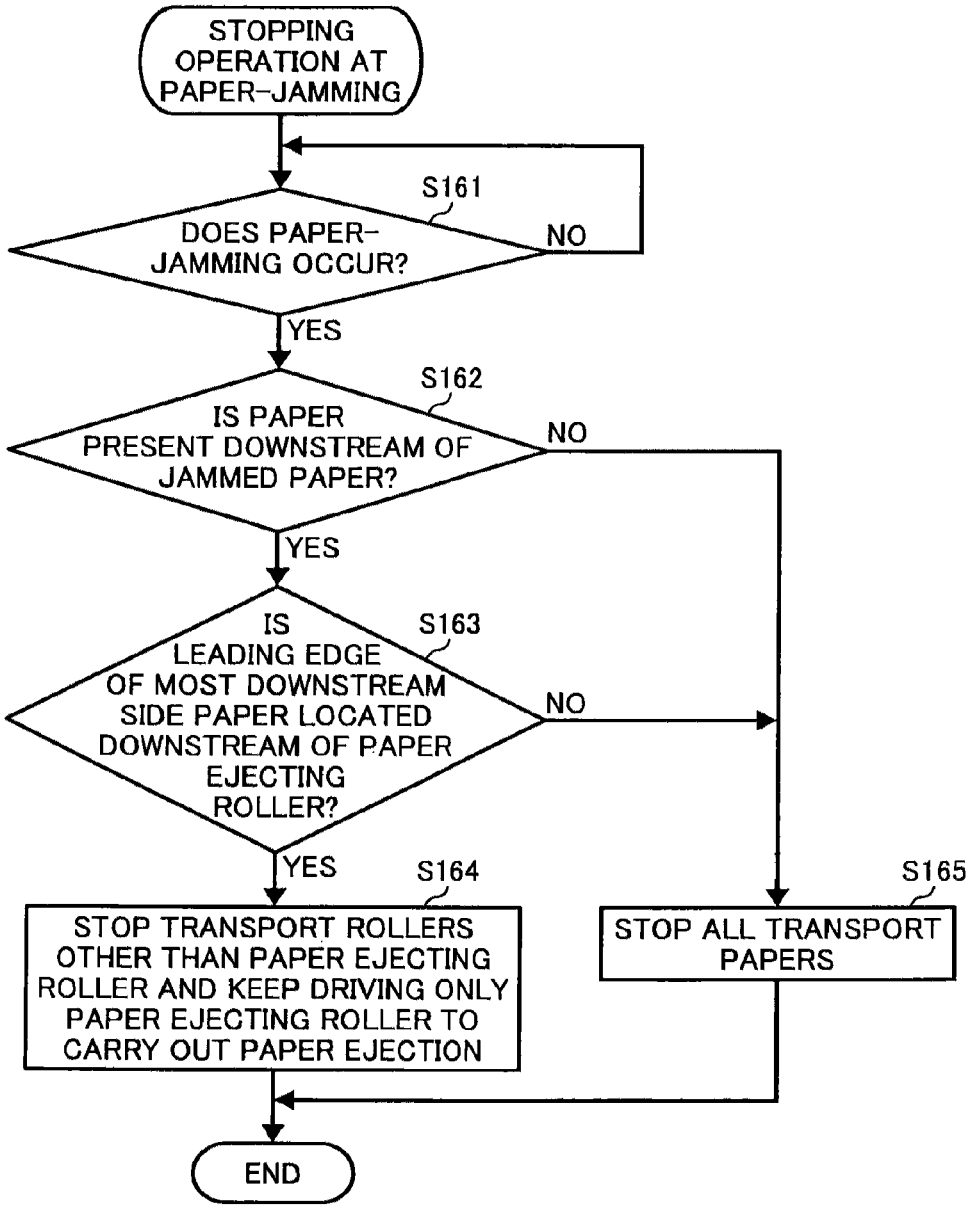
FIG. 48 is a flowchart of a processing procedure of a stopping operation at the time of paper-jamming in the examples shown in FIGS. 46 and 47.

FIG. 46 depicts an example in which the driving shaft of a transport roller is provided with a one-way clutch. Even if driving of the transport roller is suspended, the one-way clutch acts on the transport roller so that the transport roller with the one-way clutch rotates along with moving of a paper in the paper ejecting direction. Explanation is given about an operation that is carried out when the one-way clutch is disposed on the driving shaft of at least one transport roller other than the paper ejecting roller 6, for example, on the transport roller 5. FIG. 46 depicts a stopping operation at the time of paper-jamming, FIG. 48 is a flowchart of an operation procedure at the time of paper-jamming, FIG. 49 is a flowchart of an operation procedure at the time of the cover's opening, and FIG. 50 is a flowchart of an operation procedure at the time of occurrence of an abnormality.

It is preferable to stop an upstream transport roller for safety when paper-jamming, mechanical abnormality, or cover's opening occurs at the upstream side. In the present embodiment, a one-way clutch is disposed on the upstream transport roller (the transport roller 5 in FIG. 46). As shown in FIG. 46, when the most downstream side paper 402 is transported by the transport roller 5 and the paper ejecting roller 6, even if the driving motor of the upstream roller (the transport roller 5) is stopped, the transport roller 5 rotates along with movement of the most downstream side paper 402 by driving the paper ejecting roller 6. As a result, the most downstream side paper 402 is ejected completely without being damaged. Specifically, when the upper limit length of a paper acceptable to the paper post-processing apparatus PD is assumed as L meters, the one-way clutch is disposed on the driving shaft of every transport roller that is other than the paper ejecting roller 6 and that is spaced L meters or less from the paper ejecting roller 6. Therefore, for every acceptable paper, a transport roller provided with the one-way clutch rotates along with movement of the most downstream side paper 402 even when the driving motor of the transport roller is stopped. As a result, the most downstream side paper 402 is ejected completely without any damage.

The paper post-processing apparatus PD having the above configuration carries out a stopping operation at the time of paper-jamming in the following manner. When paper-jamming occurs (Yes at Step S161), the presence/absence of a paper downstream of the paper-jamming causing paper 401 is checked (Step S162). When no paper is present (No at Step S162), all transport rollers are stopped (Step S165). When a paper is present (Yes at Step S162) and the leading edge of the most downstream side paper 402 is not located downstream of the paper ejecting roller 6 (No at Step S163), all transport rollers are stopped (Step S165). When a paper is present and the leading edge of the most downstream side paper 402 is located downstream of the paper ejecting roller 6 (Yes at Step S163), transport rollers other than the paper ejecting roller 6 are stopped to keep driving only the paper ejecting roller 6 (Step S164). This causes a stopped transport roller to rotate along with movement of the most downstream side paper 402, so that the most downstream side paper 402 is ejected by the paper ejecting roller 6.

Figure 49:
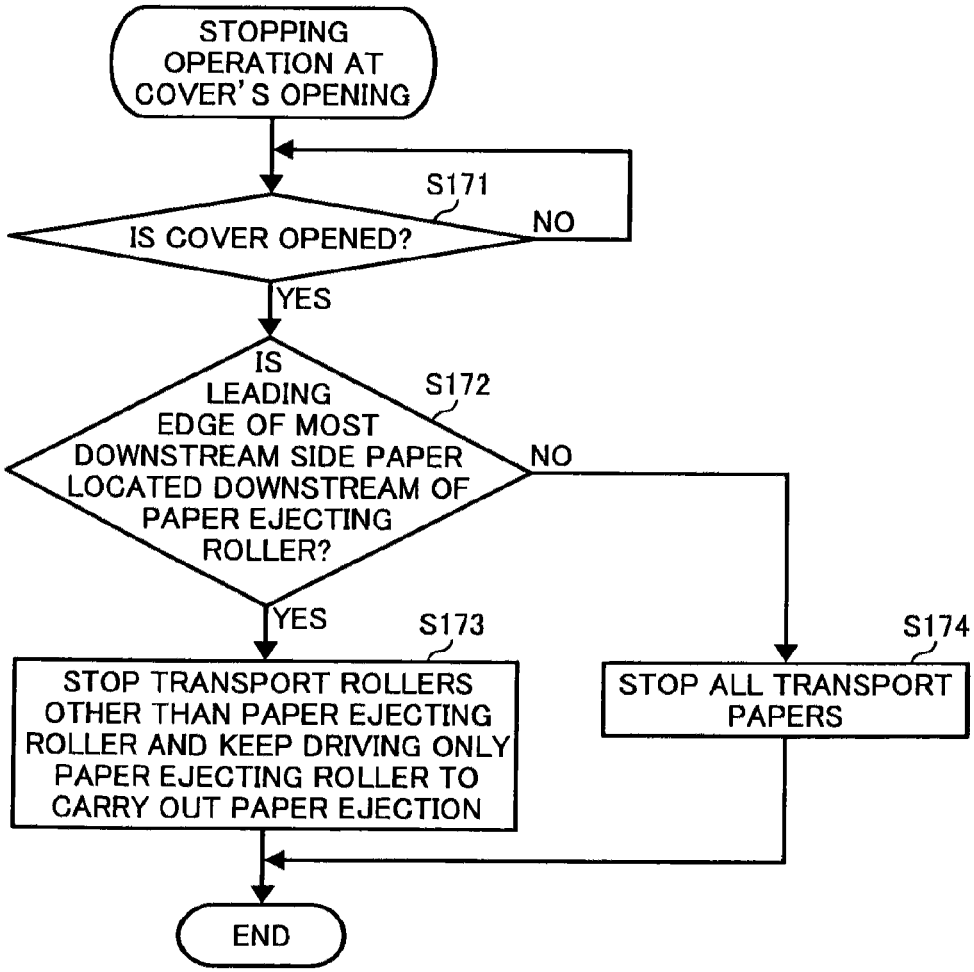
FIG. 49 is a flowchart of a processing procedure of a stopping operation at the time of the cover's opening.
Figure 50:
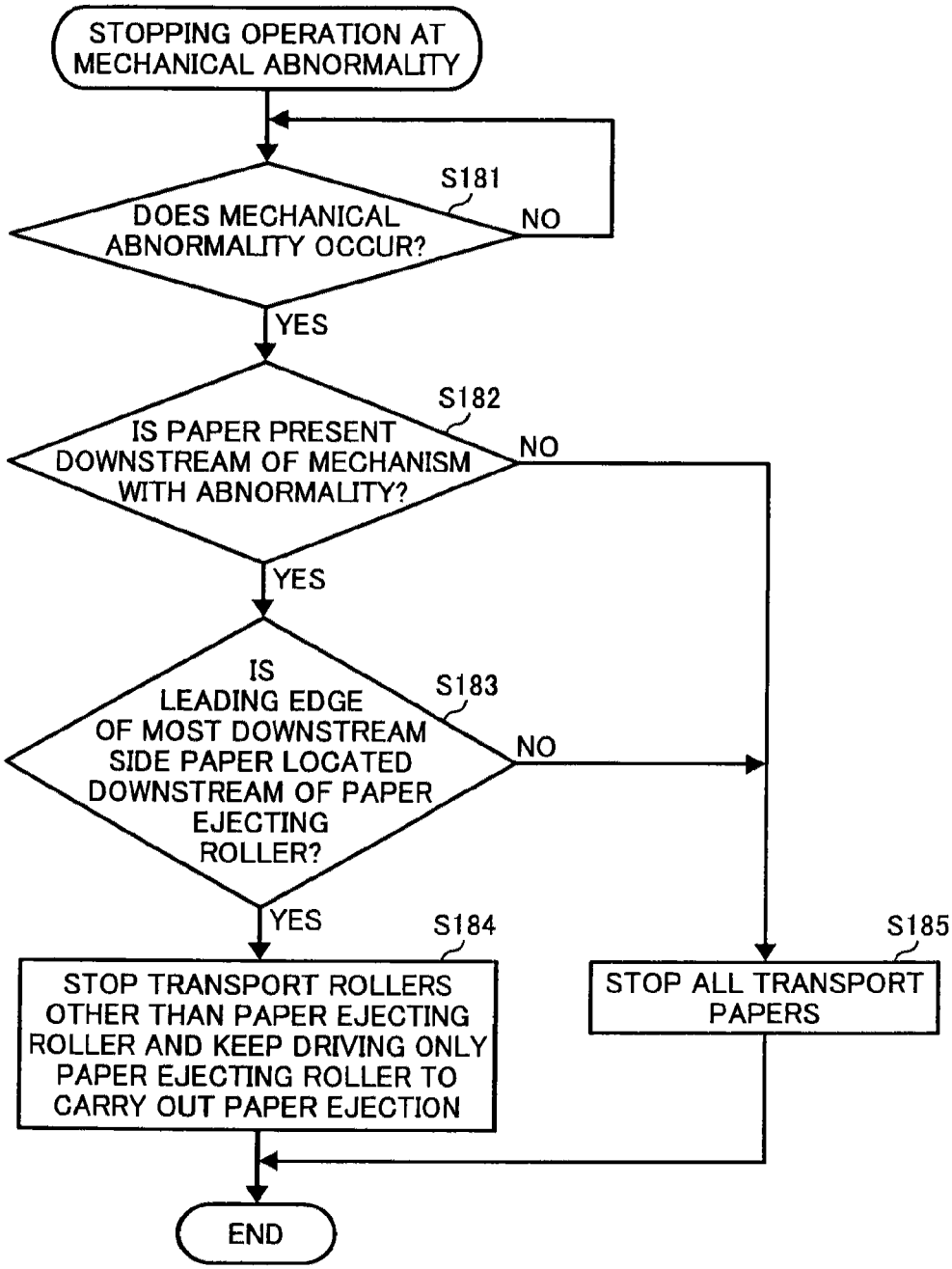
FIG. 50 is a flowchart of a processing procedure of a stopping operation at the time of occurrence of a mechanism abnormality.

When the cover is opened, as shown in FIG. 49, whether the leading edge of the most downstream side paper 402 is located downstream of the paper ejecting roller 6 is checked (Step S172) at the point of the cover's opening (Yes at Step S171). When the leading edge of the most downstream side paper 402 is not located downstream of the paper ejecting roller 6, transport of all transport papers are stopped (Step S174). When the leading edge of the most downstream side paper 402 is located downstream of the paper ejecting roller 6, transport rollers other than the paper ejecting roller 6 are stopped to keep driving only the paper ejecting roller 6 to carry out paper ejection. This causes a stopped roller to rotate along with movement of the most downstream side paper 402, so that the most downstream side paper 402 is ejected by the paper ejecting roller 6.

When a mechanical abnormality occurs, as shown in FIG. 50, the presence/absence of a paper downstream of an abnormality developing spot is checked (Step S182) at the point of occurrence of an abnormality (Yes at Step S181). When a paper is not present (No at Step S182), all transport rollers are stopped (Step S185). When a paper is present (Yes at Step S182) and the leading edge of the most downstream side paper 402 is not located downstream of the paper ejecting roller 6 (No at Step S183), transport of all transport papers are stopped (Step S185). When a paper is present and the leading edge of the most downstream side paper 402 is located downstream of the paper ejecting roller 6 (Yes at Step S183), transport rollers other than the paper ejecting roller 6 are stopped to keep driving only the paper ejecting roller 6 (Step S184). This causes a stopped roller to rotate along with movement of the most downstream side paper 402, so that the most downstream side paper 402 is ejected by the paper ejecting roller 6.

7.6 Use of Transport Roller Having Small Friction Coefficient

Figure 47:
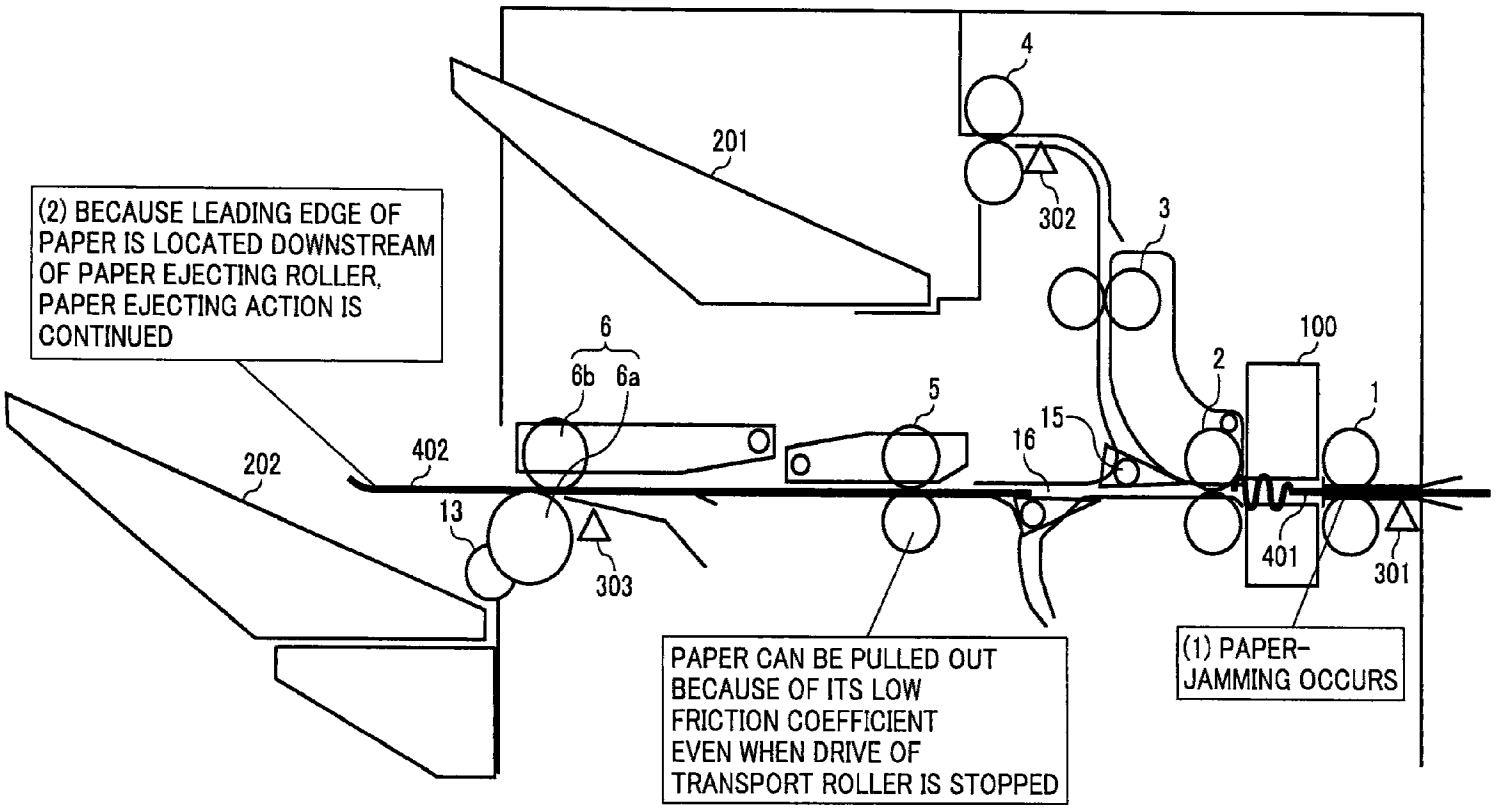
FIG. 47 is an explanatory view of a stopping operation at the time of paper-jamming when the friction coefficient of at least one transport roller other than the shift paper ejecting roller is set to be smaller than the friction coefficient of the shift paper ejecting roller.

The same operation as described in 7.5 is achieved when the friction coefficient of a transport roller is set to be smaller than that of the paper ejecting roller, instead of providing the transport roller with the one-way clutch. Therefore, the transport roller 5 can be one having a small friction coefficient. FIG. 47 is an explanatory view of a stopping operation at the time of paper-jamming that is carried out when the transport roller 5 has a small friction coefficient.

When the transport roller 5 has a small friction coefficient, a paper is caused to slip over the transport roller 5 by the transport action of the paper ejecting roller 6 and thereby the paper is ejected out. Other operation procedures are the same as those described in connection with FIGS. 48 to 50, and, therefore, redundant description will be omitted.

As shown in FIG. 47, when the most downstream side paper 402 is transported by the transport roller 5 and the paper ejecting roller 6, even if the driving motor of the upstream roller (the transport roller 5) is stopped, the most downstream side paper 402 is caused to slip over the transport roller 5 by keeping driving the paper ejecting roller 6. As a result, the most downstream side paper 402 is ejected completely without being damaged.

In this case, when the upper limit length of a paper acceptable to the paper post-processing apparatus PD is assumed as L meters, the friction coefficient of every transport roller that is other than the paper ejecting roller 6 and that is spaced L meters or less from the paper ejecting roller 6 is determined to be smaller than the friction coefficient of the paper ejecting roller 6. As a result, for every acceptable paper, the most downstream side paper 402 is ejected completely without being damaged when the operations described in the flowcharts of FIGS. 48 to 50 are carried out.

7.7 Transport Operation for Paper Long in Transport Direction

Figure 52:
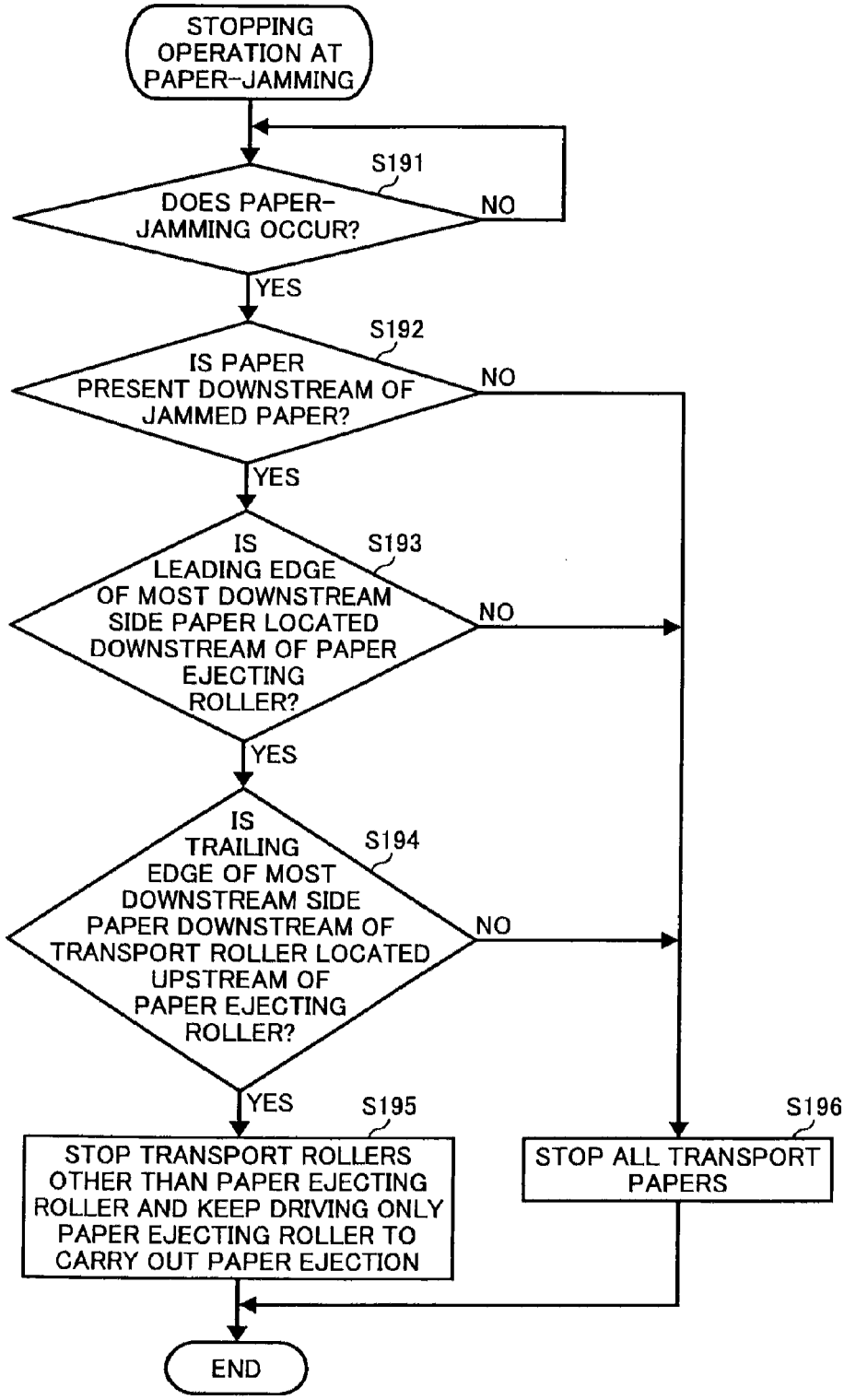
FIG. 52 is a flowchart of a processing procedure of a stopping operation at the time of paper-jamming in the example shown in FIG. 51.
Figure 53:
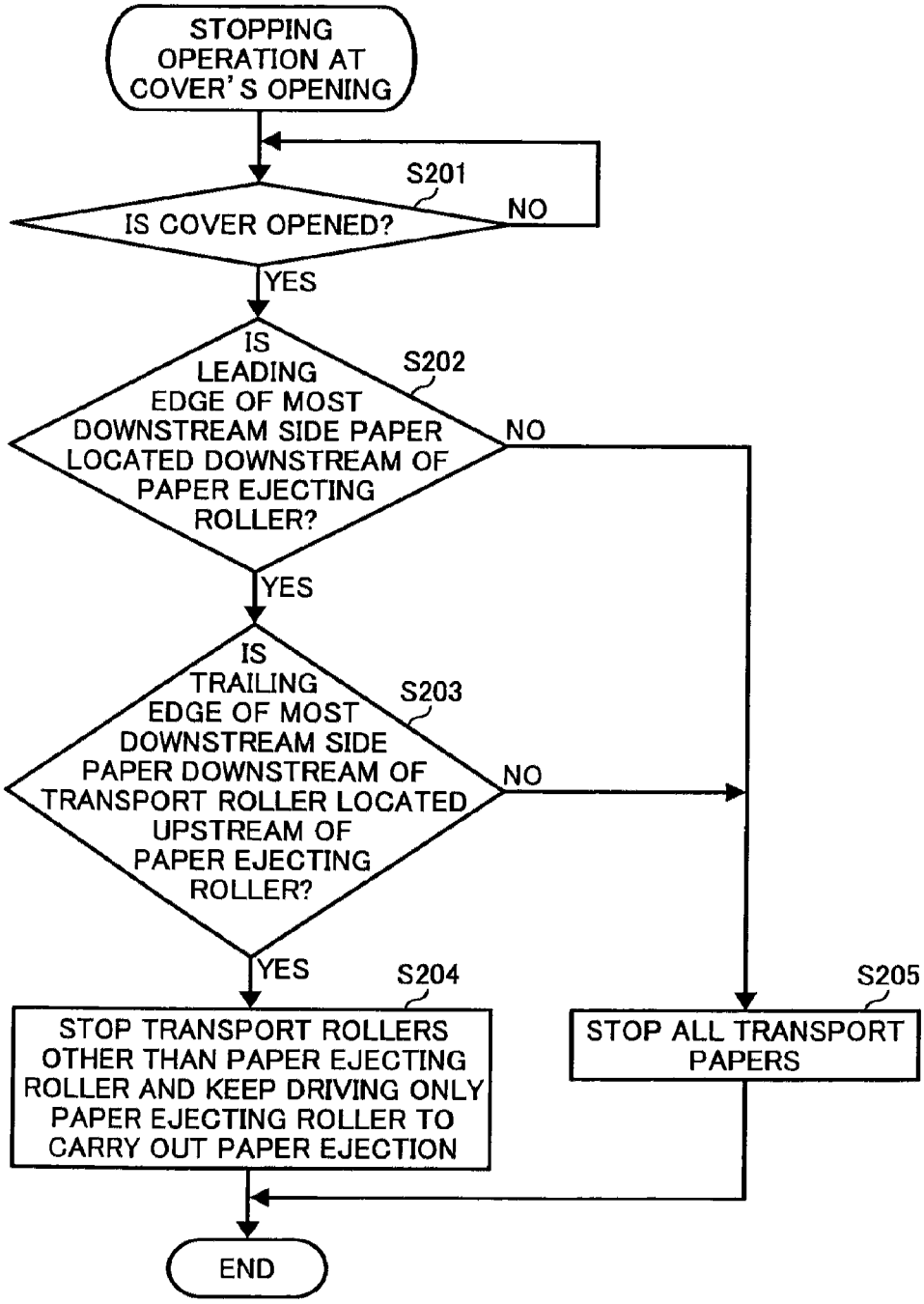
FIG. 53 is a flowchart of a processing procedure of a stopping operation at the time of the cover's opening when the most downstream side paper is in a state shown in FIG. 51.

FIG. 51 is an explanatory view of a stopping operation for a paper that is long enough to bridge the transport roller 5 and the paper ejecting roller 6 as a single paper. FIG. 52 is a flowchart of an operation procedure at the time of paper-jamming. FIG. 53 is a flowchart of an operation procedure at the time of the cover's opening. FIG. 50 is a flowchart of an operation procedure at the time of occurrence of an abnormality.

According to the operations described in 7.1 and 7.3, the paper ejecting roller 6 ejects a paper nipped by the paper ejecting roller 6 when the leading edge of the most downstream side paper 402 is located downstream of the paper ejecting roller 6. In contrast, in this example, when such a stoppage condition as paper-jamming, cover's opening, and abnormality occurs, transport rollers are stopped to prevent ejection of all papers out of the post-processing apparatus when the leading edge of the most downstream side paper 402 is located downstream of the specific position but the trailing edge of the most downstream side paper 402 is located upstream of the trailing transport roller (the transport roller 5). This suppresses a cost increase, and prevents complete ejection of the most downstream side paper 402 that has been damaged.

The paper post-processing apparatus PD having the above configuration carries out a stopping operation at the time of paper-jamming in the following manner. As shown in FIG. 52, at the point of occurrence of paper-jamming (Yes at Step S191), whether a paper is present downstream of a paper-jamming causing paper is checked (Step S192). When a paper is present (Yes at Step S192), the leading edge of the most downstream side paper 402 is located downstream of the paper ejecting roller 6 (Yes at Step S193), and the trailing edge of the most downstream side paper 402 is located downstream of a transport roller that is upstream of the transport roller 5 (Yes at Step S194), the transport rollers other than the paper ejecting roller 6 are stopped to keep driving only the paper ejecting roller 6 to carry out paper ejection (Step S195).

When a paper is not present downstream of the paper-jamming causing paper (jammed paper) at Step S192, and if the leading edge of the most downstream side paper is located upstream of the paper ejecting roller 6 at Step S193 and the trailing edge of the most downstream side paper is located downstream of the transport roller that is upstream of the paper ejecting roller 6 at Step S194, all transport papers are stopped (Step S196).

In execution of the stopping operation at the time of the cover's opening, as shown in FIG. 53, when the leading edge of the most downstream side paper 402 is located downstream of the paper ejecting roller 6 (Yes at Step S202) and the trailing edge of the most downstream side paper is located downstream of the transport roller that is upstream of the paper ejecting roller 6 (Yes at Step S203) at the point of occurrence of paper-jamming (Yes at Step S201), transport rollers other than the paper ejecting roller 6 are stopped to keep driving only the paper ejecting roller 6 to carry out paper ejection (Step S204). When the leading edge of the most downstream side paper 402 is located upstream of the paper ejecting roller 6 at Step S202, and the trailing edge of the most downstream side paper is located downstream of the transport roller that is upstream of the paper ejecting roller 6 at Step S203, all transport papers are stopped (Step S205).

Figure 54:
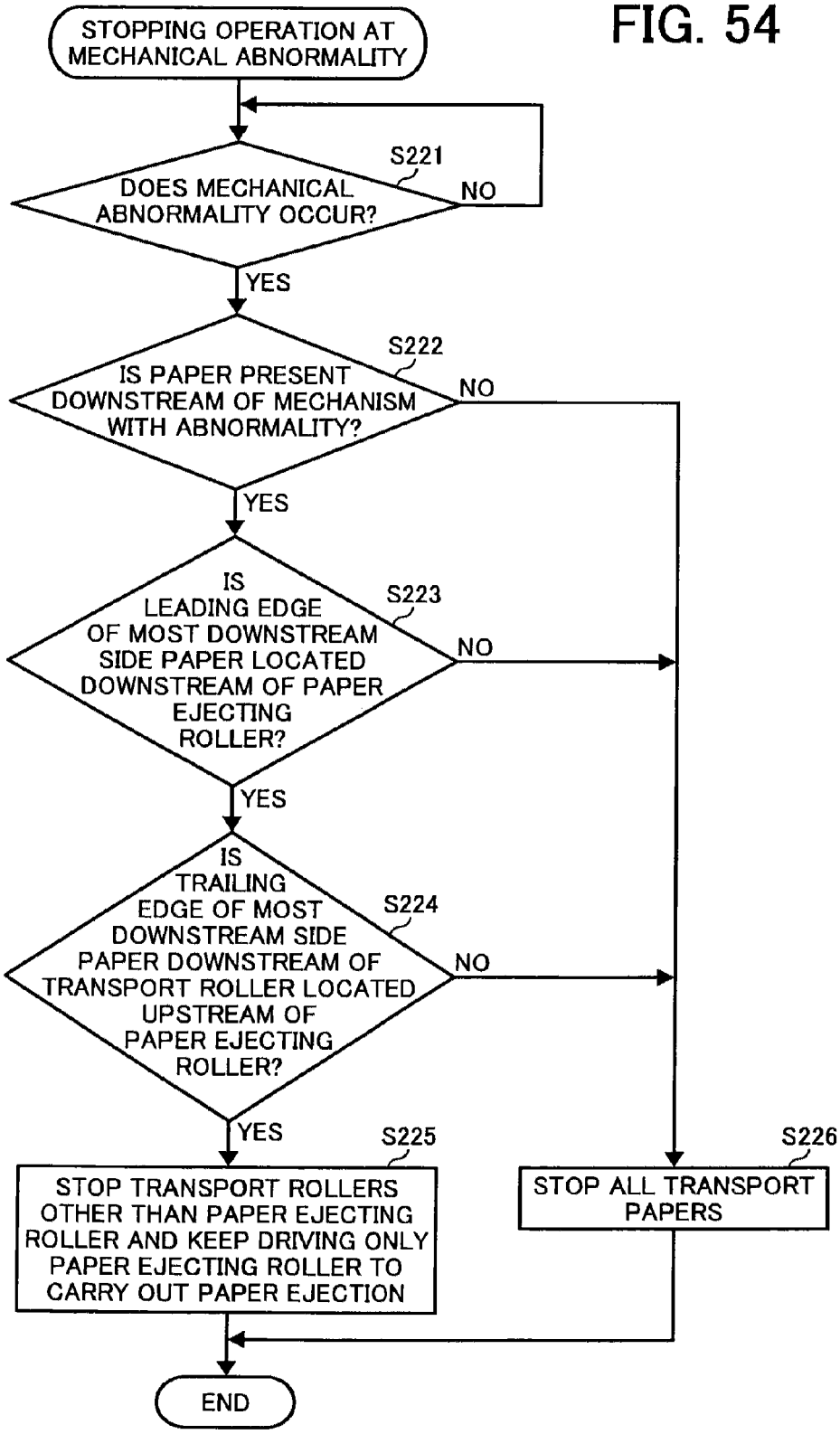
FIG. 54 is a flowchart of a processing procedure of a stopping operation at the time of occurrence of a mechanism abnormality when the most downstream side paper is in a state shown in FIG. 51.

In execution of the stopping operation at the time of occurrence of an abnormality, as shown in FIG. 54, at the point of occurrence of a mechanical abnormality (Yes at Step S221), whether a paper is present downstream of an abnormality developing spot is checked (Step S222). When a paper is present (Yes at Step S222), the leading edge of the most downstream side paper 402 is located downstream of the paper ejecting roller 6 (Yes at Step S223), and the trailing edge of the most downstream side paper 402 is located downstream of a transport roller that is located upstream of the paper ejecting roller 6 (Yes at Step S224), the transport rollers other than the paper ejecting roller 6 are stopped to keep driving only the paper ejecting roller 6 to carry out paper ejection (Step S225).

When a paper is not present downstream of the paper-jamming causing paper at Step S222, and if the leading edge of the most downstream side paper is located upstream of the paper ejecting roller 6 at Step S223 and the trailing edge of the most downstream side paper is located downstream of the transport roller that is located upstream of the paper ejecting roller 6 at Step S224, all transport papers are stopped (Step S226).

The above operation control is carried out to prevent a cost increase and an abrasion on an image, and to prevent a user from mistakenly considering a noneffective paper as effective. To achieve this, it is necessary to exactly detect the position of the leading edge and the trailing edge of an ejection paper at the stoppage of the post-processing apparatus. The position of the trailing edge of a paper is detected by the paper trailing edge detecting sensor 306 disposed near the transport roller 5 as described in connection with FIG. 51. After the initial detection, the position of the rear of the paper can be detected by counting an amount of driving of the shift paper ejecting motor (not shown) (number of drive steps in the case of a stepping motor) from the point of initial detection.

7.8 Reverse Operation of Paper Ejecting Roller

As described above, when a paper comes to a stop in a state of being exposed out of the post-processing apparatus, the user may pull the paper out of the paper ejecting roller and considers the paper as effective. In this example, when the paper ejecting roller is forced to be stopped because the leading edge of the most downstream side paper 402 is exposed out of the post-processing apparatus, the paper ejecting roller 6 is reversed to pull the exposed paper into the post-processing apparatus to prevent the user from pulling the paper from the paper ejecting roller 6.

Figure 55:
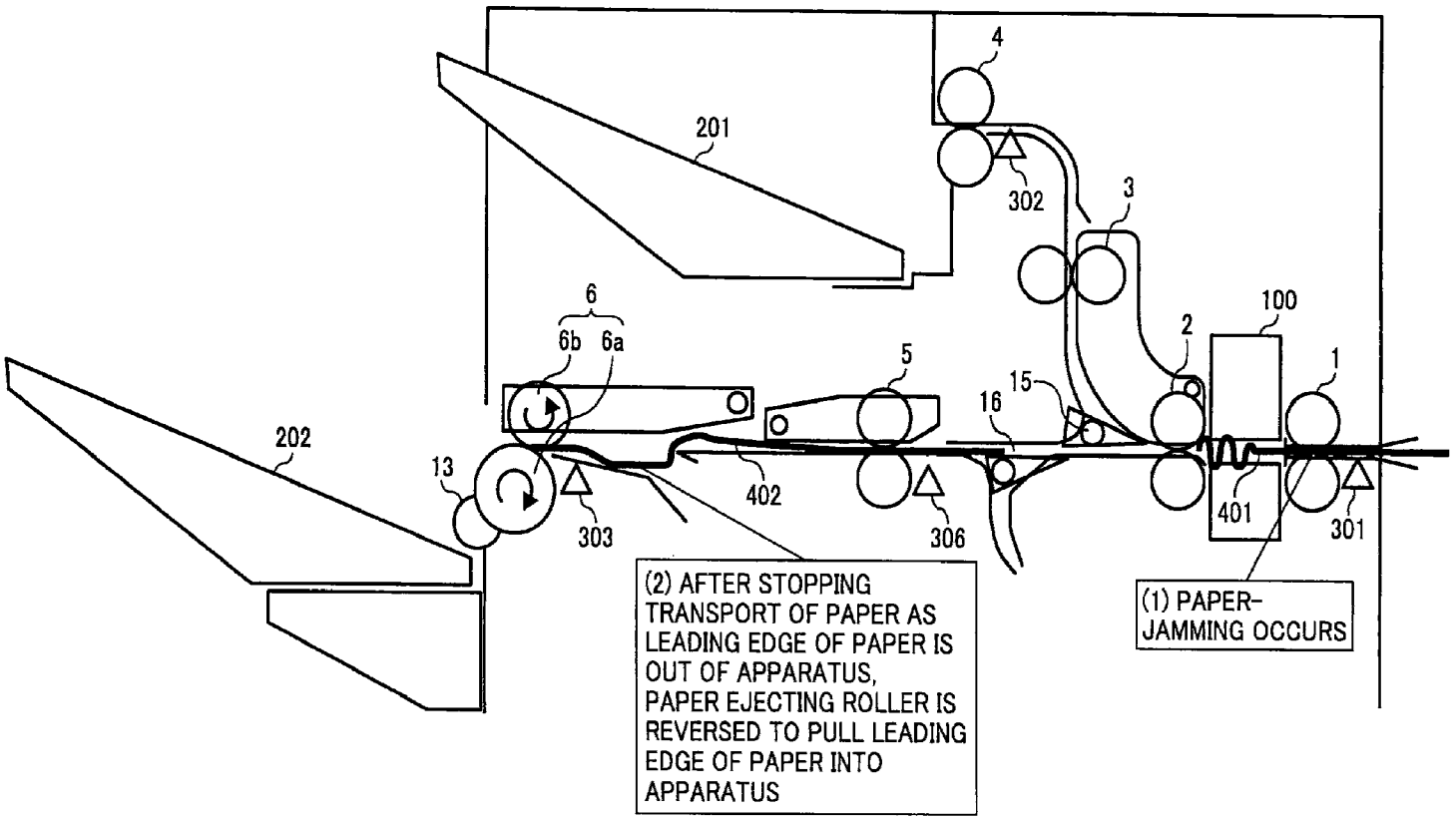
FIG. 55 is an explanatory view of an operation of preventing a user from pulling out a paper from the paper ejecting roller when the paper ejecting roller is forced to stop as the leading edge of the most downstream side paper is exposed out of the post-processing apparatus.
Figure 56:
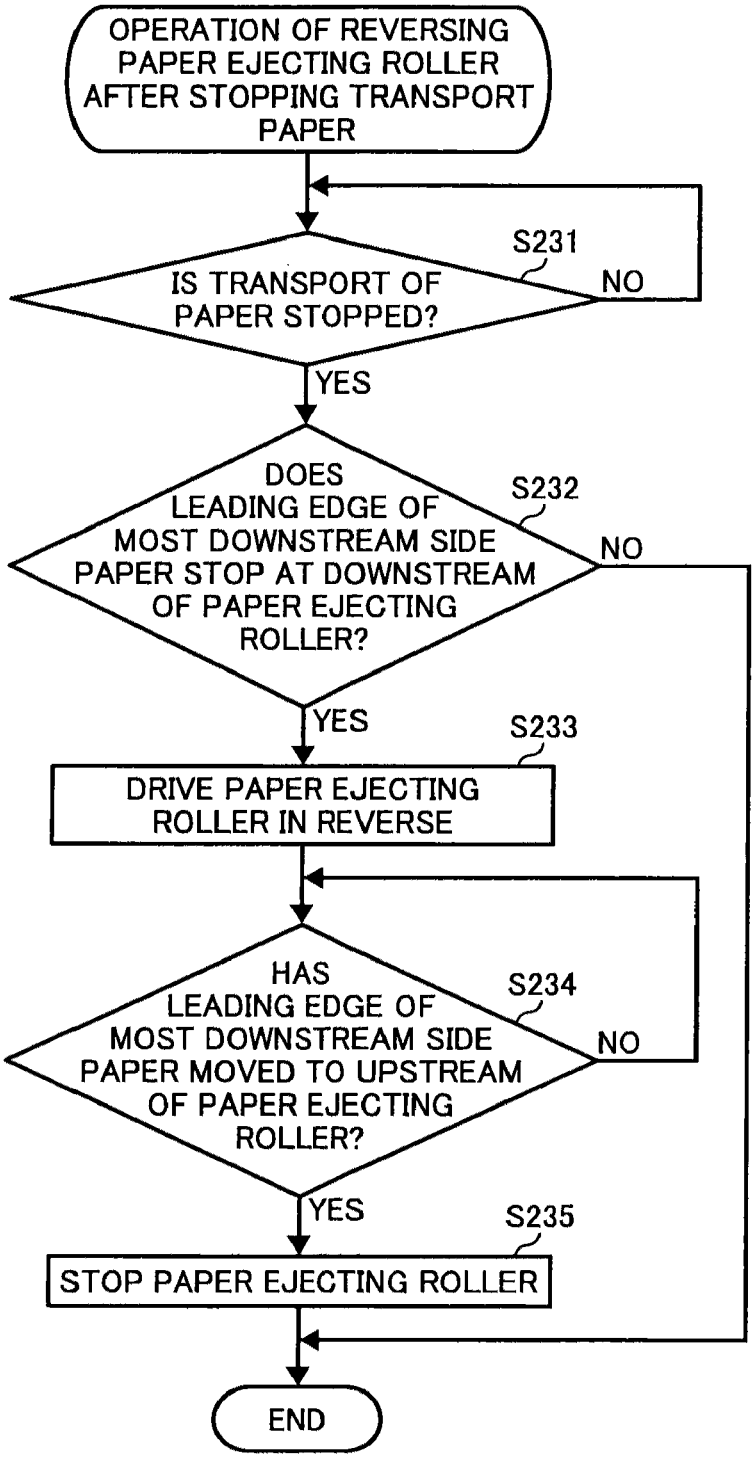
FIG. 56 is a flowchart of a processing procedure of a reverse operation of the paper ejecting roller after stopping transport of a paper in the state shown in FIG. 55.

FIG. 55 is an explanatory view of a reverse operation of the paper ejecting roller, and FIG. 56 is a flowchart of a processing procedure of the reverse operation of the paper ejecting roller. When the above stoppage operation occurs during ejection of a paper by the paper ejecting roller 6 and transport papers come to a stop (Yes at Step S231), the stop position of the leading edge of the most downstream side paper 402 is checked (Step S232). If the leading edge of the most downstream side paper 402 stops at the downstream side of the paper ejecting roller 6 (Yes at Step S232), the paper ejecting roller 6 is driven in reverse until the leading edge of the most downstream side paper 402 moves up to the upstream side of the nip of the paper ejecting roller 6 (Steps S233, S234, and S235). As a result, the most downstream side paper 402 in the state of FIG. 51 at step S231 changes to be in the state of FIG. 55 at step S235. In the state of FIG. 55, the leading edge of the most downstream side paper 402 has just passed through the nip of the paper ejecting roller 6.

In the present embodiment, after a paper remaining in the post-processing apparatus is removed, processing of the remaining paper and image formation are carried out again. Therefore, it is possible to carry out the recovery process without redundant paper output after the stoppage of the post-processing apparatus due to occurrence of paper-jamming, cover's opening during paper transport, or mechanical abnormality.

According to the present embodiments, the following effects are to be attained.

1) A stopping operation is carried out for preventing redundant output in the recovery process. Therefore, it is possible to prevent redundant paper output to be performed when the recover process is carried out after the stoppage of the post-processing apparatus due to paper-jamming, cover's opening during paper transport, and mechanical abnormality detection.

2) When the transport operation is stopped because a paper is exposed out of the post-processing apparatus, a user may pull the paper out of the paper ejecting roller to consider the paper as effective. If the paper is exposed out of the paper ejecting roller toward the downstream side to a small extent, a user is not likely to consider a paper as effective. However, even in such a case, if a user pulls out the paper, a redundant output is carried out. To deal with such a situation, in the present embodiment, whether the paper ejecting operation is continued is determined based on whether the leading edge of the paper is out of the post-processing apparatus. This prevents redundant paper output when the recovery process is carried out.

3) The shift paper ejecting sensor capable of detecting the passage of the leading edge of a paper is disposed near the paper ejecting roller. This enables exact detection of the position of the leading edge of an ejection paper.

4) When only the most downstream side paper is completely ejected in each case of transport stoppage, if the trailing edge of the most downstream side paper has not passed through a transport roller other than the paper ejecting roller, the transport roller is not allowed to stop. However, considering safety at the time of paper-jamming at the upstream side, mechanical abnormality, or cover's opening, it is preferable to immediately stop the transport roller on the upstream side. In the present embodiment, the drive system of the transport roller is provided with a one-way clutch. Because of this, the paper ejecting roller alone can eject most downstream side paper completely even if the transport roller at the upstream side is stopped immediately.

5) In the present embodiment, the friction coefficient of a transport roller other than the paper ejecting roller is set to be smaller than the friction coefficient of the paper ejecting roller. Because of this, the paper ejecting roller alone can eject most downstream side paper completely even if the transport roller at the upstream side is stopped immediately.

6) Even when the trailing edge of the most downstream side paper has not passed through a transport roller other than the paper ejecting roller in each case of transport stoppage, only the most downstream side paper is ejected completely. However, use of the one-way clutch leads to an increase in the cost of the post-processing apparatus. Furthermore, reducing the friction coefficient of the transport roller to allow the paper to be dragged out may cause an abrasion on an image depending on the state of the image or the paper. Besides, when the most downstream side paper is exposed out of the post-processing apparatus in each case of transport stoppage, if an extent of exposure is small, a user is not likely to pull the paper out of the paper ejecting roller. For these reasons, in the present embodiment, when the trailing edge of the paper is located upstream of the most downstream side transport roller other than the paper ejecting roller, transport rollers are stopped to prevent ejection of all papers out of the post-processing apparatus. This prevents redundant output in the recovery process without increasing costs and abrasion on an image.

7) The paper trailing edge detecting sensor capable of detecting the passage of the trailing edge of a paper is disposed near the most downstream side transport roller other than the paper ejecting roller. This enables exact detection of the position of the trailing edge of a paper to be ejected.

8) When the paper ejecting roller is forced to be stopped because the leading edge of a paper is exposed out of post-processing apparatus, the exposed paper is pulled into the post-processing apparatus by reversing the paper ejecting roller. This prevents an accident that the user pulls the paper out of the paper ejecting roller to consider the paper as effective when the paper ejecting roller is stopped with the paper exposed out of post-processing apparatus.

9) After a paper remaining in the post-processing apparatus is removed, processing of the remaining paper and image formation are carried out again. As a result, the recovery process is carried out without redundant paper output after the stoppage of the post-processing apparatus due to occurrence of paper-jamming, cover's opening during paper transport, and mechanical abnormality.

While preferred embodiments have been described heretofore, those skilled in the art will be able to offer various alternatives, modifications, and variants based on the disclosed contents of the present specification. These alternatives, modifications, and variants are included in the scope of the invention that is specified by the accompanying clams.

According to an aspect of the present invention, it is possible to prevent a paper being transported by transporting rollers from being damaged by folding, tearing, roller abrasion (soil), or the like even when the trailing edge of the paper has not passed a roller that is forced to be stopped due to an event that causes stopping of transport rollers.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A paper transport device used in a paper processing apparatus for an image forming apparatus, the paper transport device comprising:

a plurality of transport rollers to transport at least one paper at a time, the transport rollers includes an ejecting roller which is disposed at a most downstream of all transport rollers and which is configured to run independently of all other transport rollers in one paper transport device;

a paper-jamming detecting unit to detect a paper-jamming of a paper that is being transported by the transport rollers;

a position detecting unit to detect positions of papers that are being transported by the transport rollers; and a control unit to control driving of the transport rollers, wherein when the paper-jamming detecting unit detects the paper-jamming and the position detecting unit detects that a part of a paper is not exposed on an outside of the paper processing apparatus, the control unit stops the transport rollers to prevent ejection of all the papers from the paper processing device, and when the paper-jamming detecting unit detects paper-jamming and the position detecting unit detects that a part of a paper is exposed on an outside of the paper processing apparatus and another part of the same paper passes through the transport roller immediately before the ejecting roller, the control unit drives the ejecting roller to complete ejection of only the paper the part of which is exposed on the outside of the paper processing apparatus.

2. The paper transport device according to claim 1, wherein the part of the paper is a leading edge of a most downstream paper, and the position detecting unit detects whether the leading edge of the most downstream paper is exposed on the outside of the paper processing apparatus, when the paper jamming is detected.

3. The paper transport device according to claim 2, further comprising a first detecting unit which is disposed proximal to the ejection roller to detect whether the leading edge of the most downstream paper passes through the ejecting roller.

4. The paper transport device according to claim 1, further comprising a one-way clutch disposed on a drive system of at least one of the transport rollers which are located on an upstream of the ejecting roller.

5. The paper transport device according to claim 1, further comprising a one-way clutch disposed on each of drive systems of transport rollers other than the ejecting roller, the transport rollers other than the ejecting roller being located on the upstream of the ejecting roller and within a predetermined distance from the ejecting roller, the predetermined distance being equal to an uppermost paper length operable by the paper processing apparatus.

6. The paper transport device according to claim 1, wherein the another part of the same paper is a trailing edge of the paper whose leading edge is exposed on the outside of the paper processing apparatus, and if the position detecting unit detects that the trailing edge of the paper, whose leading edge is exposed on the outside of the paper processing apparatus, is located on the upstream of the transport roller immediately before the ejecting roller, when the control unit stops the transport rollers to prevent ejection of all the papers from the paper transport device.

7. The paper transport device according to claim 6, further comprising a second detecting unit which is disposed proximal to the transport roller immediately before the ejecting roller to detect whether the trailing edge of the paper, whose leading edge is exposed on the outside of the paper processing apparatus, passes through the transport roller immediately before the ejecting roller.

8. A paper processing apparatus comprising the paper transport device according to claim 1.

9. An image forming apparatus comprising the paper processing apparatus according to claim 8.

10. An image forming apparatus comprising the paper transport device according to claim 1.

11. The paper transport device according to claim 1, further comprising at least one of a stapling unit and a folding unit.

12. The paper transport device according to claim 1, wherein the control unit drives only the ejecting roller to complete ejection of the preceding paper.

13. The paper transport device according to claim 1, wherein the part of the paper which is exposed on the outside of the paper processing apparatus is viewable from the outside of the apparatus.

14. The paper transport device according to claim 1, wherein any recovery process is not performed on the ejected paper.

15. A paper transport device used in a paper processing apparatus for an image forming apparatus, the paper transport device comprising:

a plurality of transport rollers to transport at least one paper at a time, the transport rollers includes an ejecting roller which is disposed at a most downstream of all transport rollers and which is configured to be driven independently of all other transport rollers in one paper transport device;

an abnormality detecting unit to detect for an operational failure of each of mechanisms of the paper transfer device;

a position detecting unit to detect positions of papers that are being transported by the transport rollers; and a control unit to control driving of the transport rollers, wherein when the abnormality detecting unit detects an operational failure of at least one of the mechanisms and the position detecting unit detects that a part of a paper is not exposed on an outside of the paper processing apparatus, the control unit stops the transport rollers to prevent ejection of all the papers from the paper transport device, and when the abnormality detecting unit detects an operational failure of at least one of the mechanisms and the position detecting unit detects that a part of a paper is exposed on an outside of the paper processing apparatus and another part of the same paper passes through the transport roller immediately before the ejecting roller, the control unit drives the ejecting roller to complete ejection of only the paper the part of which is exposed on the outside of the paper processing apparatus.

16. The paper transport device according to claim 15, wherein the another part of the same paper is a trailing edge of the paper whose leading edge is exposed on the outside of the paper processing apparatus, and if the position detecting unit detects that the trailing edge of the paper, whose leading edge is exposed on the outside of the paper processing apparatus, is located on the upstream of the transport roller immediately before the ejecting roller, when the operational failure is detected, the control unit stops the transport rollers to prevent ejection of all the papers from the paper transport device.

17. The paper transport device according to claim 16, further comprising a second detecting unit which is disposed proximal to the transport roller immediately before the ejecting roller to detect whether the trailing edge of the paper, whose leading edge is exposed on the outside of the paper processing apparatus, passes through the transport roller immediately before the ejecting roller.

18. A paper processing apparatus comprising the paper transport device according to claim 15.

19. An image forming apparatus comprising the paper processing apparatus according to claim 18.

20. An image forming apparatus comprising the paper transport device according to claim 15.

21. The paper transport device according to claim 15, wherein the part of the paper is a leading edge of a most downstream paper, and the position detecting unit detects whether the leading edge of the most downstream paper is exposed on the outside of the paper processing apparatus, when the operational failure is detected.

22. The paper transport device according to claim 21, further comprising a first detecting unit which is proximal to the ejection roller to detect whether the leading edge of the most downstream paper passes through the ejecting roller.

23. The paper transport device according to claim 15, further comprising a one-way clutch disposed on a drive system of at least one of the transport rollers which are located on an upstream of the ejecting roller.

24. The paper transport device according to claim 15, further comprising a one-way clutch disposed on each of drive systems of transport rollers other than the ejecting roller, the transport rollers other than the ejecting roller being located on the upstream of the ejecting roller and within a predetermined distance from the ejecting roller, the predetermined distance being equal to a maximum paper length operable by the paper processing apparatus.

* * * * *